US012246224B2

(12) United States Patent
Martino

(10) Patent No.: US 12,246,224 B2
(45) **Date of Patent: *Mar. 11, 2025**

(54) ELECTRIC MOTOR AND PROPELLER DRIVEN TOY ROCKET

(71) Applicant: Marc Gregory Martino, Westlake Village, CA (US)

(72) Inventor: Marc Gregory Martino, Westlake Village, CA (US)

( * ) Notice: Subject to any disclaimer, the term of this patent is extended or adjusted under 35 U.S.C. 154(b) by 318 days.

This patent is subject to a terminal disclaimer.

(21) Appl. No.: 16/888,706

(22) Filed: May 30, 2020

(65) Prior Publication Data

US 2020/0330888 A1 Oct. 22, 2020

Related U.S. Application Data

(63) Continuation of application No. 15/917,845, filed on Mar. 12, 2018, now Pat. No. 10,668,332, which is a continuation of application No. 15/695,011, filed on Sep. 5, 2017, now Pat. No. 9,943,731, which is a continuation of application No. 14/261,563, filed on Apr. 25, 2014, now Pat. No. 9,782,636, which is a (Continued)

(51) Int. Cl.

| | |
|---|---|
| ***A63B 43/00*** | (2006.01) |
| ***A63H 27/00*** | (2006.01) |
| ***A63H 27/14*** | (2006.01) |
| ***A63H 29/22*** | (2006.01) |
| ***A63H 31/08*** | (2006.01) |
| ***A63H 33/18*** | (2006.01) |

(52) U.S. Cl.

CPC ..... *A63B 43/002* (2013.01); *A63H 27/00* (2013.01); *A63H 27/005* (2013.01); *A63H 27/14* (2013.01); *A63H 29/22* (2013.01); *A63H 33/18* (2013.01); *A63H 31/08* (2013.01)

(58) Field of Classification Search

CPC ..... A63B 43/002; A63H 33/18; A63H 27/00; A63H 27/14

See application file for complete search history.

(56) References Cited

U.S. PATENT DOCUMENTS 3,085,363 A * 4/1963 Sunray ..... A63H 27/00 124/16

3,418,751 A * 12/1968 Mabuchi ..... A63H 23/04 446/162

(Continued)

*Primary Examiner* — Jeffrey S Vanderveen

(74) *Attorney, Agent, or Firm* — Orbit IP LLP

(57) ABSTRACT

A self-propelled rocket toy includes an elongated body located along a longitudinal axis having a top end opposite a bottom end. The body may include at least two supports outwardly extending from and fixed relative to the body. A propeller is centered about the longitudinal axis located about the body's bottom end. An electric motor is disposed within the body and mechanically coupled to the propeller. A power source is disposed within the body and electrically coupled to the electric motor. An activation mechanism is electrically coupled to the electric motor and power source. The activation mechanism may be a launch button or a centrifugal switch. The at least two supports are fins extending outwardly and are configured to induce an autorotation for a controlled descent, either by their shape and design and/or by including a pivotably attached flap.

24 Claims, 40 Drawing Sheets

Related U.S. Application Data continuation-in-part of application No. 13/046,089, filed on Mar. 11, 2011, now Pat. No. 8,777,785.

(60) Provisional application No. 61/816,812, filed on Apr. 29, 2013, provisional application No. 61/341,124, filed on Mar. 26, 2010.

(56) References Cited

U.S. PATENT DOCUMENTS

| | | | | |
|---|---|---|---|---|
| 3,605,328 | A * | 9/1971 | Kilroy, Jr. | A63H 27/14 124/16 |
| 3,832,691 | A * | 8/1974 | Galler | A63H 30/04 318/16 |
| 5,269,514 | A | 12/1993 | Adler | |
| 5,284,341 | A | 2/1994 | Routzong | |
| 6,056,616 | A | 5/2000 | Bushman | |
| 6,669,587 | B2 * | 12/2003 | Kessler | A63B 43/002 473/570 |
| 2001/0039221 | A1 | 11/2001 | Schneider | |
| 2004/0110578 | A1 | 6/2004 | Orlowski | |
| 2005/0191930 | A1 | 9/2005 | Foster | |
| 2006/0255205 | A1 * | 11/2006 | Gleich | F42B 15/105 244/49 |
| 2007/0026763 | A1 | 2/2007 | Panec | |
| 2008/0125002 | A1 * | 5/2008 | Goitein | A63H 27/00 446/57 |
| 2009/0039207 | A1 | 2/2009 | Van De Rostyne | |
| 2009/0305599 | A1 | 12/2009 | Newton | |
| 2010/0237197 | A1 * | 9/2010 | Rosenfield | B64G 1/62 244/138 R |

* cited by examiner

ASCENT

ASCENT

ASCENT

DESCENT

STATIONARY

DESCENT

STATIONARY

ASCENT

DESCENT

ELECTRIC MOTOR AND PROPELLER DRIVEN TOY ROCKET

CROSS-REFERENCE TO RELATED APPLICATION

This continuation application claims priority to continuation application Ser. No. 15/917,845 filed on Mar. 12, 2018, which itself claims priority to continuation application Ser. No. 15/695,011 filed on Sep. 5, 2017, which itself claimed priority to application Ser. No. 14/261,563 filed on Apr. 25, 2014 now U.S. Pat. No. 9,782,636 issued on Oct. 10, 2017, which itself was a continuation-in-part application claiming priority to application Ser. No. 13/046,089 filed on Mar. 11, 2011 now U.S. Pat. No. 8,777,785 issued on Jul. 15, 2014 which itself claimed priority to provisional application 61/341,124 filed on Mar. 26, 2010. The continuation-in-part application Ser. No. 14/261,563 also claimed priority to provisional application 61/816,812 filed on Apr. 29, 2013. The contents of all the applications referenced above are incorporated herein in full with these references.

DESCRIPTION

Field of the Invention

The present invention generally relates to flying toys. More particularly, the present invention's claims relates to a toy rocket which uses an electrical power source and electric motor to drive a propeller which in turn creates an upward thrust for the rocket's powered ascent.

Background of the Inventions

This disclosure teaches a variety of flying toys. First, there are several improvements for a self-propelled flying toy, herein referred to commonly as the Jetball. The Jetball can resemble a football and be used in a similar manner for throwing and catching. The improvements to the self-propelled flying toy are a continuation of the developments previously disclosed in application Ser. No. 11/500,749 filed on Aug. 8, 2016 and also the CIP application Ser. No. 11/789,223 filed on Apr. 24, 2007, which are both incorporated in full herein by reference.

The self-propelled flying toy includes a body with a ducted fan located inside the body and along a longitudinal axis. A motor and power source drive the ducted fan to create thrust for self-propulsion. Air is drawn in through air-inlets along the front of the body and can also be drawn through auxiliary air-inlets around the center of the body. Thrust is directed through an air-outlet at the back of the body. To counter the affects of gyroscopic precession, the front of the body has at least two angled surfaces facing an opposite thrust-generating rotational direction relative to the ducted fan. These angled faces create an opposite gyroscopic precession force which then cancels out the gyroscopic precession from the ducted fan. The result is a flying toy that flies in a straight direction.

Second, a new toy is disclosed as a self-propelled rocket. This toy is commonly referred to as the PropRocket. The PropRocket is a safe alternative to the combustion driven model rockets commonly used today. Combustion driven rockets are extremely dangerous and not suitable for unsupervised play by children. The PropRocket is electrically powered and easily rechargeable and quickly relaunchable. The self-propelled rocket toy includes an elongated body with a propeller coupled at the bottom end. An electric motor and power source drive the propeller to create an upward thrust. There are a variety of activation methods that are possible with the electric rocket, including technology developed in the Jetball.

Third, a new toy is disclosed as a throwing and catching flying toy. This toy is commonly referred to either as the Flying Football, the Wing-It Football or the Gliding Football. The throwing and catching flying toy includes a structural support attached with a lift-generating wing. A body which is used to throw and catch the toy is rotatably attached to the support. A tail and tail fin are connected either to the body or the structure and provides stability in the air, much as a tail fin on an airplane does. The body spins in the air when thrown similar to a football, yet the structural support and wings remain level during flight for producing lift. The result is the farthest flying football, allowing users to greatly increase the distance thrown.

Fourth, a new toy is disclosed as a bowless arrow which is commonly referred to as the Bowless Arrow. The toy is similar to an arrow, in that it flies through the air like an arrow, yet can be launched without an auxiliary bow. This is because the bow functionality has been integrated into the arrow. The bowless arrow includes a shaft with a slider translatably coupled. A resiliently stretchable bias, such as a rubber band or spring, is attached to the slider and the rear of the arrow. The slider is held in the front-hand while the arrow is drawn backwards with the rear-hand. Upon release, the slider forces the body of the arrow forward against the forward-hand.

In another variation upon the Bowless Arrow, lift-producing wings can be attached to the body such that the toy is able to glide substantially further. This is a fifth new product and is commonly referred to as the Arrow Plane.

Sixth, a new toy is disclosed as a distance-enhanced throwing toy. This toy is commonly referred to as the Catapult Javelin, for lack of a better name. The distance—enhanced throwing toy includes an elongated shaft with a tail fin at the rear for stability. An elongated handle is pivotably attached near the front of the shaft. The handle is temporarily and securedly biased and pivotable between a first position and a second position. The handle and shaft are generally parallel in the first position and the handle and shaft are generally perpendicular in the second position. A person can grab the handle in the second position and swing the toy at an increased velocity as compared to a normal throwing motion, such as with a football or baseball. The release speed is increased because of the length of the handle is further away from the body of the person throwing it. Upon release, the handle moves into the first position such that the overall toy is aerodynamic for forward flight.

Seventh, a new toy is disclosed as a throwing and flying toy. This toy is commonly referred to as the Cruise Missile, as its shape can be formed to resemble a cruise missile. The Cruise Missile is similar in nature to the Catapult Javelin, but also includes lift-producing wings for substantially increased distance thrown. The throwing and flying toy includes an elongated body having a front portion rotatably attached to a rear portion. A tail fin and lift-generating wing are attached to the rear portion, while an elongated handle is pivotably attached to the front portion of the body. The handle is temporarily and securedly biased and pivotable between a first position and a second position similar to the Catapult Javelin. Not only is the speed at which the toy thrown increased, but lift generated by the wings also increases the distance thrown.

New toy designs are constantly being invented to satisfy the curiosity and interest of the consuming public. Flying toys are of particular interest and has become a billion dollar industry. Accordingly, there is always a need for a variety of new flying toys. The present inventions fulfill these needs and provide other related advantages.

SUMMARY OF THE INVENTIONS

Jetball—Gyroscopic Precession Countermeasures

A self-propelled flying toy is disclosed comprising a body defined as including a front section, a center section and a back section each along a longitudinal axis. A ducted fan is located within the body substantially centered about the longitudinal axis. A motor is mechanically coupled to the ducted fan and a power source is coupled to the motor, either electrically or energetically. An air-inlet is located substantially within the front section in airflow communication with the ducted fan. An air-outlet is located substantially within the back section in airflow communication with the ducted fan. At least two angled surfaces are fixed relative to the body and located substantially within the front section. Each of the at least two angled surfaces are substantially evenly centered about the longitudinal axis and facing an opposite thrust-generating rotational direction relative to the ducted fan.

In an exemplary embodiment of the present invention, the at least two angled surfaces may be in airflow communication with the air-inlet. The at least two angled surfaces may comprise a plurality of angled surfaces.

In another exemplary embodiment the body may be shaped as an oblate spheroid. Furthermore, the oblate spheroidal body may truncated perpendicular to the longitudinal axis located substantially about the back section. The air outlet may be substantially 3.5 inches in diameter or greater.

Another exemplary embodiment may include an auxiliary air-inlet located substantially within the center section about the longitudinal axis in airflow communication with the ducted fan. The auxiliary air-inlet may comprise a plurality of auxiliary air-inlets. The plurality of auxiliary air-inlets may each define an aperture extending substantially about 0.5 inches or greater ahead and about 0.5 inches or greater behind the ducted fan in a direction along the longitudinal axis. Furthermore, the air-inlet, auxiliary air-inlet and air-outlet each may include an air-permeable structure.

Another exemplary embodiment may include a centrifugal switch disposed within the body detecting rotation about the longitudinal axis. The centrifugal switch may regulate operation of the ducted fan, wherein the ducted fan is powered when rotation about the longitudinal axis is detected and not powered when rotation about the longitudinal axis is not detected. Said differently, another embodiment may include a means for automatic activation and deactivation of the motor by detecting an in-flight condition and a not-in-flight condition, wherein such means is located within the body and in communication with the motor and power source. Also, the embodiment may include a timer located within the body in communication with the motor and power source, wherein the motor after activation will automatically turn off after a predetermined time.

Jetball—Auxiliary Air-Inlet

A self-propelled flying toy is disclosed comprising a body defined as including a front section, a center section and a back section each along a longitudinal axis. A ducted fan is located within the body substantially centered about the longitudinal axis. A motor is mechanically coupled to the ducted fan and a power source is coupled to the motor. An air-inlet is located substantially within the front section in airflow communication with the ducted fan. An air-outlet is located substantially within the back section in airflow communication with the ducted fan. An auxiliary air-inlet is located substantially within the center section about the longitudinal axis in airflow communication with the ducted fan.

In various exemplary embodiments the auxiliary air-inlet may comprise a plurality of auxiliary air-inlets all located substantially within the center section about the longitudinal axis each in airflow communication with the ducted fan. Also, the plurality of auxiliary air-inlets may each extend substantially at least 0.5 inches ahead and 0.5 inches behind the ducted fan in a direction along the longitudinal axis. The plurality of auxiliary air-inlets may each comprise an air-permeable structure.

Another exemplary embodiment may include a centrifugal switch located within the body detecting rotation about the longitudinal axis. The centrifugal switch regulates operation of the ducted fan, wherein the ducted fan is powered when rotation about the longitudinal axis is detected and not powered when rotation about the longitudinal axis is not detected. Said differently, another embodiment may include a means for automatic activation and deactivation of the motor by detecting an in-flight condition and a not-in-flight condition, wherein such means is located within the body and in communication with the motor and power source. Furthermore, a timer may be located within the body in communication with the motor and power source, wherein the motor after activation will automatically turn off after a predetermined time.

Another exemplary embodiment may include at least two angled surfaces fixed relative to the body disposed substantially within the front section, wherein each of the at least two angled surfaces are substantially evenly centered about the longitudinal axis and facing an opposite thrust-generating rotational direction relative to the ducted fan. The at least two angled surfaces may also be in airflow communication with the air-inlet. The at least two angled surfaces may also comprise a plurality of angled surfaces evenly centered about the longitudinal axis.

In another exemplary embodiment, the body may be an oblate spheroidal shape. Furthermore, the oblate spheroidal body may be truncated perpendicular to the longitudinal axis disposed about the back section. Additionally, the air outlet may be substantially 3.5 inches in diameter or greater.

PropRockets

A self-propelled rocket toy is disclosed comprising a substantially elongated body located along a longitudinal axis which is defined as including a top end opposite a bottom end. A propeller is substantially centered about the longitudinal axis located about the bottom end. An electric motor is mechanically coupled to the propeller. A power source is electrically coupled to the electric motor. An activation mechanism is electrically coupled to the electric motor and power source.

In various exemplary embodiments the power source may comprise a rechargeable battery, such as a NiCad, NiMh, or LiPo battery. Alternatively, the power source may comprise a capacitor.

Another exemplary embodiment may include at least three supports outwardly extending from and fixed relative to the body, each support substantially evenly spaced about the longitudinal axis and extending below the propeller.

Furthermore, a ring may be aligned around the longitudinal axis and propeller. The ring may also be connected to the at least three supports. Also, the at least three supports may be lift-generating devices each angled at an opposite thrust-generating rotational direction relative to the propeller.

In another exemplary embodiment, the activation mechanism may comprise a launch button located relative to the body and in communication with the electric motor and power source. A timer may be located within the body in communication with the electric motor and power source, wherein the electric motor after activation will automatically turn off after a predetermined time. Alternatively, the activation mechanism may comprise a receiver disposed within the body in electrical communication with the electric motor and including a remote launch transmitter for remotely activating the electric motor and propeller.

In another exemplary embodiment, the activation mechanism may comprise a centrifugal switch disposed within the body and in communication with the electric motor and power source, wherein the centrifugal switch is configured upon detecting rotation about the longitudinal axis to activate the electric motor and propeller. Again, a timer may be located within the body in communication with the electric motor and power source, wherein the electric motor after activation will automatically turn off after a predetermined time. Said differently, the activation mechanism may comprise a means for automatic activation and deactivation of the motor by detecting an in-flight condition and a not-in-flight condition, wherein such means is located within the body and in communication with the electric motor and power source. A timer may be located within the body in communication with the motor and power source, wherein the motor after activation will automatically turn off after a predetermined time.

Flying Football

A throwing and catching flying toy is disclosed comprising a structural support including a lift-generating wing attached relative to the support. A body is rotatably attached relative to the support, wherein the body comprises a front section fixed relative to a rear section. Both the front and rear sections rotate about a longitudinal axis. A tail is located relative to either the support or the body extending in a direction beyond the rear section of the body. A tail fin is attached relative to an end of the tail.

In an exemplary embodiment, the wing may be pivotably adjustable in a pitch axis relative to the support. A thumb grip may be fixed relative to the support and located along and adjacent to the rear section of the body. The wing may comprise a breakaway wing or also be a dihedral wing. The dihedral angle may be at or greater than 10 degrees or 20 degrees. The wing may also be positioned above the longitudinal axis.

In another exemplary embodiment, the body may comprise a generally oblate spheroidal or football shape. The tail fin may comprise a plurality of tail fins. The support may be located between and separate the front section and the rear section. The rear section may be smaller in diameter than the front section. The tail may be located along the longitudinal axis and fixed relative to the body. The plurality of tail fins may be fixedly attached to the end of the tail. The plurality of tail fins may be angled with respect to the longitudinal axis. The plurality of tail fins may be rotatably attached to the end of the tail.

In another exemplary embodiment, the support may be located behind the rear section of the body. The front section and rear section may be formed as a single and continuous body. The wing may comprise a left wing and a right wing both attached relative to the support. The left and right wings may each be pivotably adjustable in a pitch axis relative to the support.

Bowless Arrow

A bowless arrow is disclosed comprising a shaft defined as including a forward end opposite a rear end. A slider is translatably coupled along the shaft including a front-hand support extending perpendicular to the shaft. A rear-hand grip is located substantially about the rear end of the shaft. A resiliently stretchable bias is attached relative to the slider and either the rear end of the shaft or the rear-hand grip.

An exemplary embodiment may include an arrow tip located at the forward end of the shaft. The arrow tip may comprise an energy dissipating material. Also, a plurality of tail fins may be substantially evenly located about the rear end of the shaft.

Another exemplary embodiment may include a lift-generating wing attached relative to the shaft. The wing may be pivotably adjustable in a pitch axis relative to the shaft. The wing may comprise a dihedral wing that is at or greater than 10 degree or 20 degrees. Furthermore, the wing may comprise a breakaway wing.

In another exemplary embodiment, the arrow tip may comprise a substantially oblate spheroidal or football shape.

Catapult Javelin

A distance—enhanced throwing toy is disclosed comprising an elongated shaft defined as having a forward end opposite a rear end. A tail fin is located about the rear end of the shaft. A tip is located relative to the forward end of the shaft. An elongated handle is pivotably attached substantially near the forward end of the shaft. The handle is temporarily and securedly biased and pivotable between a first position and a second position. The handle and shaft are substantially parallel in the first position and the handle and shaft are substantially perpendicular in the second position.

In another exemplary embodiment, the tail fin includes a plurality of tail fins substantially evenly located about the rear end of the shaft. The tip may comprise an energy dissipating material.

A bias mechanism may be attached relative to the shaft and handle. The bias mechanism temporarily and securedly biases the handle in the first and second positions. The bias mechanism may comprise an elastomeric material or spring.

In another exemplary embodiment, the tip may comprise a generally oblate spheroidal or football shape.

Cruise Missile

A throwing and flying toy is disclosed comprising a substantially elongated body including a front portion rotatably attached to a rear portion. A tail fin is located about the rear portion of the body. A lift-generating wing is attached relative to the rear portion of the body. An elongated handle is pivotably attached relative to the front portion of the body. The handle is temporarily and securedly biased and pivotable between a first position and a second position. The handle and body are substantially parallel in the first position and the handle and body are substantially perpendicular in the second position.

In an exemplary embodiment, the wing may be pivotably adjustable in a pitch axis relative to the rear portion of the body. The wing may comprise a breakaway wing or a dihedral wing. Also, the tail fin may be rotatably attached relative to the rear portion of the body.

In another exemplary embodiment, the body may comprise a substantially missile-like shape. Furthermore, the tail fin may comprise a plurality of tail fins substantially evenly located about the rear portion of the body. A tip may be located about the front portion, wherein the tip comprises an energy dissipating material. Alternatively, the tip may comprise a generally oblate spheroidal or football shape.

In another exemplary embodiment, a bias mechanism may be attached relative to the front portion and handle. The bias mechanism may temporarily and securedly bias the handle in the first and second positions. The bias mechanism may comprise an elastomeric band, a rubber band or a spring.

As used herein throughout the entirety of this disclosure: substantially means largely but not wholly that which is specified; plurality means two or more; disposed means joined or coupled together or to bring together in a particular relation; and longitudinal means of, relating to, or occurring in the lengthwise dimension or relating to length.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Jetball

Figure 1:
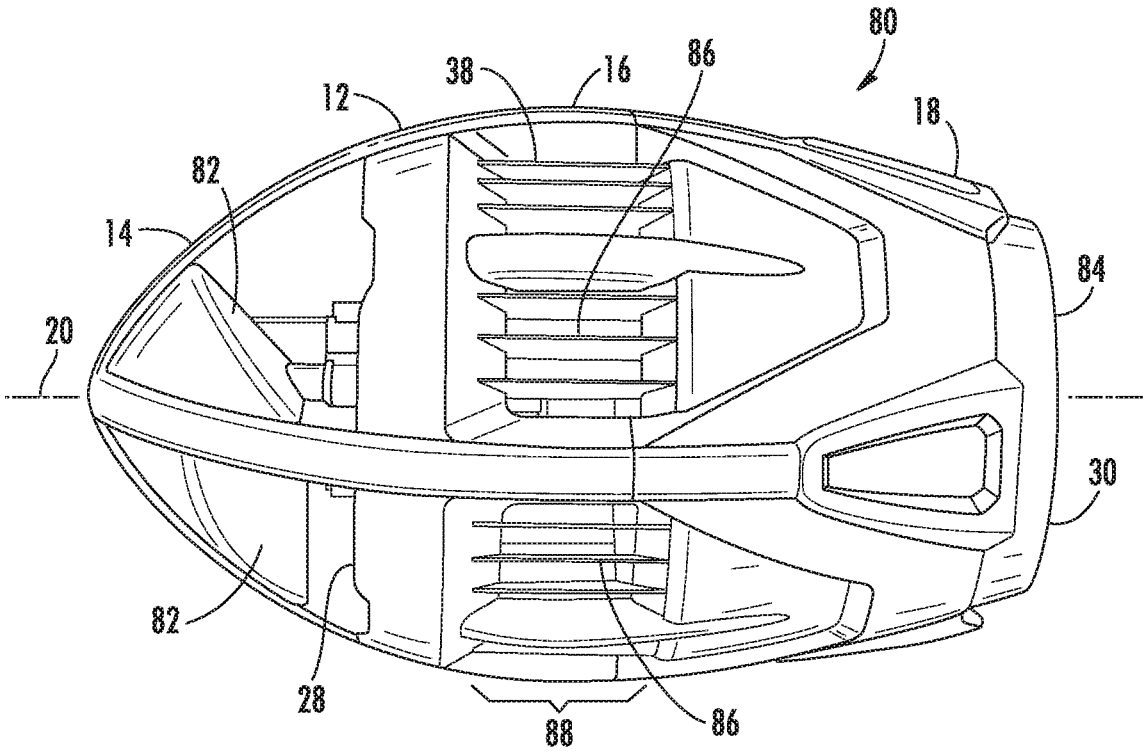
FIG. 1 is a side perspective view of an exemplary self-propelled flying toy embodying one of the present inventions.

There are several improvements disclosed herein for a self-propelled flying toy 80, herein referred to commonly as the Jetball. In some embodiments, the Jetball may resemble a football and be used in a similar manner for throwing and catching. The improvements to the self-propelled flying toy 80 are a continuation of the developments previously disclosed in application Ser. No. 11/500,749 filed on Aug. 8, 2006 and also the CIP application Ser. No. 11/789,223 filed on Apr. 24, 2007, which are both herein incorporated in full by reference.

Development of the Jetball has resulted in a significant amount of research and development in attempts to make the product function appropriately, let alone make it marketable. Initial prototypes of the Jetball were significantly heavy, as they were on the order of 300-400 grams. These Jetballs used a significant amount of LiPo batteries to generate enough force to make the product interesting and fun to play with. Generating enough thrust to make a noticeable difference was extremely tough for a 400 gram football. Two packs of 3 cell LiPo batteries each at 11.1V and 700 mAh were used wired in parallel. An electric ducted fan intended for radio control ducted fan aircrafts was utilized. The resulting product generated a significant amount of thrust, yet had several problems.

First, the resulting product was actually intimidating. The thrust generated was significant and would sound intimidating while it approached the receiver. Second, the product at the time was still a prototype and it could be somewhat dangerous to catch as the ducted fan blades were not fully protected from a stray finger or two. Third, the resulting product was not very durable, as the significant amount of overall weight became a burden when dropped or simply not caught. The internal components were intended for an RC aircraft, not a football which strikes the ground with a substantial amount of force. It was clear that making a durable production quality version would be extremely challenging. Fourth, the product would ultimately cost too much at retail to be marketable. A new Jetball version was required that would solve these aforementioned problems.

This particular Jetball prototype had to be thrown underhanded if you were right-handed. This was so because the motor and ducted fan happened to rotate in the exact wrong direction for a right-handed thrower. When you throw a football, you initially put a substantial amount of spin on the football to help keep a true trajectory. From the perspective of a right-handed thrower, the football leaves the thrower with a clockwise spin. The internal ducted fan of the prototype would want to spin the football the wrong direction (counter-clockwise) for a right-handed thrower. It must be appreciated that the torque imparted on the football body from the ducted fan is quite substantial. Rather than fight the torque, I simply threw the football underhanded as I could easily do such.

It was at this time I noticed something strange but never gave it much thought until later. I noticed a slight tendency for the football to veer to the left when thrown. I noticed it enough that on long throws I would throw the football a bit to the right to compensate for this slight veering affect. The veer was repeatable and would always occur, but I felt the inaccuracy of my hand-made construction or my underhanded throwing technique was to blame. I later learned something unique was happening.

I proceeded to develop the next design iteration of the Jetball. I aimed for an overall weight of about 100 grams. As the overall power levels needed were substantially reduced, so then should the cost be reduced as well. Also, the product would be safer to play with as it would no longer be scary or impose such a great risk from an accidental impact between the ducted fan and a stray finger. I proceeded to develop such a product based off of various toys, rapid prototyping parts and through hand-carved foams and assembly.

This new prototype happened to use motors and ducted fans that were properly geared for a right-hand throw, so I could now toss it overhand. This product was also about 100 grams in weight, or about a fourth to a third of the overall weight of the earlier Jetball prototypes. When I first threw the toy, the Jetball severely turned to the right. At first I thought I was throwing it wrong. However, the more and more I tested it out the more it wanted to repeatedly veer substantially to the right. In fact, it would change direction about 90 degrees. If I wanted a football that could literally be thrown around a corner, I had it. However, this toy would never be marketable if it kept turning in mid air.

I noticed that the latest prototype turned to the right, while the previous prototype turned to the left. This was consistent with the torque effect from the ducted fan of each. I hypothesized that the first product had less of a veer due to the fact that it was heavier. After much research, the phenomenon of gyroscopic precession was discovered. This is a phenomenon which is not intuitive in any way. Gyroscopic precession is when a rotating ducted fan has a force imparted perpendicularly to its rotation. This only happens when the ducted fan is pushing forwards or backwards, and not up and down. When a ducted fan is facing up and down, and therefore pushing up and down, there is no gyroscopic precession affect. It is only when the ducted fan is pushing forwards and backwards in a horizontal direction that gyroscopic precession causes a perpendicular force to twist the aircraft in flight.

All ducted fan driven airplanes and propeller driven airplanes suffer from gyroscopic precession. Usually the speed of the aircraft and the interaction between the air and the flight control surfaces are such that the effect is negligible. However, on my 100 gram Jetball the effect was severe. Pilots, whether for radio control aircraft or for real aircraft, are taught that when performing a slow stall turn the aircraft will naturally rotate much more easily one direction as compared to the other. This is due to gyroscopic precession. One may have noticed that approaching aircraft seem to always be slightly angled one direction or the other when taking off and landing. It is easy to chalk this up to a slight breeze, but it is more likely the natural tendency of gyroscopic precession to want to twist the aircraft while in flight.

I had to find a solution to the problem. I tried everything I could think of. I tried shifting the center of gravity of the football forward and backward, yet it made no difference. I tried adding on a significant tail section and tail fins to force the football to go straight, yet it made little difference. After two weeks of trial and error, I cut out balsa wood sections and created an angled nose section that crudely resembled a ducted fan. In essence the front of the ball resembled a ducted fan, as crude as it was, while still retaining a football like shape. Low and behold when I threw the football, it veered the other direction! I knew instantly that I invented a fix.

The solution to making a self-propelled flying toy 80 fly straight is to create a front section 14 that is angled similar to FIGS. 1-4. The front section 14 acts like a ducted fan and creates an equal and opposite gyroscopic precession affect that cancels out the gyroscopic precession affect from the ducted fan 22. In my prototypes and figures herein, I used and show four angled surfaces 82 that comprise the angled intake. If you make the angle intake too severe, the toy 80 will veer to the left. If you make the angle intake not severe enough, the toy 80 will veer to the right. This also means that counter-rotating blades will eliminate gyroscopic precession, but then that requires a more complicated gearing and ducted fan design and assembly. In the instant design, using four angled surfaces 82 happens to work well in matching the four sides of a traditional football such that the angled intake shapes are not strange looking or out of place. In fact, the design is so seamless that few who use the product will ever recognize the angled surfaces 82 as a correction for a gyroscopic precession problem.

With reference to the following FIGS. 1-5, the numbering is consistent with and is a continuation from the previously filed application Ser. No. 11/500,749 filed on Aug. 8, 2006 and also the CIP application Ser. No. 11/789,223 filed on Apr. 24, 2007, both of which are fully incorporated herein. A self-propelled flying toy 80 is disclosed comprising a body 12. The body 12 is defined as including a front section 14, a center section 16 and a back (rear) section 18 each along a longitudinal axis 20. A ducted fan 22 is located within the body 12 substantially centered about the longitudinal axis 20. A motor 24 is mechanically coupled to the ducted fan 22. The motor 24 may be an electric motor similar to the previous applications (Ser. Nos. 11/500,749 and 11/789,223) or may now be an internal combustion engine. The reference to a motor 24 as used in this instant application is not specific to particular type of motor, unless further specified in the claims. A power source 26 is coupled to the motor 24. The power source 26 may be an electrical power source similar to the previous applications (Ser. Nos. 11/500,749 and 11/789,223) or comprise a combustible fuel for an internal combustion engine. The reference to a power source 26 as used in the instant application is not specific to a particular type of power source, unless further specified.

At least two angled surfaces 82 are fixed relative to the body 12 and located substantially within the front section 14. Each of the at least two angled surfaces 82 are evenly centered about the longitudinal axis 20 and facing an opposite thrust-generating rotational direction relative to the ducted fan 22. As the ducted fan 22 spins, it causes the body 12 to spin in the opposite direction. Thrust is generated by the ducted fan 22, but thrust is also generated by angled surfaces 82 of the body 12. The gyroscopic precession from the ducted fan 22 is then canceled by the equal and opposite gyroscopic precession from the angled surfaces 82. As can be understood, the angled surfaces 82 must be facing a particular direction as to create thrust when the body 12 rotates. This is opposite the way the surface of the ducted fan blades must be angled, as the ducted fan 22 rotates in an opposite direction as compared to the body 12.

As shown in FIGS. 1-4, there are a total of four angled surfaces 82. It is to be understood by one skilled in the art that a range of a number of angled surfaces 82 can be used. For instance 2, 3, 4, 5, 6, or a plurality of angled surfaces 82 can be used to counter the gyroscopic precession from the ducted fan 22. It is to be understood that at least two angled surfaces 82 are required to create an opposite gyroscopic precession affect. Furthermore, the angled surfaces 82 may also be in airflow communication with the air-inlet 28 and ultimately the ducted fan 22. As air enters the toy 80 it first interacts with the angled surfaces 82. Air can then pass through the air-inlet 28 and an air-permeable structure 38. Air can then interact with the ducted fan 22 and is propelled out the air-outlet 30 and out another air-permeable structure 38.

The particular embodiment of the flying toy 80 in FIGS. 1-5 is made from Expanded Polypropylene (EPP) and ABS plastic to achieve its target weight of 100 grams. This means the toy 80 is sufficiently light but also more fragile than a typical football. This exemplary embodiment of the toy 80 is not meant to be played with in an overly rough or potentially destructive manner, such as tackle football or being kicked. However, a problem arises when the toy 80 closely resembles a football. If it looks like a football, the odds are great that a user will try to play with it as such and risk damaging the toy 80. Therefore, it is reasoned that some variation of styling might be invented such that the toy 80 would look different enough from a football as not to instigate such rough usage.

Figure 3:
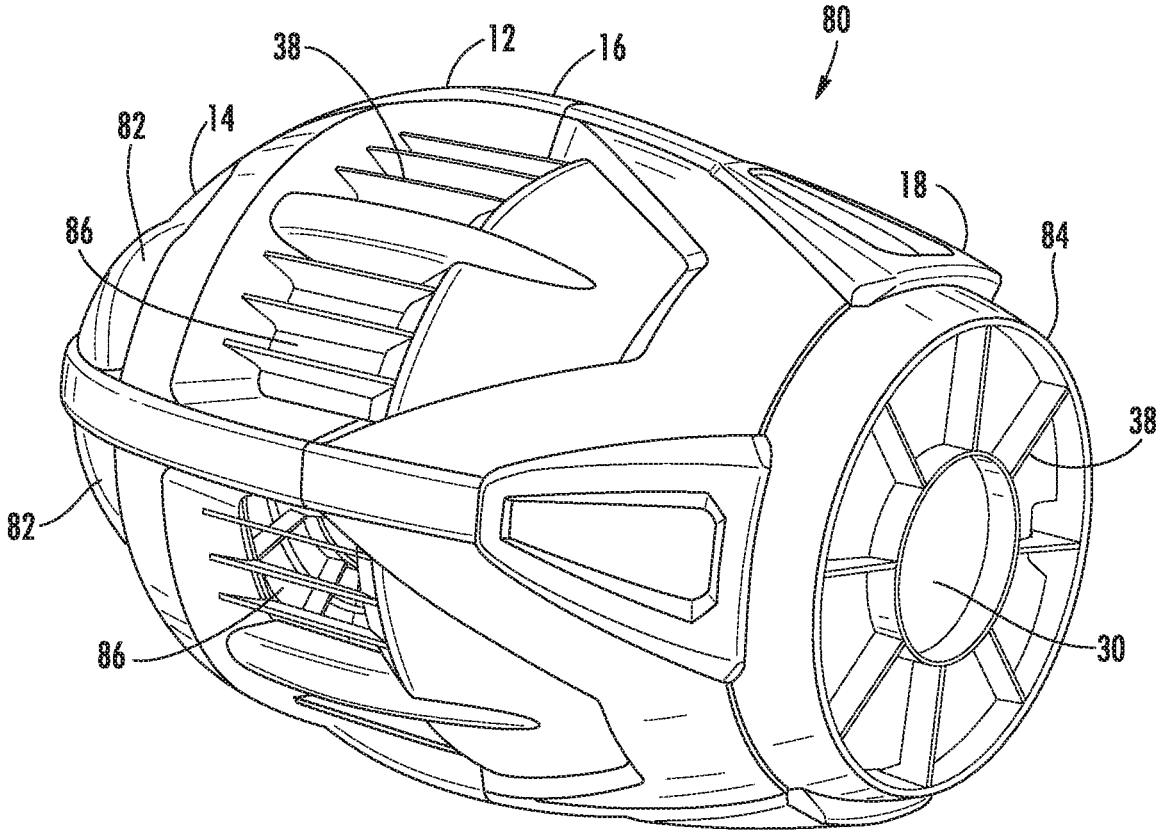
FIG. 3 is a rear perspective view of the exemplary embodiment of FIG. 1.

Accordingly, in an exemplary embodiment the oblate spheroidal body 12 may truncated perpendicular to the longitudinal axis 20 located substantially about the back section 18 resulting in a truncated end 84. FIGS. 1 and 3 best show the truncated end 84. The body 12 now has more of a bullet-like shape with a curved front section 14 and a flat (truncated) back section 18. The body 12 is still sufficiently curved and sized such that a user is able to grasp the toy 80 within their hands and throw the toy 80 in a spiral motion, similar in how a football can be thrown. It is to be understood by one skilled in the art that the body 12 can be formed in a variety of shapes which are still able to be thrown and caught, and this disclosure is not intended to limit it to the precise form described and shown herein. For instance the toy 80 can be styled similar to a bullet, a missile, a football or any combination thereof.

FIG. 3 shows how the air-permeable structure 38 can be integrated into the air-outlet 30 such that it keeps fingers away from the ducted fan 22. In this particular embodiment the air-outlet 30 has an air-permeable structure 38 which is formed from an injection molded plastic. The plastic structure 38 fits within the rear section 18 of the air-outlet 30 and helps to add strength and stability to the overall toy 80.

The size of the air-outlet 30 is also critical. It was discovered during thrust testing of different air-outlet 30 designs that making a smaller diameter air-outlet 30 resulted in a significant amount of loss thrust. It was found that the air-outlet 30 should be substantially around 3.5 inches in diameter or greater for a ducted fan 22 that is substantially about 4 inches in diameter. If the air-outlet 30 is sized too small, thrust is actually retarded significantly as air tries to come out the air-inlet 28.

To develop the powerplant (motor, battery, gearing, ducted fan) of the Jetball, a bench powerplant was devised. This bench powerplant was mounted upon a digital scale and pointed directly upwards. In other words, a ducted fan was pointed upwards such that it was thrusting downwards on the scale when in operation. The scale would be zeroed right before a thrust test to then determine how much thrust a particular powerplant was producing. This was needed as there are an endless variety of ducted fan sizes and shapes, motors, gearing and RC battery types that could be utilized.

One such exemplary embodiment of a powerplant combination utilized the tail rotor from a RC helicopter (like the Piccolo Helicopter tail rotor prop) cut down to about 4 inches in diameter, a 12 mm diameter motor from GWS-EDF-50 that was rated for 6-7.2 volts, a gearing ratio of about 3:10 and a LiPo battery of 7.4 Volts and about 300 mAh. This combination produced about 100 grams of thrust and was found to be a suitable for this application. The smaller gear 90 attaches to the motor 24 and the larger gear 92 attaches to the ducted fan 22. The smaller gear 90 has 12 teeth and a pitch diameter of 6 mm. The larger gear 92 has 40 teeth and a pitch diameter of 20 mm.

While this powerplant worked well without any structure around it, a test diameter of foam was slowly lowered over and around the fan while it ran. The test diameter of foam was about 4.5 inches in diameter, just enough to slip over the rotating ducted fan. As the test diameter of foam approached the ducted fan, the sound and pitch of the ducted fan changed, and surprisingly the thrust produced dropped significantly. Through trial and error, it was determined that when an outer diameter structure is placed within either 0.5 inches ahead of the ducted fan or 0.5 inches behind the ducted fan, the thrust levels would be dramatically reduced.

Therefore, to increase performance of the toy 80 an exemplary embodiment may include an auxiliary air-inlet 86 (also called a hover vent or cheater vent) located substantially within the center section 16 about the longitudinal axis 20 in airflow communication with the ducted fan 22. The auxiliary air-inlet 86 may comprise a plurality of auxiliary air-inlets 86. The plurality of auxiliary air-inlets 86 may each define an aperture 88 extending substantially about 0.5 inches or greater ahead and 0.5 inches or greater behind the ducted fan 22 in a direction along the longitudinal axis 20. Furthermore, the air-inlet 30, the auxiliary air-inlet 86 and the air-outlet 30 may each include an air-permeable structure 38. The auxiliary air-inlets 86 may also be shaped to help channel air into the ducted fan 22 as the body 12 spins. Each portion or span of the air-permeable structure 38 for the auxiliary air-inlets 86 is angled to help channel and direct air inwards to the ducted fan 22. The auxiliary air-inlets 86 can be fashioned in a multitude of ways. FIGS. 1-4 show that the auxiliary air-inlets are divided into four main sections placed about the circumference of the body 12 about the center section 16. It is to be understood by one skilled in the art that a multitude of different designs for the auxiliary air-inlets 86 may be fashioned and this disclosure is not limited to any particular embodiment or teaching.

The self-propelled flying toy 80 can be activated in a multitude of ways and methods previously taught in application Ser. No. 11/500,749 and application Ser. No. 11/789,223. In short, a centrifugal switch 94 may be disposed within the body 12 detecting rotation about the longitudinal axis 20. The centrifugal switch 94 regulates operation of the ducted fan 22, wherein the ducted fan 22 is powered when rotation about the longitudinal axis 20 is detected and not powered when rotation about the longitudinal axis 20 is not detected. Said differently, another embodiment may include a means for automatic activation and deactivation of the motor 24 by detecting an in-flight condition and a not-in-flight condition, wherein such means is located within the body 12 and in communication with the motor 24 and power source 26. Also, these embodiments may include a timer 96 located within the body 12 in communication with the motor 24 and power source 26, wherein the motor 24 after activation will automatically turn off after a predetermined time.

Figure 4:
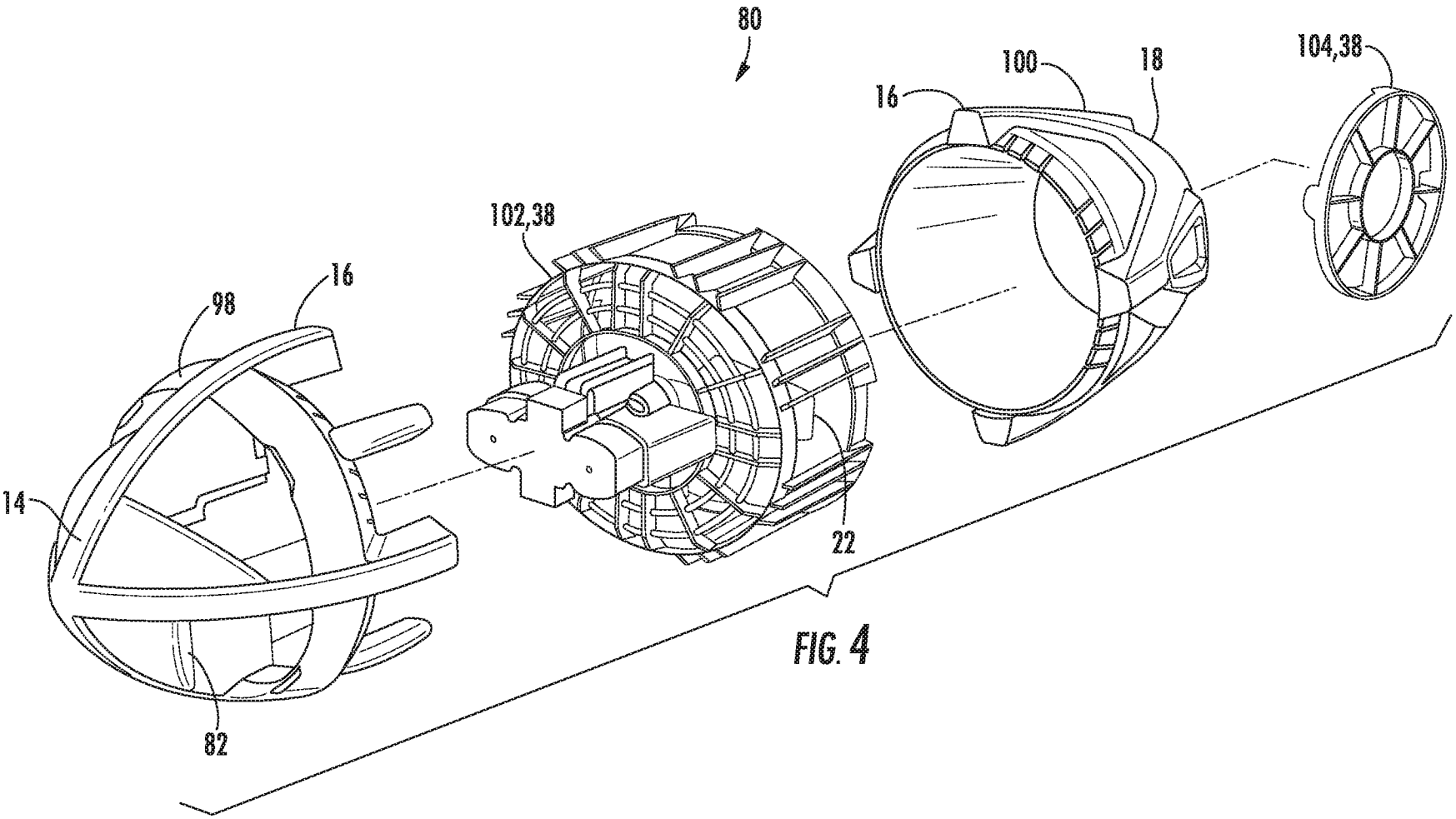
FIG. 4 is an exploded front perspective view of the exemplary embodiment of FIG. 1.

FIG. 4 shows how one embodiment may be constructed. A first section 98 may be made of EPP foam or some other comparable resilient material. The foam should be about 1.4 lbs per square inch, to keep the weight down. The first section 98 includes the front section 14 and half of the center section 16. A second section 100 may also be made of EPP foam or some other comparable resilient materials. The first section 98 and the second section 100 make up a majority of the body 12 of the toy 80. It can be seen that when the two sections 98 and 100 are joined, they form the body 12 of the toy 80. A first plastic screen 102 forms the air-permeable structure 38 that prevents fingers from entering the air-inlet 28 of the auxiliary air-inlet 86. When the first section 98 is joined with the second section 100, it captures in place the first plastic screen 102. Also, a second plastic screen 104 can be attached to the rear of the second section 100 which acts as an air-permeable structure 38 about the air-outlet 30.

Figure 5:
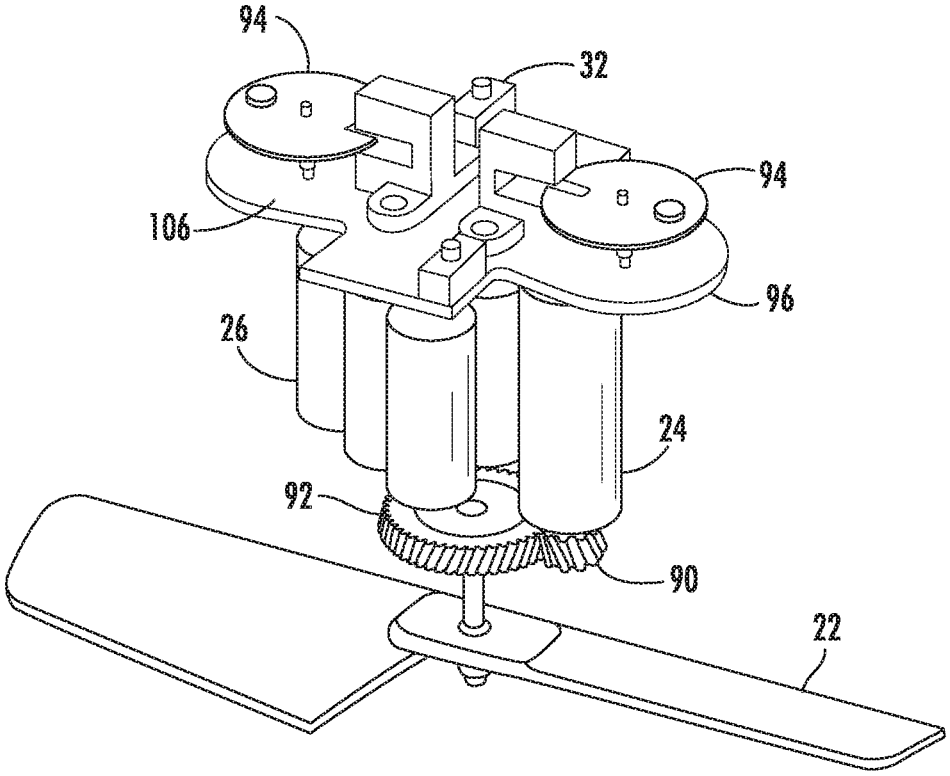
FIG. 5 is a perspective view of an exemplary embodiment of a powerplant assembly of FIGS. 1-4.

FIG. 5 shows more detail of the exemplary powerplant used within the toy 80. The motor 24 is mechanically coupled to the ducted fan 22 through a smaller gear 90 and a larger gear 92. The power source 26 supplies energy to the motor 24. The smaller gear 90 is directly attached to the motor 24 and the larger gear 92 is directly attached to the ducted fan 22. It is to be understood that a variety of gearing or directly-driven ducted fans 22 may be utilized. An electrical board 106 can include the centrifugal switches 94, an on-off switch 32, or other switches required to make the toy 80 operate. The electrical board 106 is wired to control the flow of energy from the power source 26 to the motor 24.

Although several embodiments of and improvements to the self propelled flying toy 80 have been described in detail for purposes of illustration, various modifications may be made to each without departing from the scope and spirit of the invention. Accordingly, the invention is not to be limited, except as by the appended claims.

PropRockets

Development of the PropRocket led from development of the Jetball, as the two products are capable of sharing a multitude of similar parts. Accordingly, the information disclosed in the Jetball is directly applicable and incorporated into the PropRocket disclosure without repetition.

Figure 6:
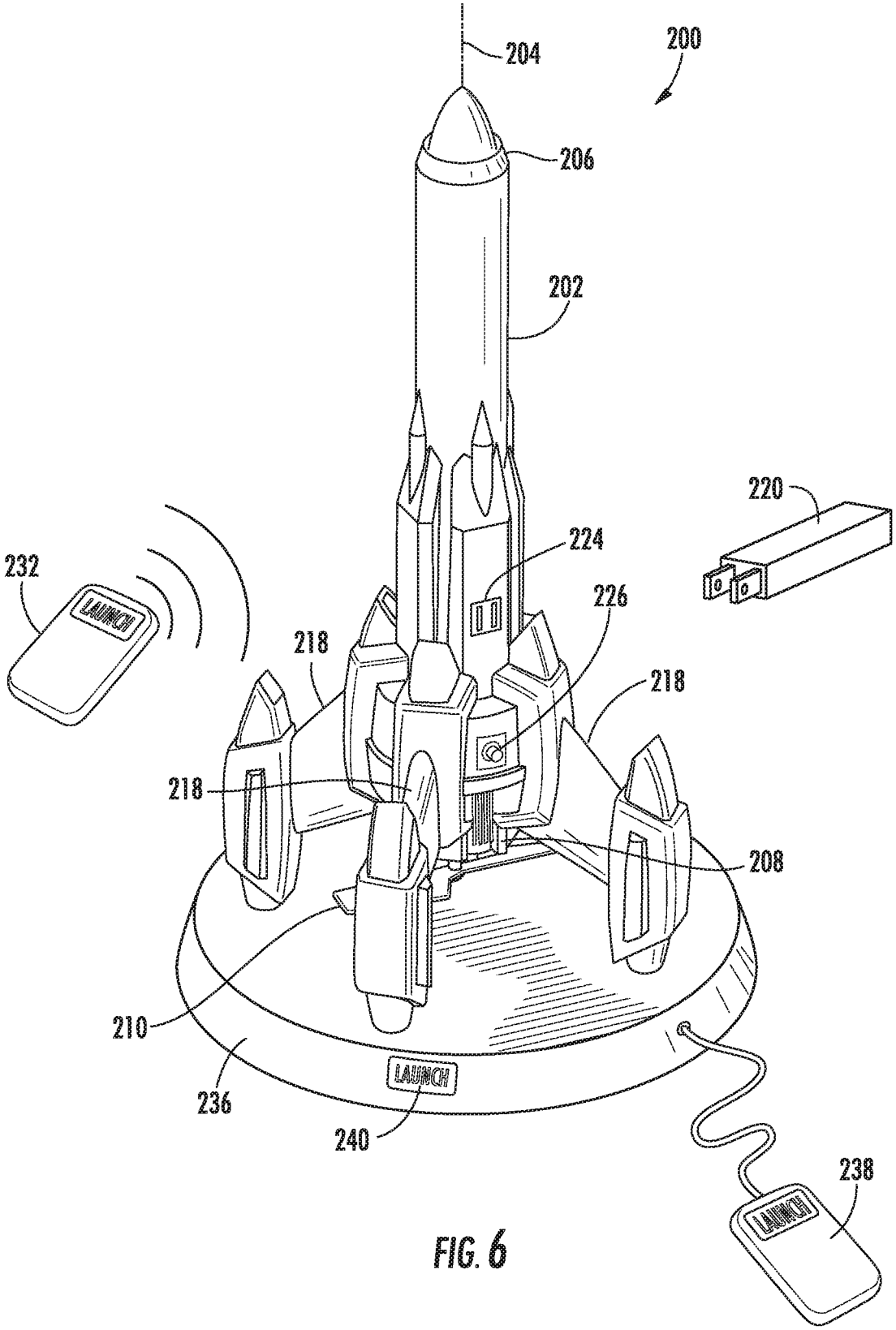
FIG. 6 is a perspective view of an exemplary self-propelled rocket toy embodying one of the present inventions.
Figure 7:
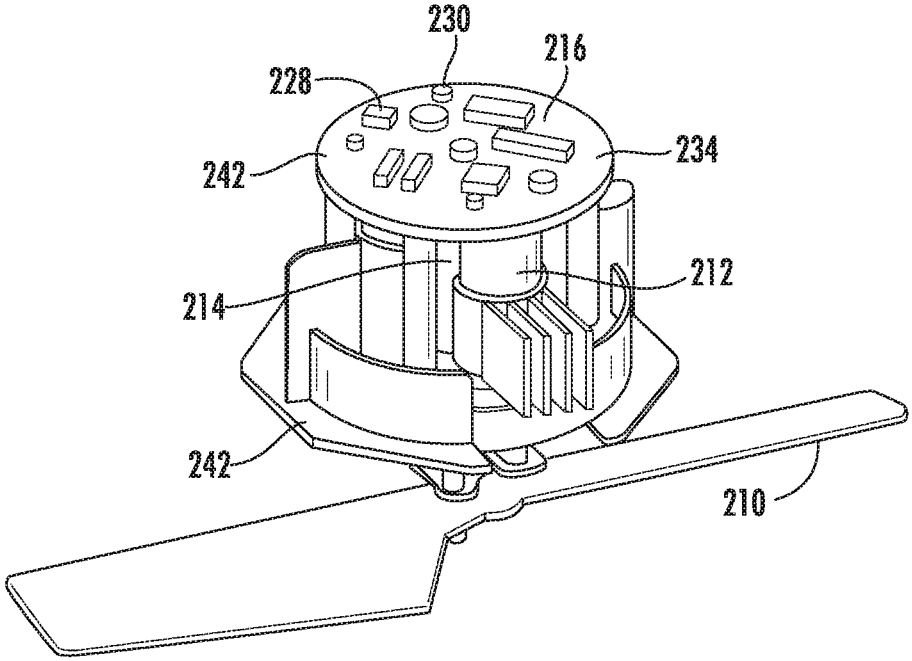
FIG. 7 is a perspective view of a powerplant assembly for the exemplary embodiment of FIG. 6.
Figure 8:
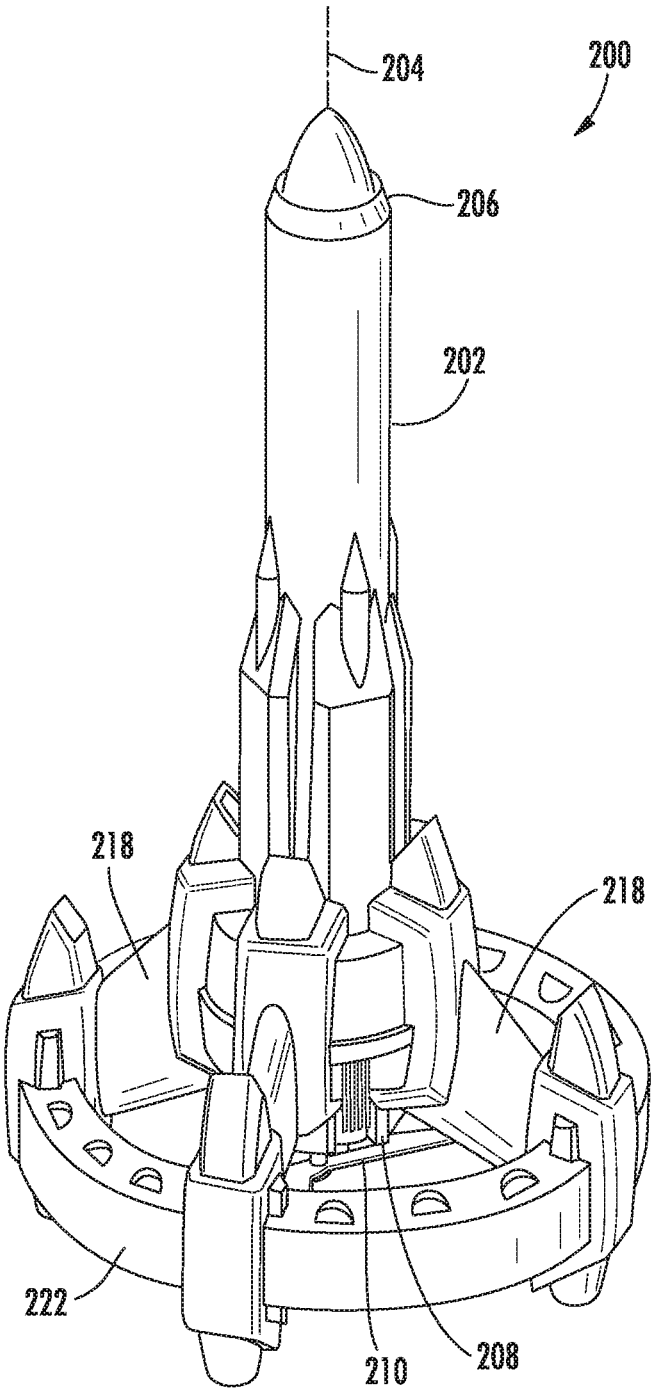
FIG. 8 is a perspective view of another exemplary self-propelled rocket toy body embodying one of the present inventions.

Referring now to FIGS. 6-8, a self-propelled rocket toy 200 is disclosed comprising a substantially elongated body 202 located about a longitudinal axis 204 which is defined as including a top end 206 opposite a bottom end 208. A propeller 210 is substantially centered about the longitudinal axis 204 located about the bottom end 208. An electric motor 212 is mechanically coupled to the propeller 210. A power source 214 is electrically coupled to the electric motor 212. An activation mechanism 216 is electrically coupled to the electric motor 212 and power source 214. In various exemplary embodiments the power source 214 may comprises a rechargeable battery, such as a NiCad, NiMh, or LiPo battery. Alternatively, the power source 214 may comprise a capacitor.

While using the same Jetball powerplant worked well for the prototype of the PropRocket, in production it may be better to use a capacitor in place of a battery. A capacitor is significantly cheaper than a LiPo battery, or even a NiMH or NiCAD battery. Batteries store energy chemically, whereas a capacitor stores electrical energy in the electrical form. While a capacitor can be charged and discharged quickly, it will also lose its stored energy over time very rapidly. However, the play pattern of the PropRocket lends itself to a charge and launch play pattern. This means that an external and auxiliary charger 220 can be used to quickly charge the capacitor. For instance, the auxiliary charger 220 can be plugged into a charger port 224 located on the body 202. Once charged the PropRocket can be immediately launched fully expending its stored energy. The PropRocket will fall to the earth to simply be recharged again and again.

Another exemplary embodiment of the self-propelled rocket toy 200 may include at least three supports 218 outwardly extending from and fixed relative to the body 202. Each support 218 is substantially evenly spaced about the longitudinal axis 204 and extending below the propeller 210. Now referring to FIG. 8, a ring 222 may be located about the longitudinal axis 204 and around the propeller 210 connected to the at least three supports 218. The supports 218 help to provide a foundation for the toy 200 and help to keep the propeller 210 away from striking the ground. The supports 218 and ring 222 work together to provide protection from the spinning propeller 210. An air-permeable structure similar to the Jetball can be integrated into the supports 218 and ring 222, however it is thought unnecessary considering the toy 200 doesn't interact with the hands as much as the Jetball does during throwing and catching.

In another exemplary embodiment not shown, the supports 218 may be lift-generating devices each angled at an opposite thrust-generating rotational direction relative to the propeller 210. As the propeller 210 spins, it causes the body 202 to spin in the opposite direction. Thrust can be gained by forming the supports 218 to generate lift either by creating a wing-profile or angling the supports 218.

There are a multitude of methods or ways the self-propelled rocket toy 200 can be launched. In one exemplary embodiment, the activation mechanism 216 may comprise a launch button 226 located relative to the body 202 and in communication with the electric motor 212 and power source 214. After pressing the launch button 226, a countdown can be started and displayed either visually through LEDs or through a speaker projecting a countdown. A timer 228 may also be located within the body in communication with the electric motor 212 and power source 214, wherein the electric motor 212 after activation will automatically turn off after a predetermined time. The timer 228 can be adjusted to turn the motor 212 off at different intervals which correspond to different heights achieved during flight.

In another exemplary embodiment, the activation mechanism 216 may comprise a receiver 230 disposed within the body 202 and including a remote launch transmitter 232 for remotely activating the electric motor 212 and propeller 210.

In another exemplary embodiment, the activation mechanism 216 may comprise a stand 236 that the toy 200 is placed upon. The stand 236 can resemble a full size launch pad or other stylistically appeasing forms. The stand 236 can incorporate the charging mechanism either from batteries or a wall mounted plug. Once the toy 200 is charged, it can be activated from a tethered launch button 238 or a launch button 240 located on the stand 236.

A new and unique way to activate the rocket toy 200 is to manually launch it from a person's hand by spinning the body 202 in the air. While it is commonly known to spin a football in flight, it is not commonly known or thought of to spin a rocket in flight. In this exemplary embodiment, the activation mechanism 216 may comprises a centrifugal switch 234 disposed within the body 202 and in communication with the electric motor 212 and power source 214, wherein the centrifugal switch 234 is configured upon detecting rotation about the longitudinal axis 204 to activate the electric motor 212 and propeller 210. This embodiment is directly similar to the activation methods disclosed for the Jetball, as all activation methods of the Jetball are applicable to the PropRocket and are incorporated herein. Said differently, the activation mechanism 216 may comprise a means for automatic activation and deactivation of the motor 212 by detecting an in-flight condition and a not-in-flight condition, wherein such means is located within the body 202 and in communication with the electric motor 212 and power source 214. A timer 228 may be located within the body 202 in communication with the motor 212 and power source 214, wherein the motor 212 after activation will automatically turn off after a predetermined time.

FIG. 7 is a perspective view of a powerplant assembly showing how a frame 242 can be made to connect the motor 212 and the power source 214. An electrical board 244 is mounted to frame 242 and can include the activation mechanism 216. The frame 242 is designed to be slide within and connect to the bottom end 208 of the elongated body 202. The electrical board 244 can include any necessary electronic components, including the charger port 224, the launch button 226, or any other switches such as an on/off switch, LED lights or even a small speaker for sounds and countdowns. A heat sink may be attached to the motor 212 to dissipate heat energy in the motor 212 from repeated use. The heat sink shown herein comprises four surfaces that interact with air. Furthermore, the heat sink may be used in any of the toys herein utilizing a motor or the like.

The PropRocket must be properly balanced to achieve a controlled and straight flight upwards. Initial prototypes were wobbly and erratic while flying upwards. After trial and error, three dimes were placed on the inside of the lower foam ring 222. The PropRocket instantaneously flew perfect. This means that a certain amount of mass placed at a distance away from the propeller 210 and below the propeller 210 helps to stabilize the flight characteristics. In fact, one exemplary embodiment might allow the user to selectively place coins in premade receptacles to adjust flight characteristics.

The outside ring 222 can act as a safety feature helping to keep fingers away from the rotating propeller 210. The outside ring 222 can also be deleted as shown in FIG. 6 to then allow the PropRocket body 202 to better imitate a real rocket. As can be imagined by one skilled in the art, there are an endless amount of variations that can be fashioned to create a line of different rocket bodies.

Other exemplary embodiments of the PropRockets are possible. For instance, a glider PropRocket could be devised such that once the PropRocket reaches its apex, the motor deactivates and the PropRocket glides back to the ground. It would be beneficial if the glide path was somewhat circular such that the PropRocket would come down in about the same place as when it was launched. Another exemplary embodiment is to include a deployable parachute that activates once the PropRocket reaches its apex. Another exemplary embodiment is to create an RC glider from the PropRocket. The PropRocket would launch like a PropRocket, but once it reached the apex it could be controlled through a radio transmitter and receiver setup. A payload series PropRocket is yet another exemplary embodiment where the PropRocket would carry a payload to the apex and then detach. For instance, the detachable portion could be a glider, an RC glider, a parachute or any other deployable payload. As can be seen by one skilled in the art and from this disclosure, there are a multitude of PropRocket variations that could be devised.

Figure 50:
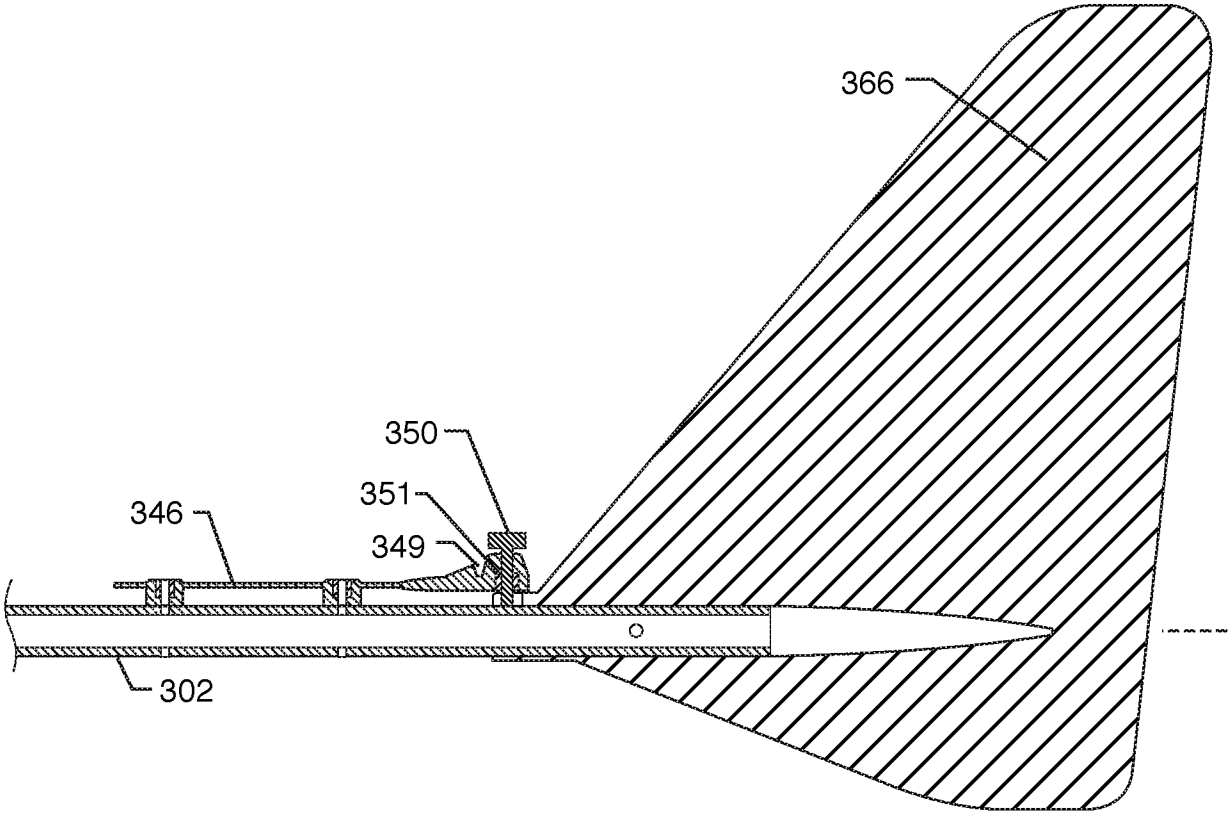
FIG. 50 is an enlarged sectional side view of the rear structure of FIG. 48.
Figure 51:
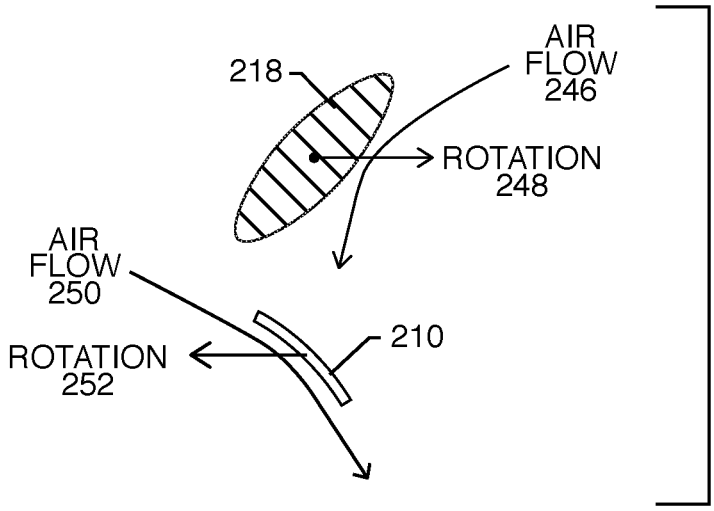
FIG. 51 is a simplified representation of an exemplary self-propelled rocket toy now showing how a first embodiment of a support would interact with the airflow during an ascent.

FIGS. 51-62 show further improvements to the PropRockets. Referring now to FIG. 51, if the supports 218 that extend outwardly from the elongated body 202 are angled, they may be angled to increase the overall lift of the toy 200 during an ascent. FIG. 51 is a simplified representation of the forces acting on the support 218 in comparison to the propeller 210. Shown here is a single slice of the interactions with the air flow. The air flow 246 is seen coming at an angle. This is because the toy 200 is rising and the spinning at the same time. To the support 218, the air flow 246 is approaching as shown. As the support 218 moves along its rotation 248 it will redirect the air flow 246 downward and create propulsion. The same thing is happening to the propeller 210 just in the opposite direction. The air flow 250 is directed downwardly and producing propulsion because the propeller 210 is spinning in rotation 252. While the setup of FIG. 50 works well for ascent, it does not work well once the motor 212 is shut off. This is because the angle on the support 218 will create an opposite torque and cause the body 202 to spin in the opposite direction.

Figure 52:
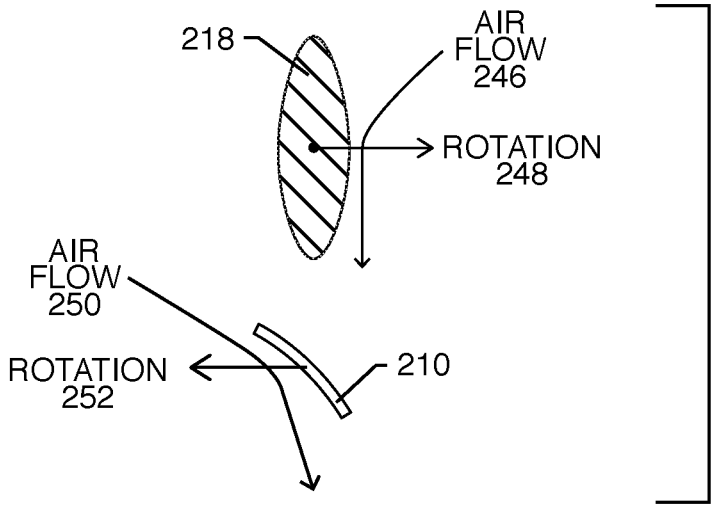
FIG. 52 is a simplified representation of another exemplary self-propelled rocket toy now showing how a second embodiment of a support would interact with the airflow during an ascent.

Now referring to FIG. 52, the support 218 can be oriented straight up and down. During ascent the support 218 moves along rotation 248 but will not impart any upwards propulsion to the toy 200. The support 218 will slow the rotation of the body 202 as it hits the air flow 246. The propeller 210 behaves the same way as in FIG. 51. The torque produced by the motor overcomes any drag created by the support 218 and the toy 200 will continue to rotate. However, during descent the support 218 will tend to slow the rotation of the body 202 and the toy 200 will fall quite quickly.

Figure 53:
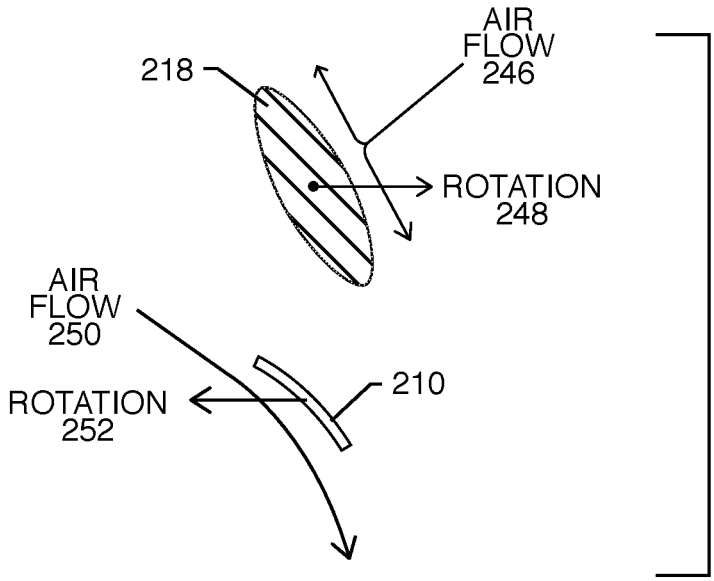
FIG. 53 is a simplified representation of another exemplary self-propelled rocket toy now showing how a third embodiment of a support would interact with the airflow during an ascent.

FIG. 53 shows the support 218 oppositely angled in comparison to FIG. 51. As the support 218 moves along rotation 248, it will provide either propulsion downward or stall the rotation 248 significantly. Assuming the propeller 210 creates enough thrust to still force the toy 200 upwards, the air flow 246 hitting the support 218 will cause the rotation of the body 202 to slow. In FIG. 53 the propeller still behaves the same way as in FIG. 51. The rotation of the body 202 will be significantly slowed.

Figure 54:
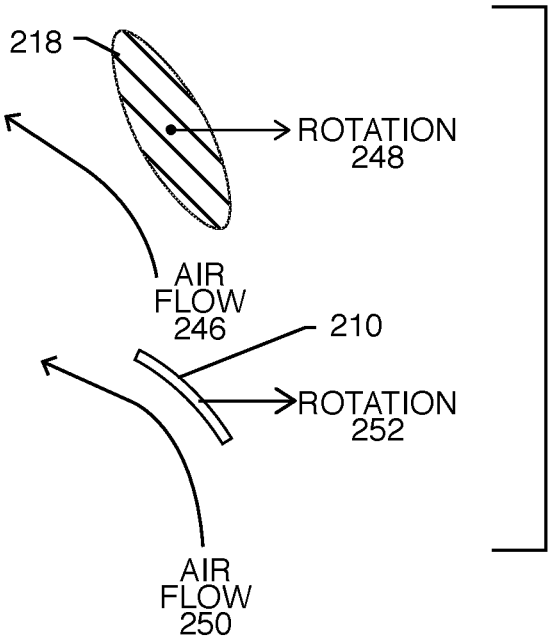
FIG. 54 is a simplified representation of the exemplary self-propelled rocket toy now showing how the third embodiment of a support would interact with the airflow during a descent.

The structure of FIG. 53 is also shown in FIG. 54 but now the motor 212 has been stopped and the toy 200 is falling back to earth. With reference now to FIG. 54, the air flow 246 will impact the support 218 and cause the body 202 to continue to rotate along rotation 248. The propeller 210 is also similarly shaped and air flow 250 impacting the propeller will help to rotate the body 202 along rotation 252. Therefore, FIG. 53 teaches an embodiment where the rocket toy will autorotate as it falls to the earth. Autorotation will slow the descent of the toy 200 and is also quite enjoyable to see in action. A favorable aspect is that the rotation 248 of the body 202 never stopped whether going up or down. The body 202 wants to rotate in the same direction whether the toy 200 is in ascent or in descent.

Figure 55:
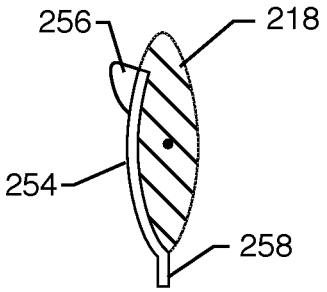
FIG. 55 is a simplified representation of another exemplary self-propelled rocket toy now showing a pivotable flap integrated into the outside surface of the support.

FIG. 55 is another embodiment of a support 218 designed to enhance autorotation. Here, a flap 254 is pivotably attached to the support 218. The flap 254 may be attached with a hinge, joint or other mechanism or simply taped onto the support 218.

Figure 56:
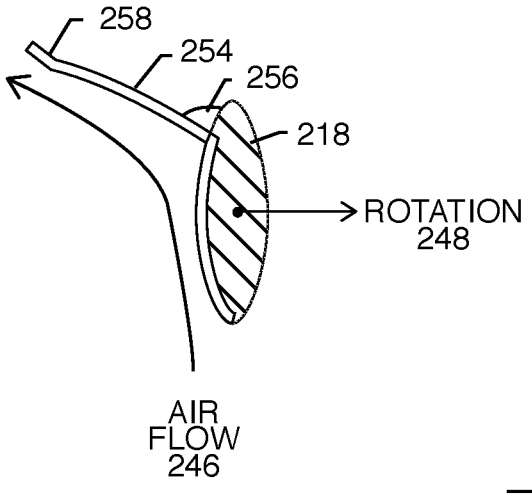
FIG. 56 is a simplified representation of the structure of FIG. 54 now showing how the pivotable flap would interact with the airflow during a descent.

FIG. 56 shows what happens during a descent of the toy 200. Air flow 250 will force the flap to pivot about its hinge or about its pivot. An extension 258 can increase the surface area of the flap 254. As the flap 254 pivots upwards, a stop 256 will prevent the flap 254 from over rotating. The flap 254 then causes the body to rotate along rotation 252. Autorotation can be achieved simply with the addition of this pivotable flap 254 while not departing from the aesthetics of the traditional rocket form.

Figure 57:
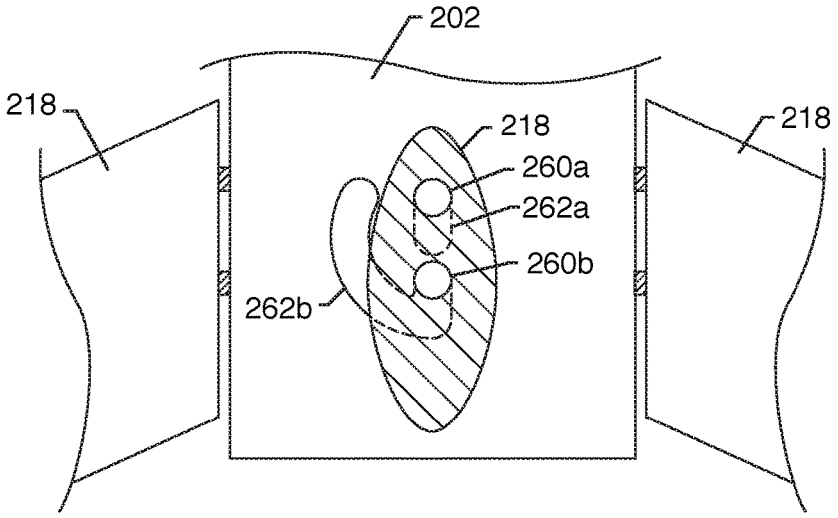
FIG. 57 is a simplified representation of a how a support could be movably attached to the body of the rocket now shown in a stationary position.

FIGS. 57 through 62 show yet another embodiment where the supports 218 are translatable and pivotable in a predefined motion such that autorotation is maximized while also not severely limiting the propulsion upwards of the toy 200. As shown in FIG. 57 the toy 200 is stationary and laid up a surface. Each support 218 has a first guide 260*a* and a second guide 260*b*. The first guide 260*a* is configured to move within the first track 262*a*. The second guide 260*b* is configured to move within the second track 262*b*. When the toy 200 is placed on a surface, the weight of the toy 200 biases the guides 260 at the top of each track 262. In this way the supports are locked into place and seem fixed to the body 202.

Figure 58:
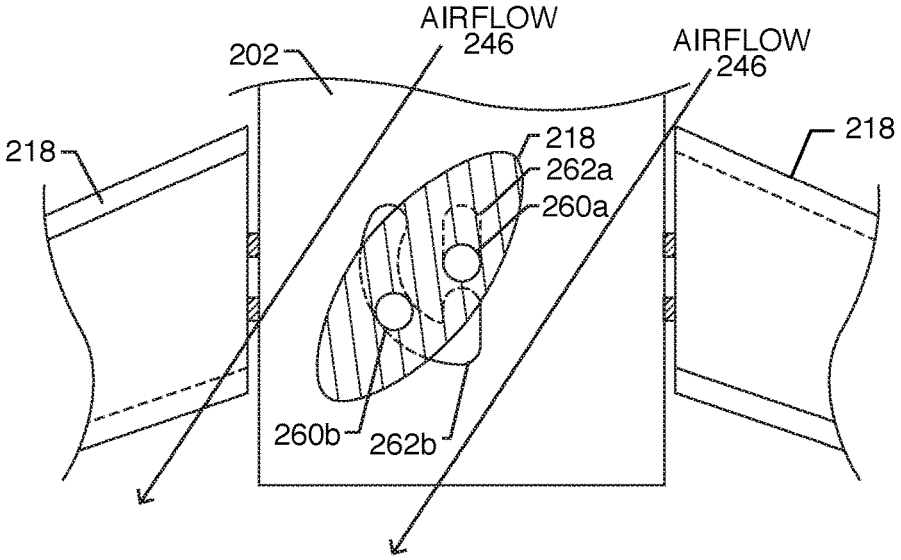
FIG. 58 is a simplified representation of the structure of FIG. 56 now showing how the support would interact with the airflow during an ascent.

FIG. 58 shows the toy 200 when it is ascending. The toy 200 is being propelled upwards and the body 202 is being spun due to the torque on the body 202 from the motor and propeller. As the body moved upwards, the guides 260 fell downward in the tracks 262. Then as the airflow 246 impacts the supports 218, the supports 218 rotate about the first guide 260*a*. The supports 218 are now directly facing into the air flow 246. This orientation does not produce any thrust upwards, but it does minimize the drag generated by the supports 218.

Figure 59:
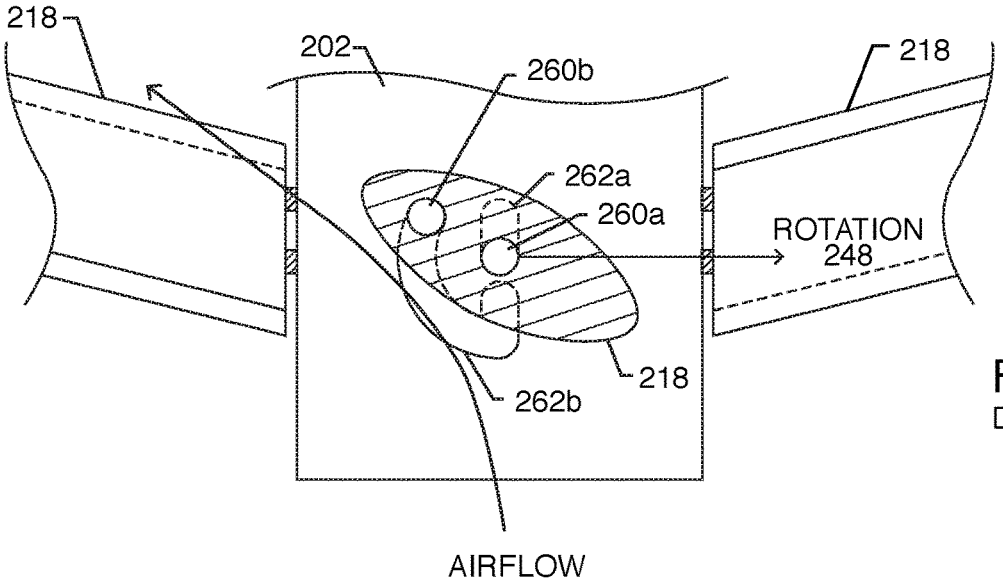
FIG. 59 is a simplified representation of the structure of FIG. 56 now showing how the support would interact with the airflow during a descent.

FIG. 59 shows the toy 200 when it is descending. Now the supports 218 pivot even further about the guide 260*a* until the second guide 260*b* comes to its end of the track 262*b*. Now the support 218 is in the optimal position to create a substantial autorotation function.

Figure 60:
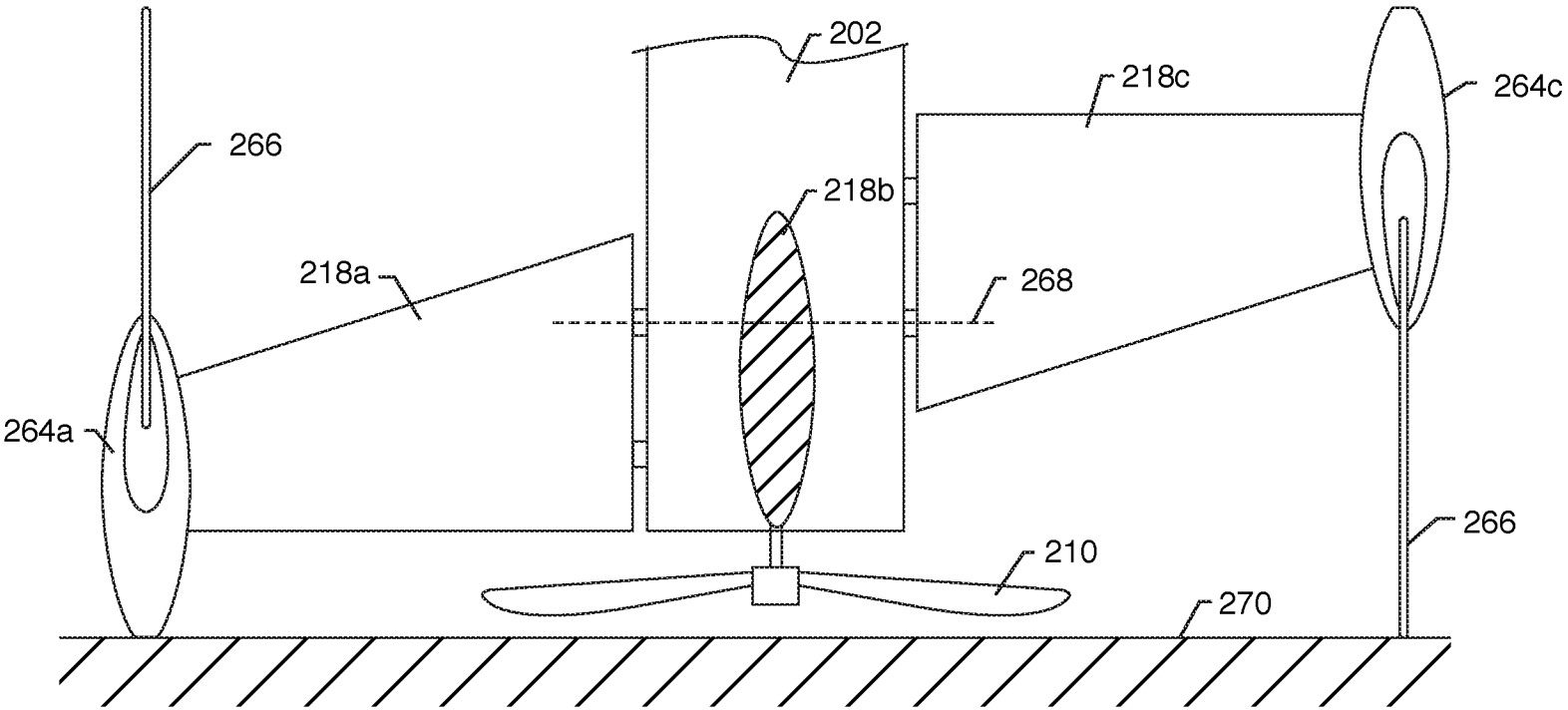
FIG. 60 is a simplified side view of another exemplary embodiment of a self-propelled rocket toy with movable support now showing the left support in the stationary position and the right support upside down.

FIG. 60 incorporates the similar structures taught and shown in FIGS. 57-59. Each support 218 has a stand 264. The stand 264 may be a separate part or integrally formed as part of the support 218. Support 218*a* is shown to demonstrate that the stand 264*a* keeps the propeller 210 from touching surface 270. However, when the support 218*c* rotates completely upside down it would no longer protect the propeller 210 from impact when the toy 200 autorotates back to the ground. An extension 266 is shown to prevent the propeller 210 from ever impacting the surface 270. The extension 266 must be configured such that it keeps the propeller 210 off the ground no matter how the support 218 is rotated about the axis of pivot 268.

Figure 61:
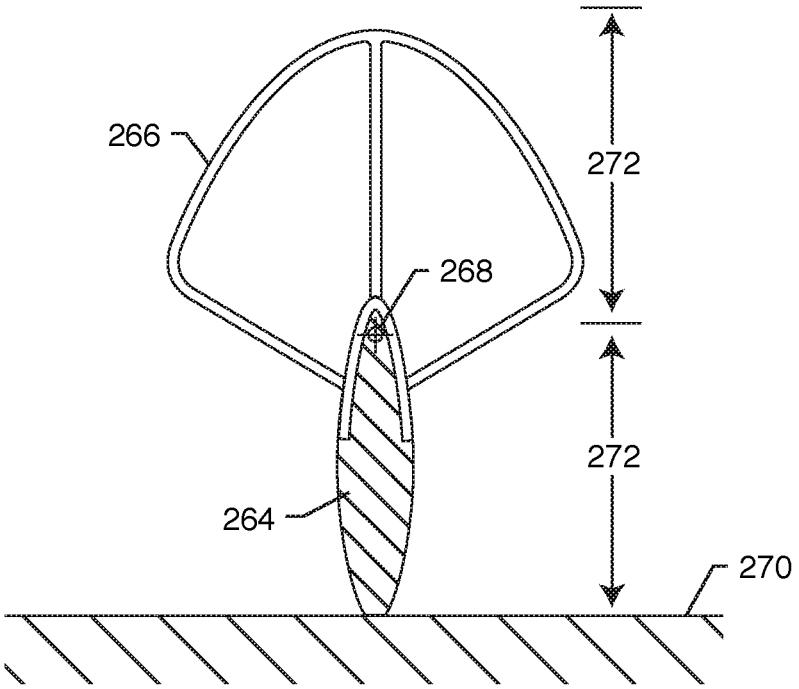
FIG. 61 is a side view of an exemplary support with extension structure.

FIG. 61 shows one embodiment of the extension 266 which is attached to the stand 264. As can be seen the distance 272 is the same about the axis of pivot 268.

Figure 62:
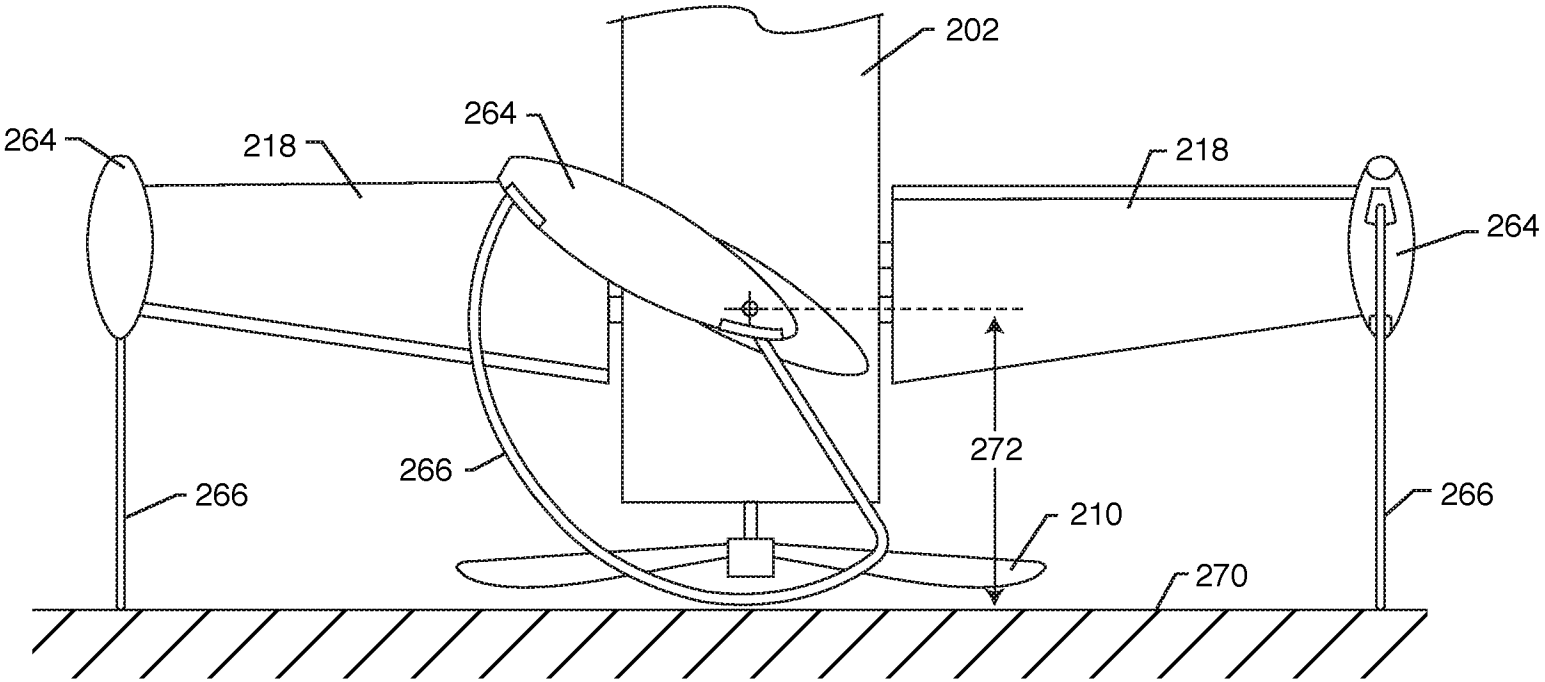
FIG. 62 is a simplified side view of another exemplary embodiment of a self-propelled rocket toy with movable supports now showing how during autorotation the extension structures protect the propeller.

FIG. 62 shows another embodiment of how extensions 266 could be devised to keep the propeller 210 from impacting the surface 270 when autorotating. Here the extensions 266 are asymmetrical as they are only needed to be disposed on one side of the stands 264. This is because as shown in FIGS. 57-59 the motion of the supports 218 are defined along the tracks 262. As can be seen, the transition from ascent to descent is seamless as the body 202 never stops its rotation along the same direction.

It is also possible to configure a variety of mechanisms and configurations to produce the desired motion of the supports 218. This teaching is not intended to limit it to just the precise form disclosed herein. Furthermore, the supports 218 may be motorized such that even greater control can be obtained. For instance, the supports could be angled to produce thrust during ascent while also angling further over during descent or angled directly upwards when the toy 200 is stationary such that it resembles a traditional rocket form.

Although several embodiments of the self-propelled rocket toy 80 have been described in detail for purposes of illustration, various modifications may be made to each without departing from the scope and spirit of the invention. Accordingly, the invention is not to be limited, except as by the appended claims.

Flying Football

Referring now to FIGS. 9-20, a throwing and catching flying toy 300 is commonly referred to either as the Flying Football, the Wing-It Football or the Gliding Football. The throwing and catching flying toy 300 comprises a structural support 302 including a lift-generating wing 304 attached relative to the support 302. A body 306 is rotatably attached relative to the support 302, wherein the body 306 comprises a front section 308 fixed relative to a rear section 310. Both the front section 308 and rear section 310 rotate about a longitudinal axis 312. A tail 314 is located relative to either the support 302 or the body 306 extending in a direction beyond the rear section 310 of the body 306. A tail fin 316 is attached relative to a tail end 318.

In exemplary embodiments, the body 306 may comprise a generally oblate spheroidal or football shape. It is also to be understood that the body 306 can be formed to resemble other various shapes, such as missile, rockets or other combinations thereof. The rear section 310 is formed such that a person can grasp the toy 300 within their hand and then throw the toy 300 in a similar motion in how a football is thrown. The front section 308 is formed such that it is easy to catch, in a similar manner as to how a football is caught.

Figure 9:
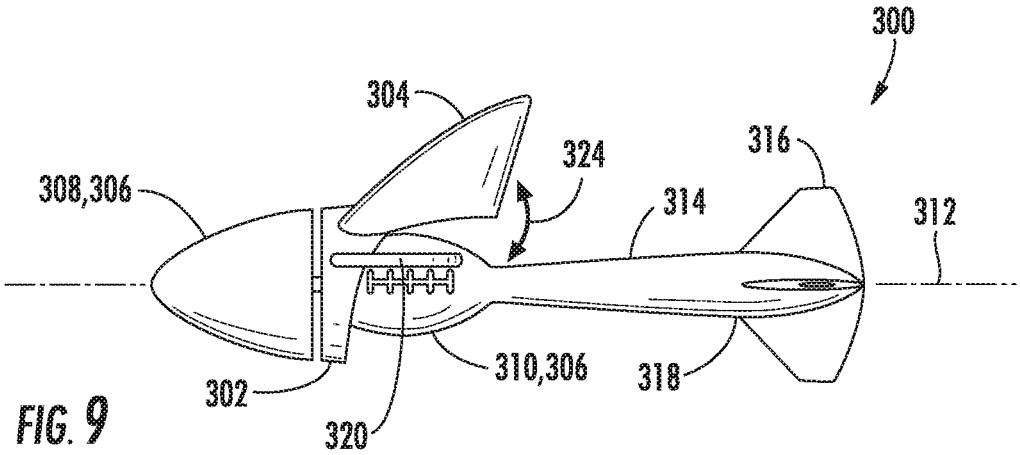
FIG. 9 is a side view of an exemplary throwing and catching flying toy embodying one of the present inventions.
Figure 10:
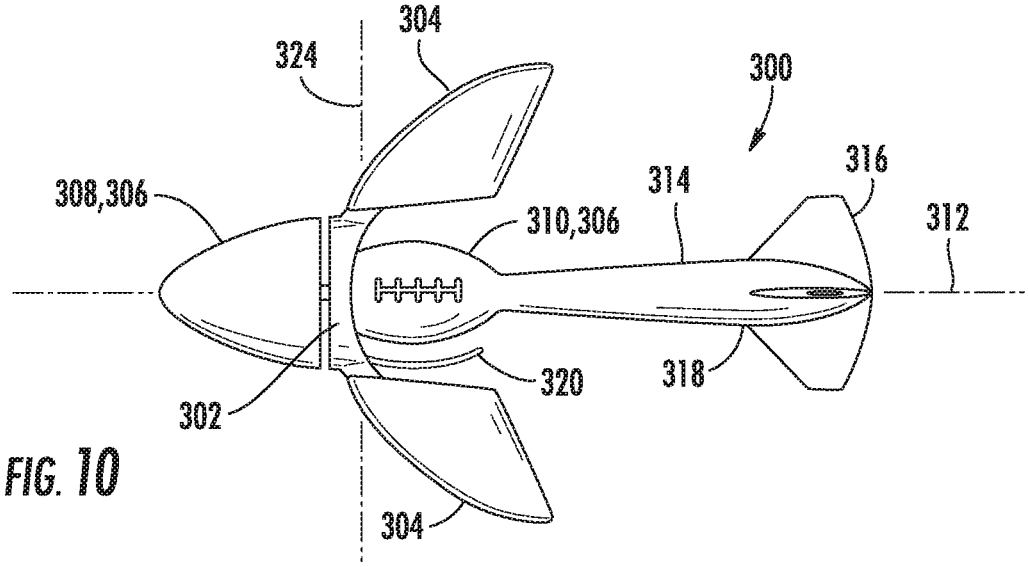
FIG. 10 is a top view of the exemplary embodiment of FIG. 9.
Figure 11:
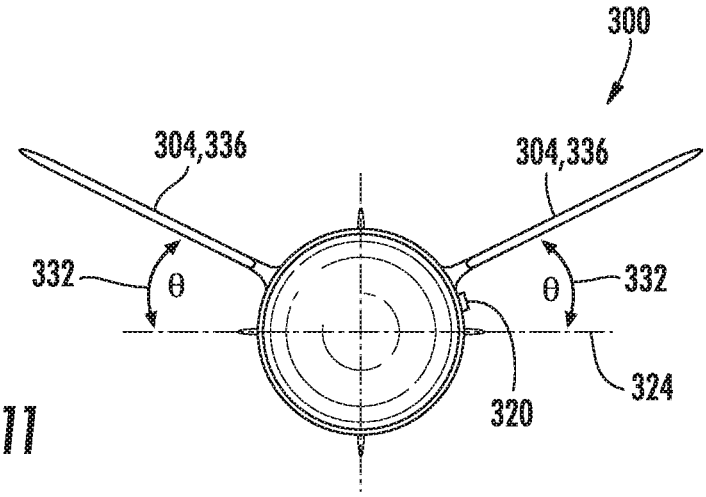
FIG. 11 is a front view of the exemplary embodiment of FIG. 9.
Figure 12:
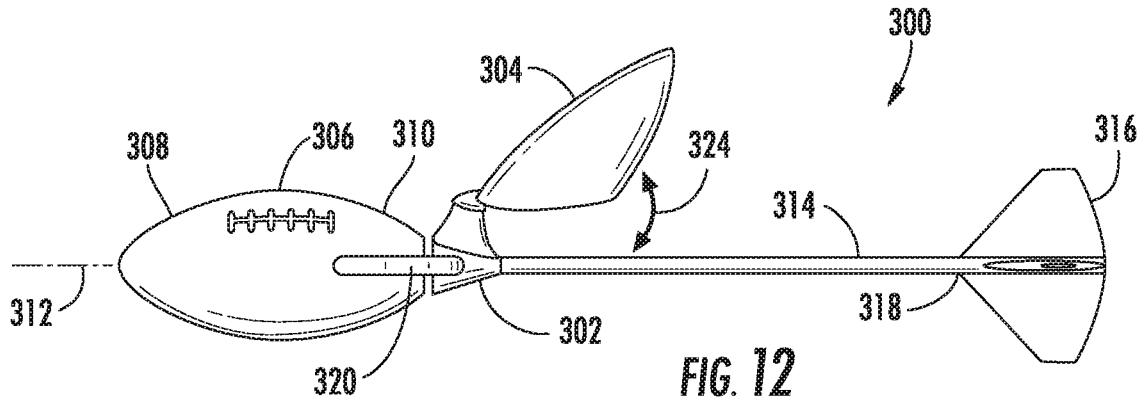
FIG. 12 is a side view of another exemplary throwing and catching flying toy embodying one of the present inventions.
Figure 13:
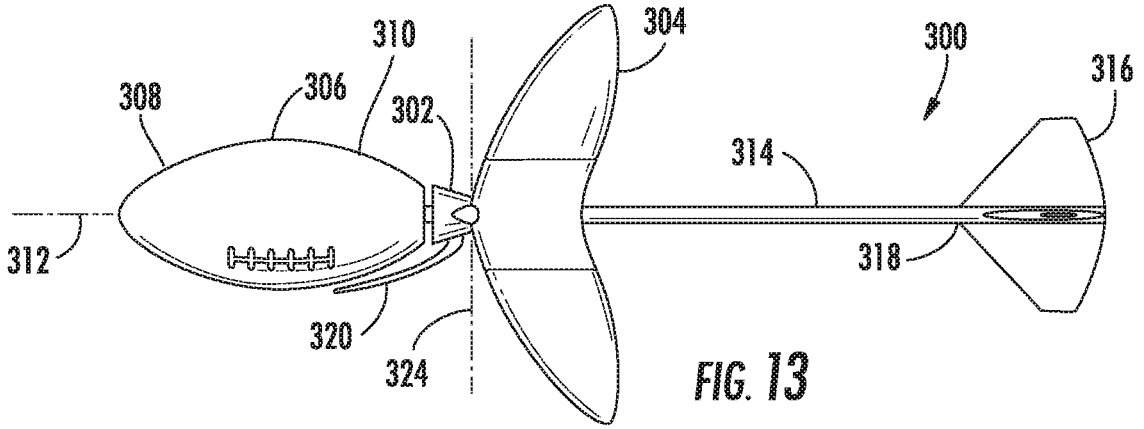
FIG. 13 is a top view of the exemplary embodiment of FIG. 12.
Figure 14:
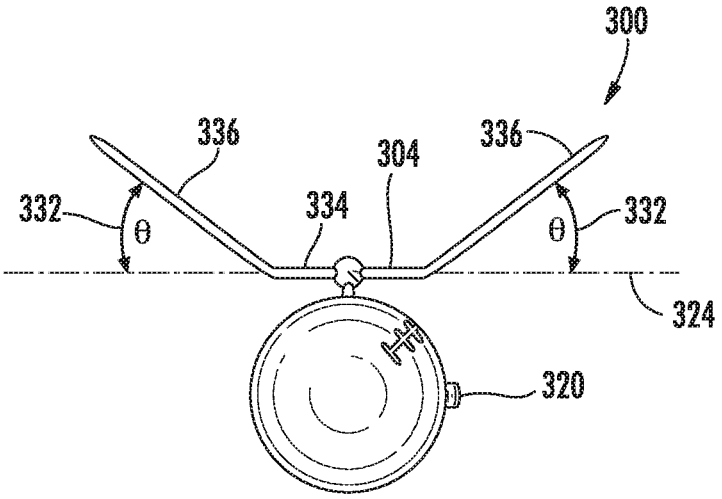
FIG. 14 is a front view of the exemplary embodiment of FIG. 12.

In some embodiments, as shown in FIGS. 12-14, the front section 308 and rear section 310 may be formed as a single body 306. In other embodiments, as shown in FIGS. 9-11 and 15-18, the front section 308 may be formed separate from the rear section 310, while the sections are still fixedly connected. More specifically, the support 302 may be located between and separate the front section 308 and the rear section 310. In some embodiments, as shown in FIGS. 9-11, the rear section 310 may be smaller in diameter than the front section 308. This is so because it is easier to grasp a smaller diameter rear section 310 for throwing, and it is also easier to catch a larger front section 308 when catching the toy 300. In another embodiment, as shown in FIGS. 15-18, the front section 308 and rear section 310 are the substantially the same diameter such that the transition between the sections does not vary in shape and diameter.

Figure 18:
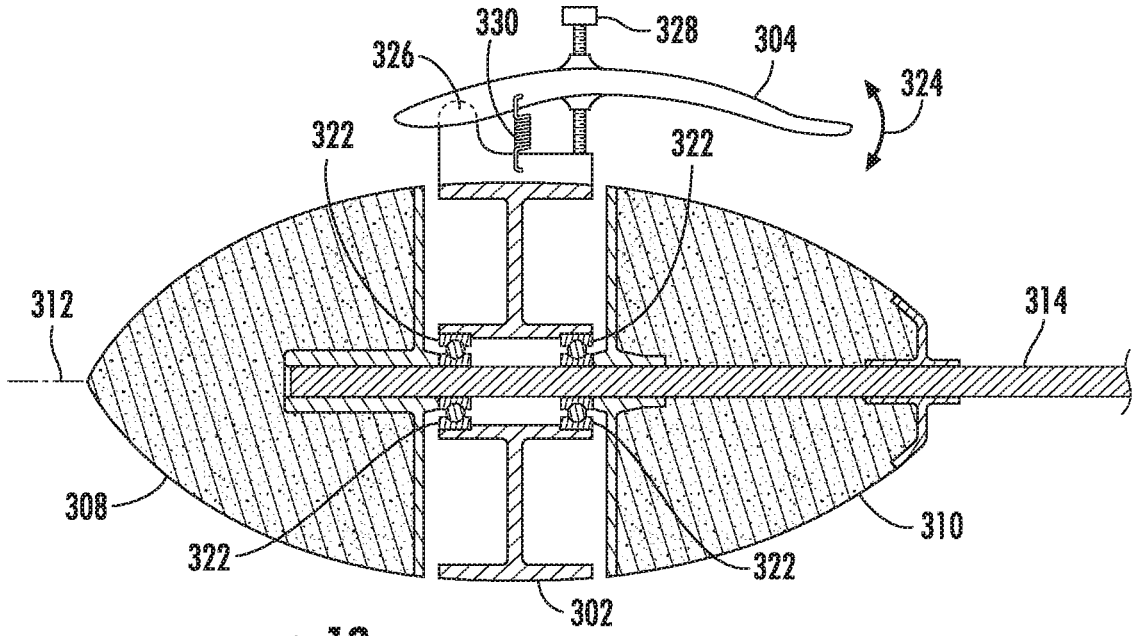
FIG. 18 is an enlarged cross-sectional view of the main body of the exemplary embodiment of FIG. 15.

The body 306 is rotatable with respect to the support 302. This is most easily accomplished with a bearing 322. It has been found that the bearing 322 should be of a very low friction. This can be accomplished with a relatively loose fitting roller ball bearing which does not have grease. Grease imparts enough friction that the body 306 does not freely rotate. Other low friction bearings are suitable replacements if the friction of the bearing is low enough. The bearing 322 is most easily seen in FIG. 18. FIG. 18 shows how the bearing 322 allows the front section 308 and rear section 310 to rotate freely about the support 302.

A thumb grip 320 may be fixed relative to the support 302 and located along and adjacent to the rear section 310 of the body 306. The thumb grip 320 is shaped and formed such that a user's thumb presses the thumb grip 320 while the toy 300 is held. Due to the low friction of the bearing 322, the structural support 302 and wing 304 would rotate when the toy 300 was held before a throw. The thumb grip 320 allows the body 306 to be temporarily fixed relative to the support 302. Once the toy 300 is in the air, the thumb grip 320 is released and the body 306 is able to rotate freely. In the various embodiments, the thumb grip 320 extends from the support 302 and is positioned just above the rear section 310. In FIGS. 9-11 and 15-17 the thumb grip 320 starts at the support 302 and moves rearward over the rear section 310. In FIGS. 12-14 the thumb grip 320 starts at the support and moves forward over the rear section 310. The thumb grip 320 is also positionable on either side of the support 302 such that it can be used for either a right-handed thrower or a left-handed thrower. Additionally, the thumb grip 320 can be positioned at various locations on each side of the support 302 such that it can be sized for people of varying hand sizes. For instance, an adult has a larger hand and might want to move the thumb grip 320 further over as compared to a child with a smaller hand.

In an exemplary embodiment, the wing 304 may be pivotably adjustable in a pitch axis 324 relative to the support 302. Adjusting the pitch of the wing 304 is necessary to trim the toy 300 in flight. If the pitch is too great, the toy 300 may fly in an upward arc and then stall before it reaches the intended receiver. If the pitch is too less, the toy 300 may fly downwards and crash into the ground prematurely. The right amount of pitch is necessary such that the toy 300 can fly in a long and straight flight path.

To achieve this adjustability the wing 304 may be pivotably adjustable with respect to the structure 302. FIG. 18 best shows how this pivotable adjustment could operate, as there are a multitude of methods one skilled in the art could devise. The wing 304 is pivotable about a pivot 326. The wing 304 is biased against the pivot 326 by a bias 330, or also a spring means or a rubber band. The pitch of the wing 304 is therefore adjusted by a screw 328. As the screw 328 threads into the wing 304, it causes the whole wing 304 to either pitch up or pitch down relative to the support 302. The toy 300 can be thrown and adjusted to achieve the right amount of overall pitch.

Another feature of the design of FIG. 18 is that the wing 304 can also be a breakaway wing 304. This means that the wing 304 can come apart from the support 302 and be easily replaced. For instance, when the toy 300 crashes, a wing that is fixedly attached might snap and break. To prevent this, the wing 304 is held in place with the bias 330. When the bias 330 is overcome, the wing 304 simply comes apart from the support 302. Then the wing 304 can be reattached to the support 302 for further play. It is to be understood by one skilled in the art that a multitude of designs can be devised where the wing 304 is breakaway and this disclosure is not intended to limit it to the precise form described and shown herein.

Another feature of the exemplary embodiments may incorporate a wing 304 that has an amount of dihedral built in. Dihedral is best shown in FIGS. 11, 14, and 17. The dihedral angle 332 is a measure of the angle between the wing that is horizontal and the wing that is angled upwards. A wing that has an amount of dihedral built into it is inherently stable. As one side of a wing tips downward and becomes more aligned along a horizontal plane, it essentially generates more lift, which then causes it to rise. Dihedral helps to keep the toy 300 flying level and causes the support 302 and the wing 304 to remain upright while the rest of the body 306 rotates during flight. The wing 304 may be broke apart into two separate halves as is shown in FIGS. 9-11, or the wing 304 may comprise one single wing 304 with a horizontal section 334 joined by two dihedral sections 336 as is shown in FIGS. 14-17. The dihedral angle 332 can be a variety of angles, such as 10 degrees or 20 degrees. The more the dihedral angle 332, the more stability is increased while an amount of overall lift is lost.

Another feature of the exemplary embodiments is placing the wing 304 above the center of gravity of the toy 304 or above the longitudinal axis 312. By placing the wing 304 above the center of gravity, it makes the toy 300 inherently stable. Placing the wing 304 below the longitudinal axis or below the center of gravity would make the toy 300 inherently unstable. The high placement of the wing 304 combined with the dihedral angle 332 makes the toy 300 stable in flight.

The tail 314 can extend rearward from either the support 302 as shown in FIGS. 12-14, or the tail 314 can extend from the rear section 310 of the body 306 as shown in FIGS. 9-11 and 15-18. When the tail 314 extends from the support 302, the tail 314 is stationary in that it doesn't rotate with the body 306. When the tail 314 extends from the rear section 310 of the body 306, the tail 314 rotates with the body 306.

Figure 19:
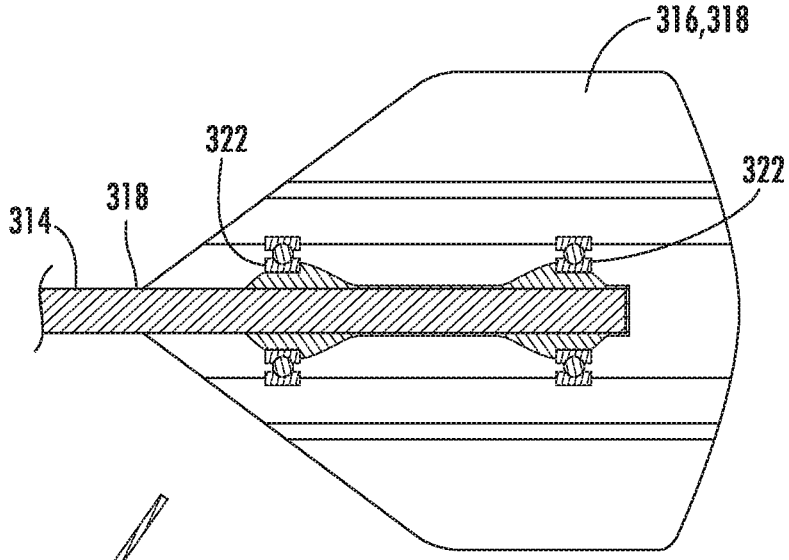
FIG. 19 is an enlarged cross-sectional view of the tail and tai fin of the exemplary embodiment of FIG. 15.
Figure 20:
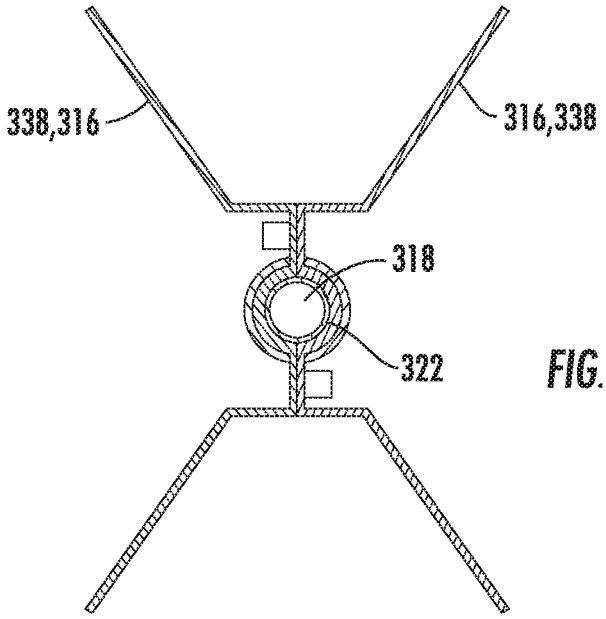
FIG. 20 is a rear view of the tail and tail fin of the exemplary embodiment of FIGS. 15 and 19.
Figure 21:
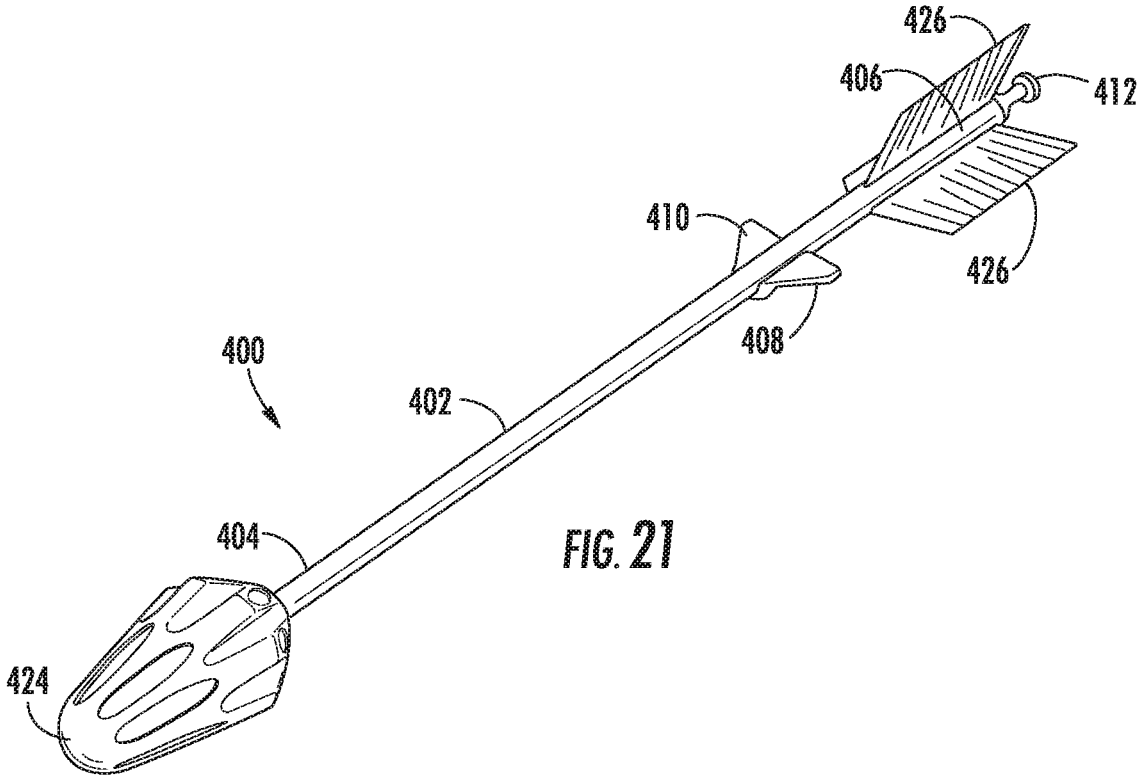
FIG. 21 is a front perspective view of an exemplary bowless arrow embodying one of the present inventions.
Figure 22:
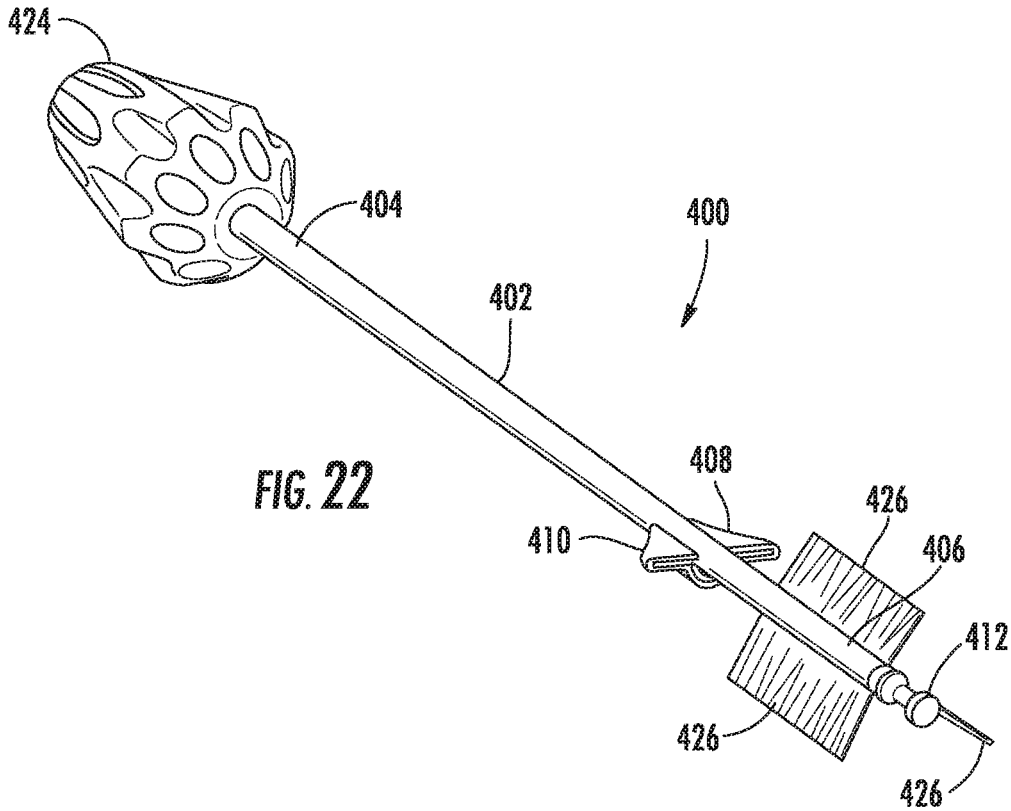
FIG. 22 is a back perspective view of the exemplary embodiment of FIG. 21.
Figure 23:
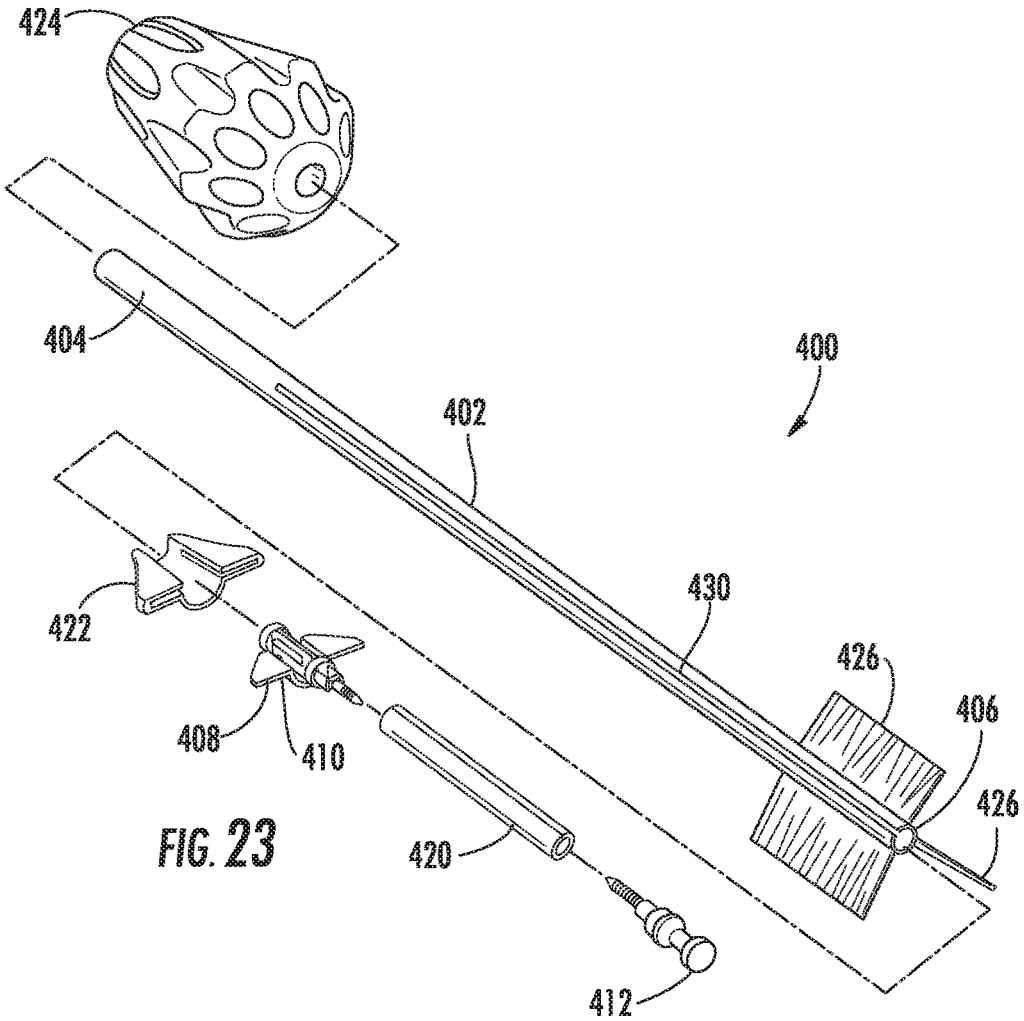
FIG. 23 is an exploded perspective view of the exemplary embodiment in FIG. 22.
Figure 24:
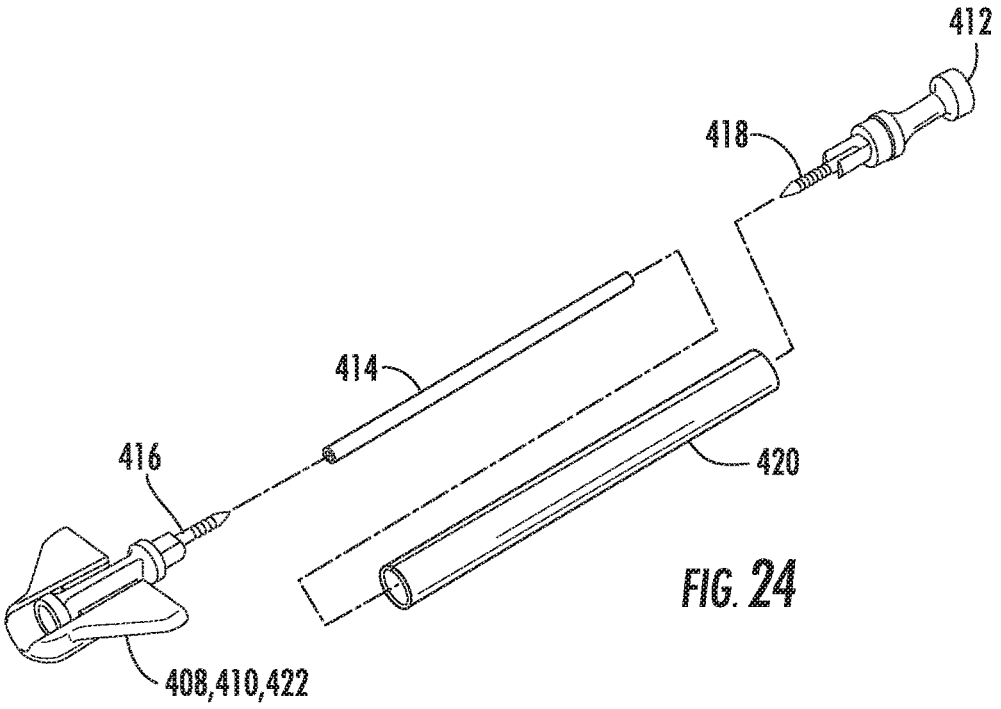
FIG. 24 is an enlarged exploded front perspective view of the launch mechanism of FIG. 23.

The tail fin 316 may be attached to the tail end 318. The tail fin 316 may be either fixedly attached or rotatably attached to the tail end 318. FIGS. 19-20 show an embodiment where the tail fin 316 is rotatably attached to the tail end 318. Bearings 322 may be used to rotatably attach the tail fin 316 to the tail end 318. The tail fin 316 may be comprised of two vacuum-formed plastic parts 338 that are fastened together to capture the bearings 332. For instance, the vacuum-formed plastic parts may be comprised of polycarbonate sheets which are either 10, 15 or 20 thousands of an inch thick. This allows the tail fin 316 to remain light and durable. It is essential for stability that the tail assembly of the toy 300 remain light such that it causes the body 306 of the toy 300 to straighten during flight. Through testing an overly heavy tail assembly shows bad stability during flight and can become uncontrollable. In another embodiment, the tail fin 316 can be angled such that during forward flight, it induces the tail fin 316 to spin. In another embodiment, the tail fin 316 can be a plurality of tail fins 316. As be understood by one skilled in the art a variety of tail designs can be formed as this disclosure is not intended to limit it to any of the precise forms shown and described herein.

The throwing and catching flying toy 300 is the farthest flying football due to the lift-generating wing 304 which allows the toy 300 to actually fly like a glider once thrown in the air. All footballs are simply rotating projectiles. A projectile will travel a set distance that is dependent upon its aerodynamic resistance, exit velocity, overall weight, rotational velocity and various other factors. One variable that is not a factor is lift.

Lift is produced by a wing profile. The reason a football and a wing haven't been combined is that a football body rotates while a wing cannot rotate. A wing can only generate lift if it doesn't rotate and stays relative to the ground. The solution is to allow part of the football to rotate, while allowing the wings to stay stationary.

The center of gravity of the toy 300 in relation along the longitudinal axis 312 should be substantially in the middle of the rear section 310 or near a location between the front section 308 and rear section 310. This means that when the toy 300 is held in the throwing hand about the rear section 310, the center of gravity should be located in the center of the hand as well, but not behind the hand. This allows for a good feeling for throwing the toy 300. If the center of gravity is behind the throwing hand, it is extremely difficult to throw correctly. Therefore, getting the center of gravity within the correct location is critical to making the toy 300 easy to throw.

Another exemplary embodiment not shown would be the integration of the Jetball into the Flying Football. This exemplary embodiment would include the lift-generating wing characteristics of the Flying Football, with the self-propelled characteristics of the Jetball.

Figure 2:
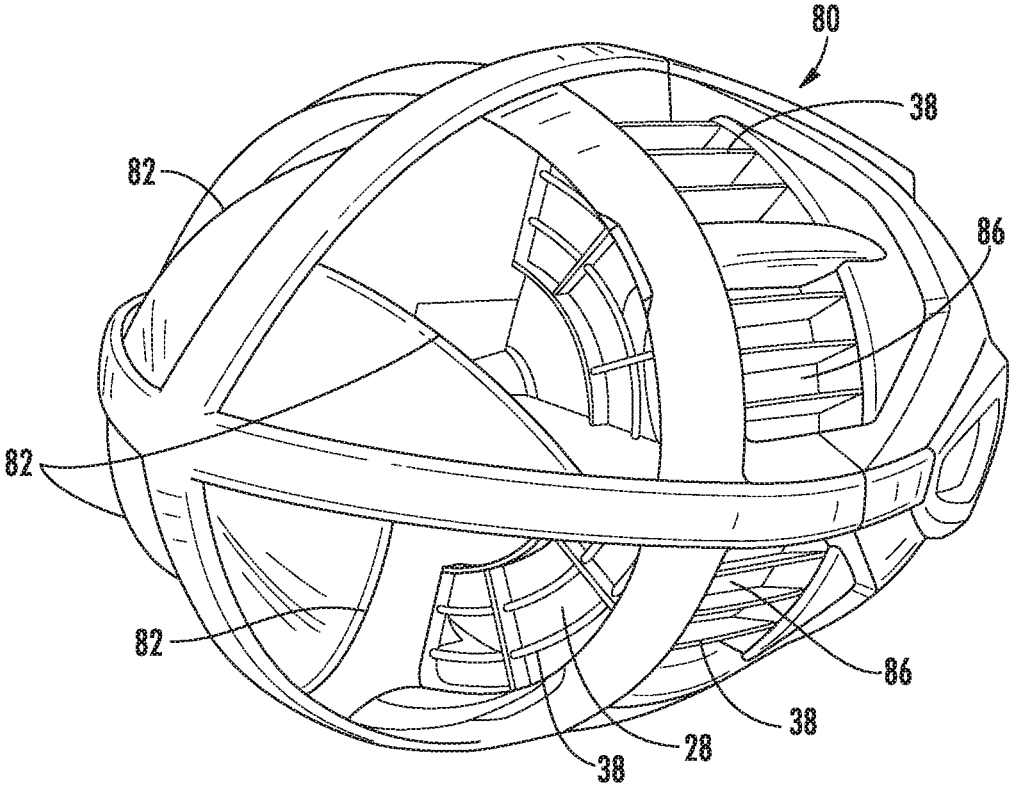
FIG. 2 is a front perspective view of the exemplary embodiment of FIG. 1.

Provisional application 61/816,812 filed on Apr. 29, 2013 showed in FIGS. 1-3 another exemplary embodiment of the present invention. As compared to FIGS. 9-20 20 of this application, the football body of the '812 application did not rotate. The body was stationary with respect to the wings and tail section.

FIG. 4 of the '812 application showed an exploded perspective view of the structure of FIGS. 1-3. FIG. 4 showed it was comprised of a front foam section and a rear foam section separated by a plastic piece. Separating the football body into two sections had the advantage that the foams can comprise different materials. For instance, the front foam can be a soft type foam that is configured to absorb impact loads when the football is caught by a catcher or strikes an object, such as a tree, a car, another person or the ground. The front foam can comprise a soft and resilient type of foam that gives under load but bounces right back after the force is removed. The durable and resilient foam also lessens the g-loads experienced by the rest of the product during a crash.

The rear foam does not have to be the same type of foam as the front foam. The rear foam can be comprised of a stiffer and lighter material such as EPP, EPS or EPO foam. These foams are significantly lighter than as compared to the front foam and help to keep the overall weight of the product low. The rear foam can also be stiffer such that a thrower of the football can get a good grip on the product.

The part separating the front and rear foam is fastened or attached to the center shaft that runs the length of the product. In this case the shaft is 15 mm diameter 7075-T6 aluminum. Through testing 10 mm diameter aluminum shafts were used. However, these shafts were constantly breaking and bending during use of the product. Increasing the diameter from 10 mm to 15 mm increases the overall strength of the aluminum shaft. Furthermore, the aluminum shaft is strong because it is made from 7075-T6 which is a very strong alloy of aluminum that has also undergone a heat treatment process to increase its strength.

The part separating the front and rear foam can be glued to the aluminum shaft, press fitted, or fastened to the shaft. When the football impacts an object, impact loads are transmitted through the front foam and to the middle part that then transmits the loads to the shaft. This means that for the most part, impact loads are not transmitted through the rear foam. The middle part can be injection molded. In this particular case the middle part is comprised of polypropylene (PP) due to its low density. The front foam can be glued to the middle part to ensure that the front foam stays attached to the rest of the product. The middle part is this embodiment is fastened to the shaft with a bolt and a nut (not shown).

Behind the rear foam is the wing bracket. FIGS. 5-6 of the '812 application are further exploded views of the body of the football. The wing bracket captures the rear foam between the middle part and the wing bracket. The wing bracket can also be attached to the center shaft in a multitude of ways but is shown here with a hole for a fastener (not shown). Through product testing a lot of force is transmitted through the wing bracket part. Typically prototype parts were made using ABS. However, ABS would snap and break due to fatigue. It was discovered that polycarbonate (PC) is an optimum choice for the wing bracket that reduces breaks and mechanical failure.

FIGS. 7-9 of the '812 application are various views showing the novel attachment means between the wings and the wing bracket. When the product strikes the ground or strikes a tree, a large amount of force is transmitted through the wings into the wing bracket. This area of attachment is a zone that is prone to failure. Using screws to primarily hold the wing to the wing bracket led to repeated failures. The embodiment here teaches to hard mount the wing to the wing bracket through a male-female feature that reduces the loads carried by a fastener. For instance, in these embodiments the wing bracket has a male section that is match fitted to fit within a female section on the wing. In this embodiment the male protrusion is shaped as an oval such that proper placement and location is automatic. The wings cannot move relative to the oval which locks the wings in place.

By placing one part inside of the other, impact loads are transmitted through the materials themselves and not through a fastener. Here, a fastener is still used but it is not a load carrying fastener. A bolt/screw/fastener can enter from above the wing and a nut can be placed within the channel located on the wing bracket. The fastener and nut simply help hold the wing onto the wing bracket, but no major impact loads are needed to flow through the bolt and nut. In this embodiment the hole that the nut is placed within is match sized such that a socket or a wrench needed to hold the nut in place is not needed. This simplifies the overall parts needed for a customer to assemble the product and reduces costs. The Applicant prefers to use a bolt/screw with a locknut. Lock nuts have nylon inserts that prevent unfastening due to vibration. Therefore, the hole in the wing and wing bracket is a through hole. A screw could be used, but then the screw would have to bite into the plastic of the wing or wing bracket. Threads would be formed by the screw and could create areas of stress localization that would result in premature failure. As can be seen, the male or female side could be switched between the wing and wing bracket. Also, many sizes and shapes of male-female features could be used that accomplish the same result.

At the rear of the wing bracket it is flat and has two extensions designed for placement of the first and middle finger. Because this particular embodiment does not spin, it is intended that the thrower of the product place his/her first and middle finger on the back of the wing bracket. The throwing action is then a mix between a football throw and that of a throw for a dart or a glider. The flat surface allows a great location to impart a large push force for extended throws.

FIGS. 10-13 of the '812 application show an embodiment of a tail section of the football. This particular design is configured to also act as an upright stand as best shown in FIGS. 11 and 12 of the '812 application. Both tail sections provide the needed stability to make the product fly straight during use. However, the horizontal tail is designed to be manually adjustable. A thumb screw (not shown) is configured to go into the rear protrusion on the horizontal tail. It has been discovered by the applicant that the product flies best when nose-heavy. This means that the center of gravity of the product is ahead of where the lift is generated by the wings. This means that if the horizontal tail was purely horizontal the product would nose dive to some extent. To counter-act this nose dive, the horizontal tail can be manually biased up through the thumb screw. The thumb screw threads through the protrusion on the horizontal tail and pushes against the center shaft. This then causes the horizontal tail to push down when in flight. The user can then adjust the balance of the football to achieve perfect flight characteristics. To help bias the horizontal tail against the center shaft, a rubber band or other bias means can be used. Here, a rubber band (not shown) can be placed around the protrusion on the horizontal tail and the shaft.

Figure 15:
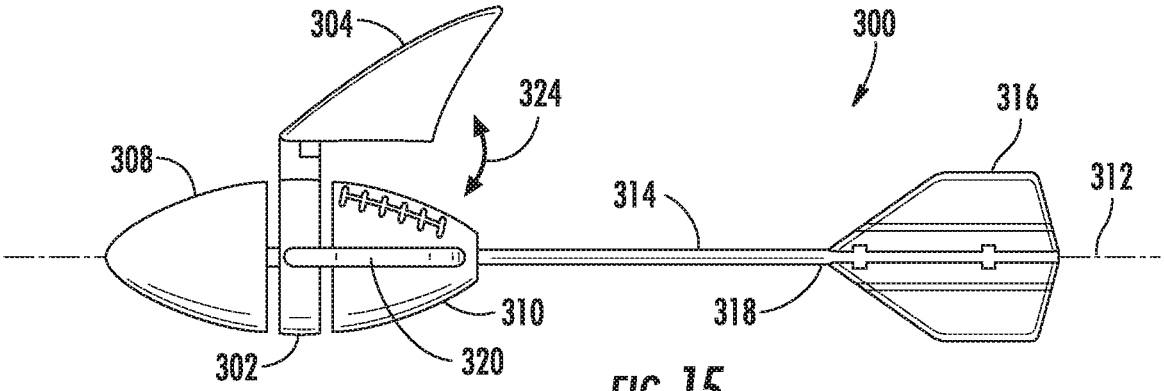
FIG. 15 is a side view of another exemplary throwing and catching flying toy embodying one of the present inventions.

FIG. 13-15 of the '812 application shows another embodiment of the wing bracket. In this embodiment, the wing bracket was shortened and the finger push section raised. This was done to locate the finger push sections at the vertical center of gravity of the overall product. It is preferred to have the finger push section centered on the center gravity. However, the product still could work if it was centered within 0.5 inches or even 1.0 inch of the center of gravity. It was discovered in the embodiment shown in FIGS. 1-12 that the cg was higher/above the finger push areas. Therefore, when the football is thrown hard, the football would rotate upwards because the portion being pushed was below the center of gravity. As can be seen in the images, the bottom of the wing bracket it also contoured to allow access for a user hands to rest against and helps allow one to better hold and grasp the football. It is expected that the user places his first and middle finger along the back of the wing bracket. The thumb rests against the rear body of the football on one side while the ring finger and pinky finger rest on the opposite side of the rear body. The first finger and middle finger split the center shaft of the football. It is also noted that the finger push sections are also near the center of gravity with respect to the overall product when looking at it from front to back, or with respect to along the longitudinal axis. As one can see the finger push sections are also aligned with center of gravity left to right as well. Therefore, the finger push sections are aligned with the center of gravity in all three axes. This is believed to provide more reliable and consistent launches/throws by the thrower.

Figure 16:
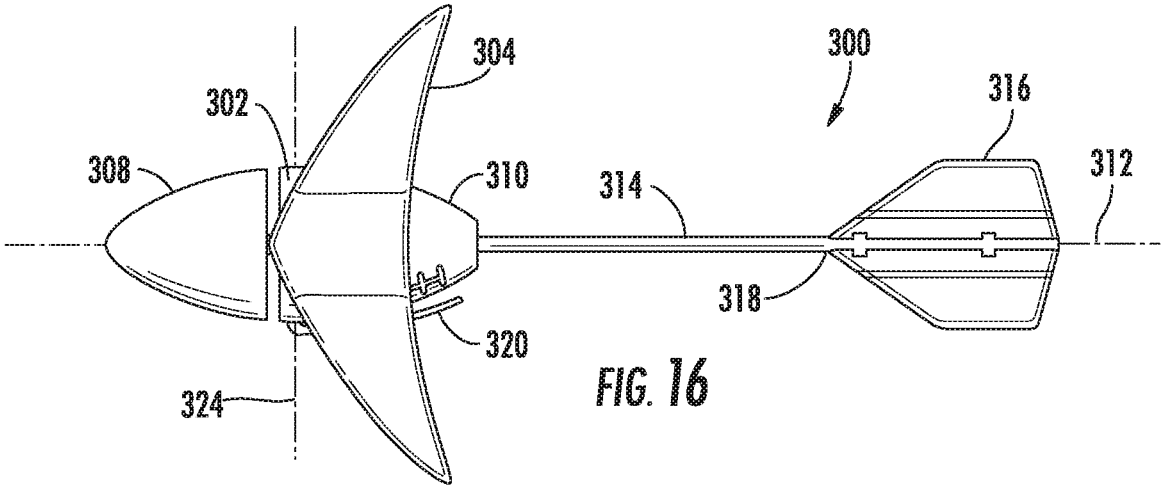
FIG. 16 is a top view of the exemplary embodiment of FIG. 15.
Figure 17:
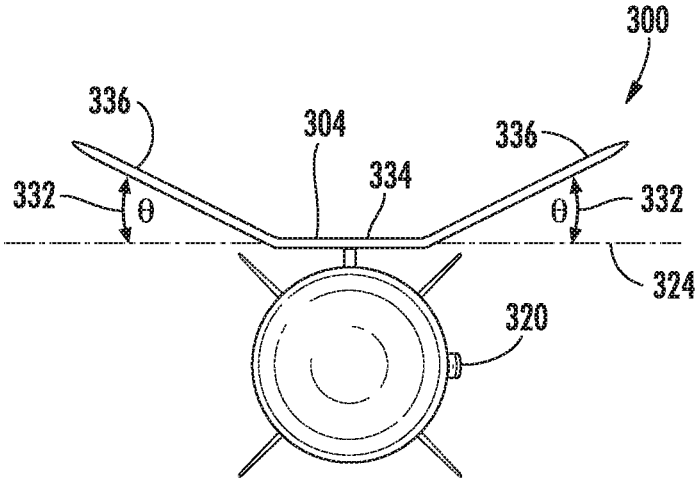
FIG. 17 is a front view of the exemplary embodiment of FIG. 15.

FIGS. 16-17 of the '812 application are yet another embodiment of a tail section where the horizontal tail is ahead of the vertical tail. Each tail section also includes a hex shaped recess for a locknut to be placed within. FIGS. 16-17 of the '812 application show a large tail section for increased stability. The horizontal tail also includes a protrusion for a thumb screw (not shown). A tailless version may be constructed that completely removes the horizontal and vertical tail. Winglets on the end of a main wing may be used in lieu of the vertical tail and wing twist may be used in lieu of the horizontal tail.

The wing of the football is also unique. Most RC aircraft use a foam or wood wing. These wings are easily deformed and broken during crash landings. These wings cannot stand up to the repeated use a football encounters. The applicant has invented a wing made from plastic. The wing is thin in that no substantial thickness is used. Typically wings have a thickness to them. However, a plastic wing with a thickness would be too heavy and impractical. Also, to keep manufacturing costs low, the applicant uses a single layer of plastic that is curved to produce a wing-like shape. Because the wing is made from a plastic, such as high-impact polystyrene (HIPS) or ABS it is stiff yet light enough. HIPS was found to be one of the optimal choices due to its stiffness in keeping its shape. However, later is was discovered that ABS was more optimal as it was not prone to cracking as much as HIPS. As can be seen, a variety of polymer choices could be used.

The wing is also specially shaped to improve aerodynamics and provide long, consistent throws. In the applicant's experience, one optimal configuration is for the wing to have about an 8 percent thickness measure from the bottom of the leading and trailing edges. The height of 8 percent is reached about 30 percent along the cord of the wing. Also, the angle of attack of the whole wing is at 2 degrees with a 2 degree downward twist of the wing moving from the center out. This means that at the tip the wing has zero angle of attack. This helps to keep stability during high angles of attack when the football is climbing at a high angle. Also, these wing measurements have provided long throws with substantial increase in distances thrown.

The middle section also is shown as having two legs or stands protruding. This allows the product to be placed on a surface and remain upright.

The wing also has a substantial amount of dihedral such that it adds to overall stability. The dihedral angle could be 10, 15 or 20 degrees or some other variation thereof. The wings are also swept backwards to aid in stability and to also keep the wings behind the football body such that it is easier to catch.

It is also contemplated that one embodiment of the football could include active surfaces to keep it aligned and straight. These adaptive/active surfaces could include a gyro/sensor that controls a servo and a flap, such as is done with radio controlled aircraft.

In another embodiment, a football could include a height sensor to keep the football flying about chest level throughout its flight. A sensor could determine whether the football was too high or too low and make an adjustment.

It was also discovered during testing of other versions with a rotating football body that gyroscopic precession can cause the football to turn in the air. This therefore means that to neutralize this affect, the center of gravity of the rotating body/mass along the longitudinal axis should coincide with the center of the lift being generated such that no gyroscopic precession exists. A preferred embodiment may include forward swept wings such that the center of gravity of the rotating mass will be aligned with the center of the lift being generated. In this way the product can have its gyroscopic precession minimized to the point where it has no noticeable affect or to the point where it is eliminated.

In another embodiment, the football could include active control surfaces controlled by a transmitter similar to an RC aircraft. A person throwing and a person catching the product could each control the football, preferably one at a time. Because the transmitter is typically held and controlled by one's hands, this would be impractical for a football. Therefore, a transmitter could be integrated into a hat or a headband. Control of the football would be done by tilting one's head forward/backward or left/right. Sensors in the hat/headband could sense movement and then transmit them to the football. A switch on the football could be switched such that control from only one headband is allowed at any one time.

A baseball version of the product is also possible, as many of the technologies and lessons learned can be applied to a baseball version. For instance, the football body could be replaced with a baseball body. Also, the body could be a double baseball configuration with a forward baseball body for catching and a rearward baseball body for throwing.

Moving from the refinements and improvements made in the '812 provisional application, more improvements are disclosed herein as shown in FIGS. 39-50. The embodiments shown in FIGS. 39-50 are very close as the version that will go into production. A throwing or catching toy 300 has a generally elongated spheroidal body 306. The body 306 can be defined as having a longitudinal axis 312, where a length 307 of the body along the longitudinal axis 312 between a front end 311 of the body 306 to a back end 313 of the body 306 is longer than an equatorial diameter 309.

The equatorial diameter 309 is generally aligned with a center 319 of the body 306. The center 319 is disposed along the longitudinal axis 312. The center 319 may not evenly split the distance from the front of the body 311 to the rear of the body 313 depending on the shape of the body 306. This is the case with the present embodiment where the football shaped body 306 has a bullet shape.

It has been learned that various prior art patents and texts refer to a football shape as either being an oblate spheroid or a prolate spheroid. It is now believed that a prolate spheroid is the proper geometrical description, however as used herein in previous applications and this application, both prolate spheroid and oblate spheroid have the meaning that the body 306 is elongated like a football such that is cuts through the air better being more aerodynamic while also resembling a football. It is also understood herein that football refers to American football and not the game of soccer where a soccer ball is completely round.

A lift-generating wing 304 is non-movably attached to either the body 306 or to a support 302. The support 302 is non-movably attached to the body 306. In this embodiment, the front end 311 of the body 306 comprises a front end 315 of the toy where the support 302 is not disposed through the front end 311 of the body 306. The toy 300 is easier to catch when the front end 315 of the toy is just the football shape without the support 302 protruding or extending therethrough. In this manner the body 306 is configured to be thrown and caught by a user.

In this embodiment, it is preferred that the equatorial diameter 309 is at least 3.5 inches. 3.5 inches in diameter is larger than a typical RC aircraft fuselage but smaller than a full size football. If the equatorial diameter 309 was less than 3.5 inches, it would improve aerodynamic drag however it would be at the expense of ease of catching the toy 300. The product is still a throwing and catching product and consideration to ease of catching must still be a valid concern. Some products in the marketplace are simply too small and easily pass through the open hands of a receiver/user only to hit the receiver in the head or body.

This embodiment has the body 306 broken up into a front section 308 and a rear section 310. The front section 308 is designed and configured to reduce the impact loads upon the toy 300 and prevent injury to the users. One of the major hurdles in perfecting the toy 300 was making a structure and design that could withstand the abuse of repeated crashes and hard landings while still flying straight and true. Part of the solution is to make the front section 308 soft to the touch or to absorb energy. This means that at least a portion of the front end 311 of the body 306 or the entire front section 308 be made to have a Shore A durometer hardness substantially equal to or less than 25. For instance an EVA style foam may be a good choice for the front section 308. The upper limit of the Shore A hardness should remain at or below 35. A Shore A hardness at or less than 25 is optimum. This provides a good balance of sufficient stiffness while also having sufficient compression for reducing impact loads. As can be seen the front section 308 of the body 306 is football shaped providing good aerodynamics while also being aesthetically pleasing.

Due the material of the front section 308, it is typically quite heavy. It is preferred that an overall weight of the toy is less than 400 grams. It is even more preferred if the overall weight is at or less than 350 grams. Better yet, it is optimum if the overall weight is at or less than 300 grams. It is also preferred that the overall weight remain above 200 grams or better yet 250 grams. When the weight goes down, the toy 300 remains in the air longer as the lift being generated by the wings 304 keeps the toy flying. However, if one was to make the toy too light, it could actually damage the user's arm. It was discovered through testing that footballs with weights around 150 grams were too light and it would create physical damage from throwing one's arm out. You could actually feel small tears in the arm ligaments from throwing various football products after just a couple throws. It was found that having a weight around 300 grams was optimal such that it was easy to throw and yet did not cause any damage to the arm of the user.

In efforts to keep the weight down, the rear section 310 can be a lighter material. For instance, the rear section 310 can be EPP, EPS or EPO. These materials are expanded foam polymers that are rigid while being extremely light. However, these materials would not work well for the front end 311 of the body 306 because they would rip and tear far too easily. The density of the rear section 310 should be at or below 2.0 lbs per cubic feet. EPP has a density of 1.3 lbs per cubic feet and is preferred.

It was also discovered that the laces 340 on the rear section 310 were susceptible to ripping, tearing and destruction from the user's hand during the process of throwing. This is because the EPP foam that made up the rear section 310 would wear prematurely. A solution is to place a flexible polymer sticker over this area to provide increased support and increased durability while not increasing the overall weight of the product.

Figure 39:
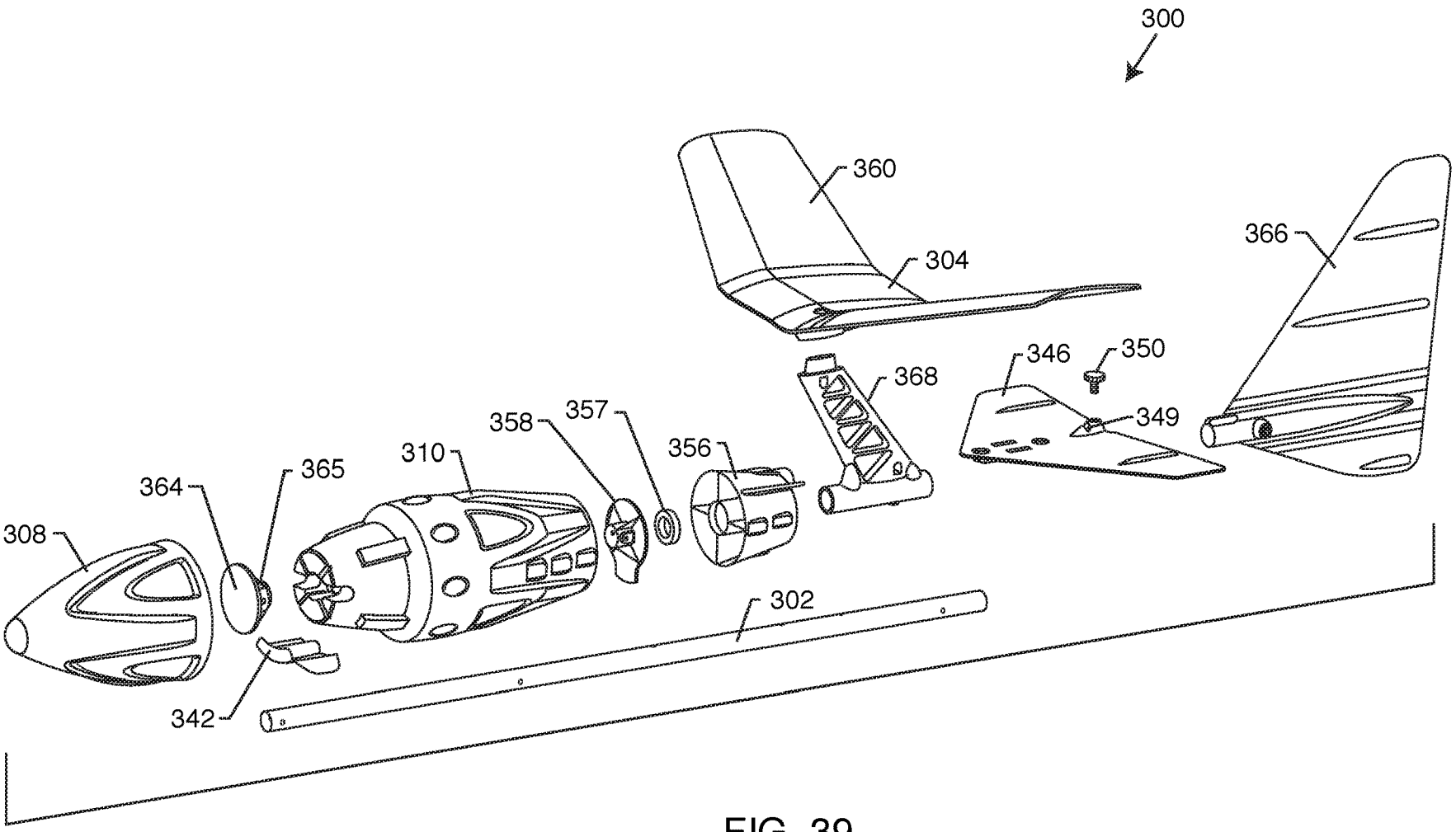
FIG. 39 is an exploded front perspective view of the exemplary embodiment of FIG. 34.
Figure 40:
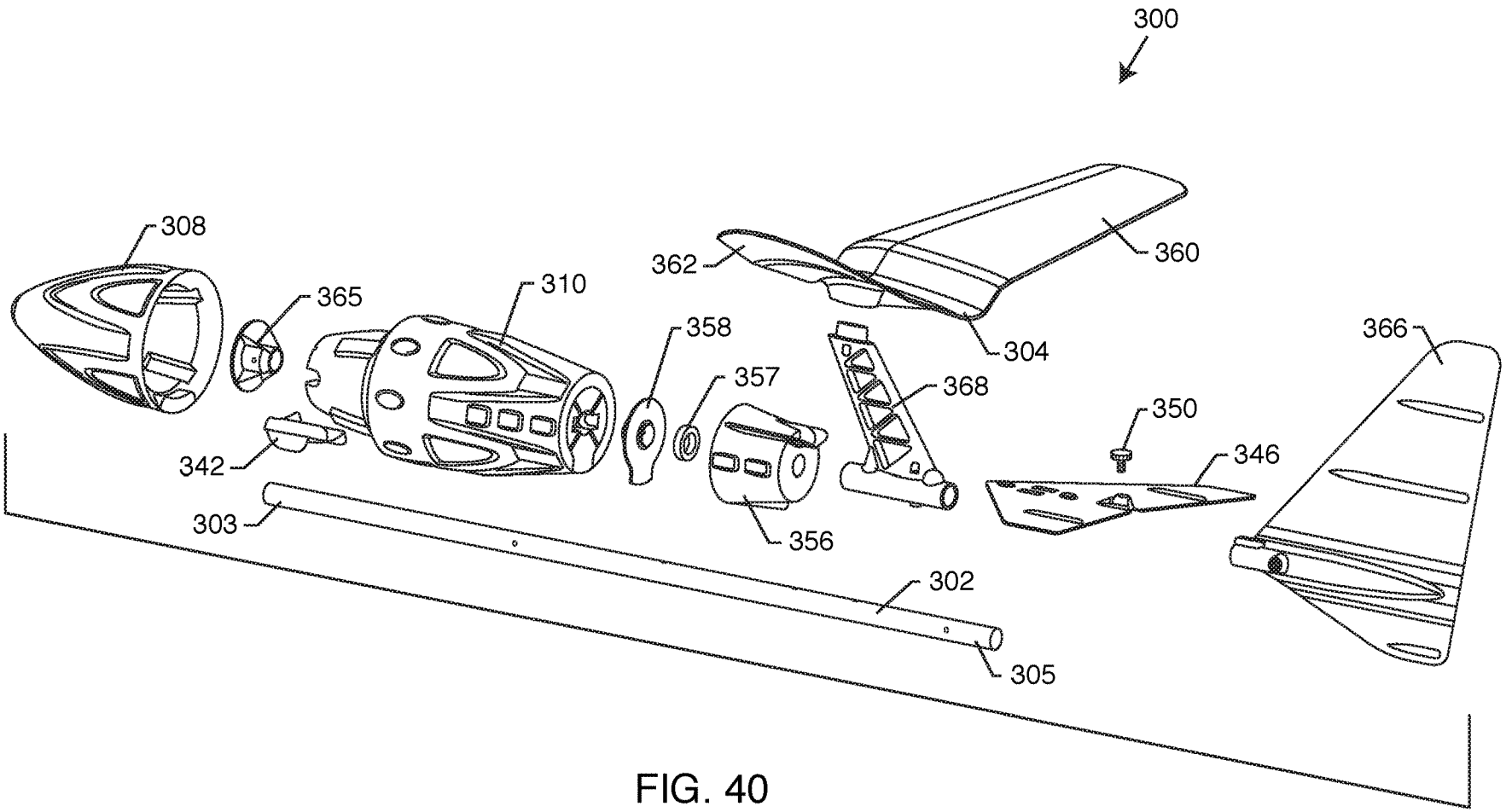
FIG. 40 is an exploded rear perspective view of the exemplary embodiment of FIG. 34.

As best can be seen in FIGS. 39 and 40 and to keep the weight of the toy 300 down, it is better to optimize the shapes of the front and rear sections of the body 306 such that the front section 308 has a smaller volume than compared to the rear section 310. The front section 308 should have a maximum of at least half the volume of the rear section 310. This means the rear section 310 has at least double the volume of the front section 308. Even more optimal the front section 308 should have a maximum of at least one third of the volume of the rear section 310. This means the rear section 310 has at least three times the volume of the front section 308. This particular embodiment has a rear section 310 with a volume of 72 square inches where the front section 308 only has a volume of 21 square inches. This means that the rear section 310 has about 3.4 times the volume as compared to the front section 308.

The support 302 extends along the longitudinal axis 312 beyond the back end 313 of the body 306. The support 302 is a frame for the whole structure, tying all the parts and pieces together in a fixed (non-movably) and controlled relationship. The support 302 has a first end 303 that is disposed within the body 306. The support 302 does not extend outwardly from the front section 308, the front end of the body 311 or from the front end of the toy 315. The support 302 has a second end 305 that is disposed behind the body 306 and extends beyond the back end 313 of the body.

The support 302 experiences a tremendous amount of abuse and shock loads but must remain light and rigid. The use of a thin-walled, hollow aluminum tube was the best choice after significant trial and error. The diameter of the tube is also important. In this embodiment, the aluminum tube comprises a circular cross-section and comprises an outer diameter of at least 15 mm or greater. As the outer diameter increases so does the strength and stiffness. 10 mm diameter tubes were used but kept breaking. The amount of failure was reduced when the outer diameter was increased to 15 mm. Furthermore, the alloy of aluminum used is also 7075-T6 or stronger. This is a very high quality aluminum that is extremely strong. This is needed because other alloys of aluminum would still break and fail. Other cross-sectional shapes of the aluminum tube could be used, such as rectangular, square, hexagon, octagon or other variations thereof. This teaching is not limited to just the use of a circular cross-section.

A floor stand 342 is attached to a bottom 317 of the body 306, where the floor stand 342 is configured to stabilize the toy in a fixed position when the toy is placed upon a generally horizontal surface. (The bottom 317 is opposite the top of the body 321.) This is because the floor stand 342 has two protrusions 343 extend outwardly. It is critical that the protrusions 343 are smoothly shaped such that they don't cut or puncture a user's hands when the user is attempting to catch the toy 300.

The lift-generating wing 304 defines a wing centerline 344, where the wing centerline 344 is generally parallel to the longitudinal axis. The wing centerline 344 is right down the middle of wing 304 centered between the left and right parts of the wing 304. It has been discovered through significant trial and error testing that it is optimal if the wing centerline 344 of the lift-generating wing 306 is disposed at least 3 inches above the longitudinal axis 312. Having a relatively high wing centerline 344 creates an inherent stability of the toy in flight and also places the wings above the user's head when the product is thrown. This significantly makes the toy 300 easier to throw as one does not need to side-arm the toy 300 resulting in an awkward throwing movement.

The lift-generating wing 304 also has a dihedral angle of at least 10 degrees, or more optimally at least 15 degrees. The embodiments shown herein have 17 degrees of dihedral angle. As previously discussed, the dihedral angle increases the stability of the toy in flight and is actually 17 degrees. This means that each side of the wing 304 is rotated up about the wing centerline 344 from a horizontal plane 17 degrees.

A horizontal stabilizer 346 is disposed behind the lift-generating wing. The horizontal stabilizer 346 comprises a downward force producing horizontal stabilizer 346 which creates a nose-up pitch of the toy 300 in flight. It was found optimal to create a toy 300 with a natural tendency to dive downwards in flight, or pitch downward in flight. Then the horizontal stabilizer 346 can be trimmed by the user to balance the toy 300 for their individual throwing style and ability.

When a wing is producing lift, its forces can be simplified to have a lift component upwards and a moment component pitching forward. A wing does not just generate a lift component, as the moment component is not intuitive to understand. To balance the moment component one could adjust the center of gravity 348 of the overall toy by moving it forwards and backwards with respect to the longitudinal axis. This usually means moving the wings relative to the rest of the body or structure. However, moving the wings is very difficult in a toy that needs to withstand repeated crashes and yet still produce reliable and repeatable alignment crash after crash. Also, the amount of balance may be different from one person to another due to the different throwing styles and different throwing velocities.

A better solution as compared to moving structures along the longitudinal axis 312 is to use a manual adjuster 350 associated with just the horizontal stabilizer 346. The manual adjuster 350 controls a shape of the horizontal stabilizer 346. The manual adjuster 350 is mechanically engaged between the horizontal stabilizer 346 and the support 302 as best seen in FIG. 50. The manual adjuster 350 may be a hand-turnable threaded fastener such as a thumb screw or a wing nut. The manual adjuster 350 can be threaded into a nylon-insert/locknut 351 that is captured by the horizontal stabilizer 346. As a user turn the thumb screw 350 it threadably engages the nut 351 and forces the thumb screw down causing the back end of the horizontal stabilizer 346 to rise because the thumb screw is already pressing against the support 302.

Figure 46:
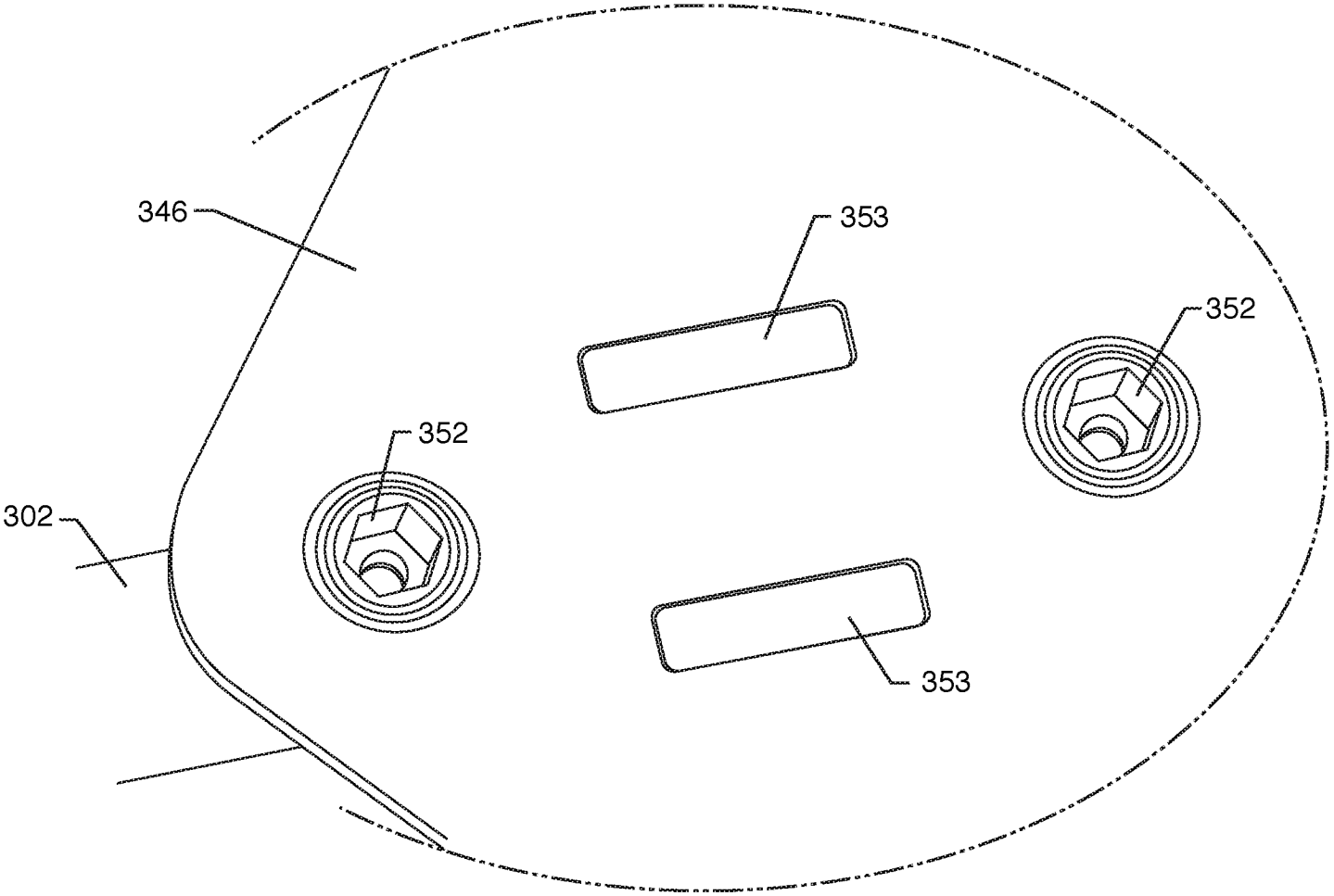
FIG. 46 is an enlarged view taken from section 46-46 of FIG. 45.

The nut 351 can be captured by a nut recess 352. This is best seen in FIG. 46 where the top of the horizontal stabilizer 346 has two nut recesses 352 to capture a nut 351 therein. As can be seen, the shape of the nut recess 352 prevents rotation of the nut 351 itself. Also shown herein are two apertures 353 which are configured to engage into a wall stand (not shown) that is mounted to a wall. In this way the toy 300 can be placed vertically along a wall which allows easy storage when not in use.

To help keep the horizontal stabilizer 346 biased against the support 302, a notch 349 is formed such that a rubber band may be placed within and secured around the support 302. Other biasing mechanisms may be used such as springs or magnets, however a rubber band is cheap, easily available and easy to secure.

Figure 47:
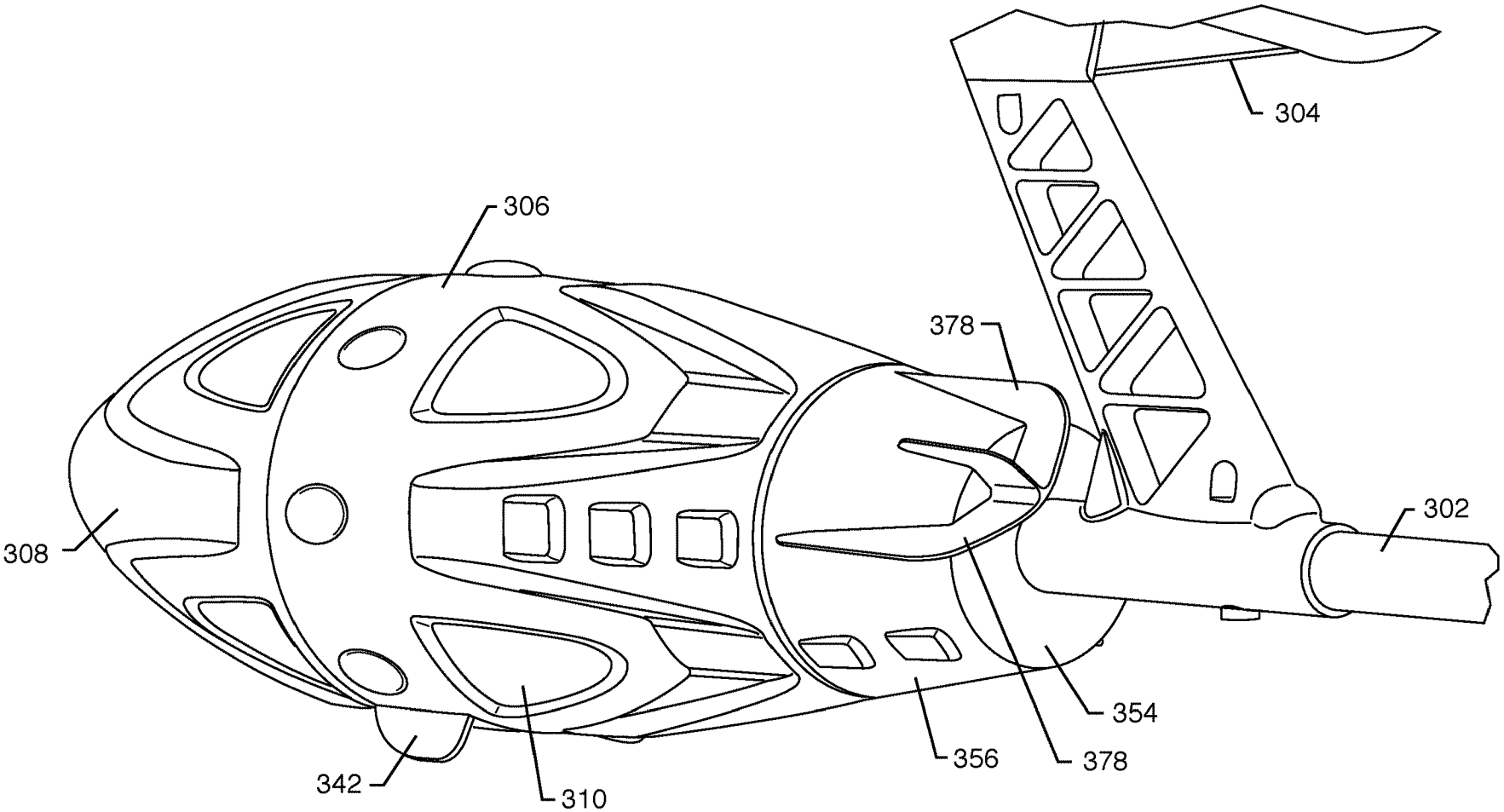
FIG. 47 is an enlarged perspective view of the rotatable push surface.
Figure 48:
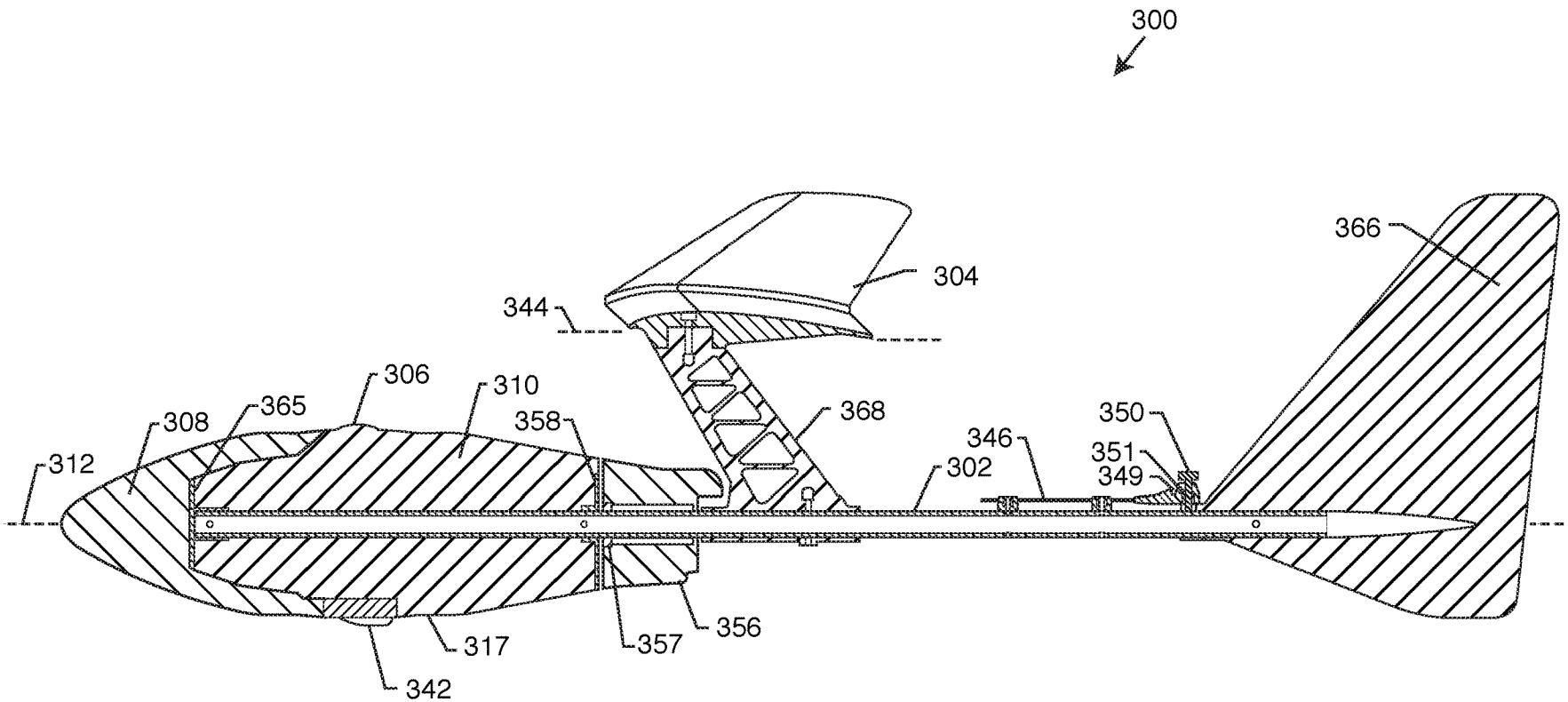
FIG. 48 is a sectional side view of the exemplary embodiment of FIG. 34.

As best seen in FIG. 47, the back end 313 of the body 306 or back section 310 of the body 306 includes a push surface 354. The push surface 354 is generally perpendicular to the longitudinal axis 312. The push surface 354 is pivotably or rotatably coupled to the body 306 or to the support 304, where the push surface 354 can pivot or rotate about an axis generally parallel to the longitudinal axis 312 while the push surface 354 is also fixed in translation in relation to the longitudinal axis 312.

A user places his first finger and middle finger upon the push surface 354. The fingers will split the support 302. The thumb and other fingers will grip the rest of the body 306. As seen in FIG. 47, the push surface 354 is already rotated about the longitudinal axis. It was discovered through trial and error testing that when throwing the toy 300, many users will impart a spin to the toy 300. It is inherent in the throwing motion of most people to spin a ball when thrown. However, imparting a spin into this particular embodiment shown in FIGS. 39-50 is unwanted. Therefore as a person throws the toy 300, the two fingers upon the push surface 354 impart the energy forward to create flight. The rotatable push surface 354 cancels any spin that may or may not be imparted to the toy 300 when thrown. This is because the push surface 354 is part of a spinner 356.

The spinner 356 may also capture a bearing 357 to help create a smooth rotation or pivot about its axis of rotation. It is also possible to remove the bearing 357 so that the spinner 356 still rotates about the support 302. It is also possible to use two bearings 357 on either side of the spinner 356. This particular embodiment only uses one bearing 357.

The bearing 357 also presses against a rear brace 358. The rear brace 358 is secured to the support 302. As shown herein the rear brace 358 slides upon the support 302 and then is fixed to the support 302. The rear brace 358 captures the rear section 310 of the body 306 during assembly of the toy 300.

Figure 49:
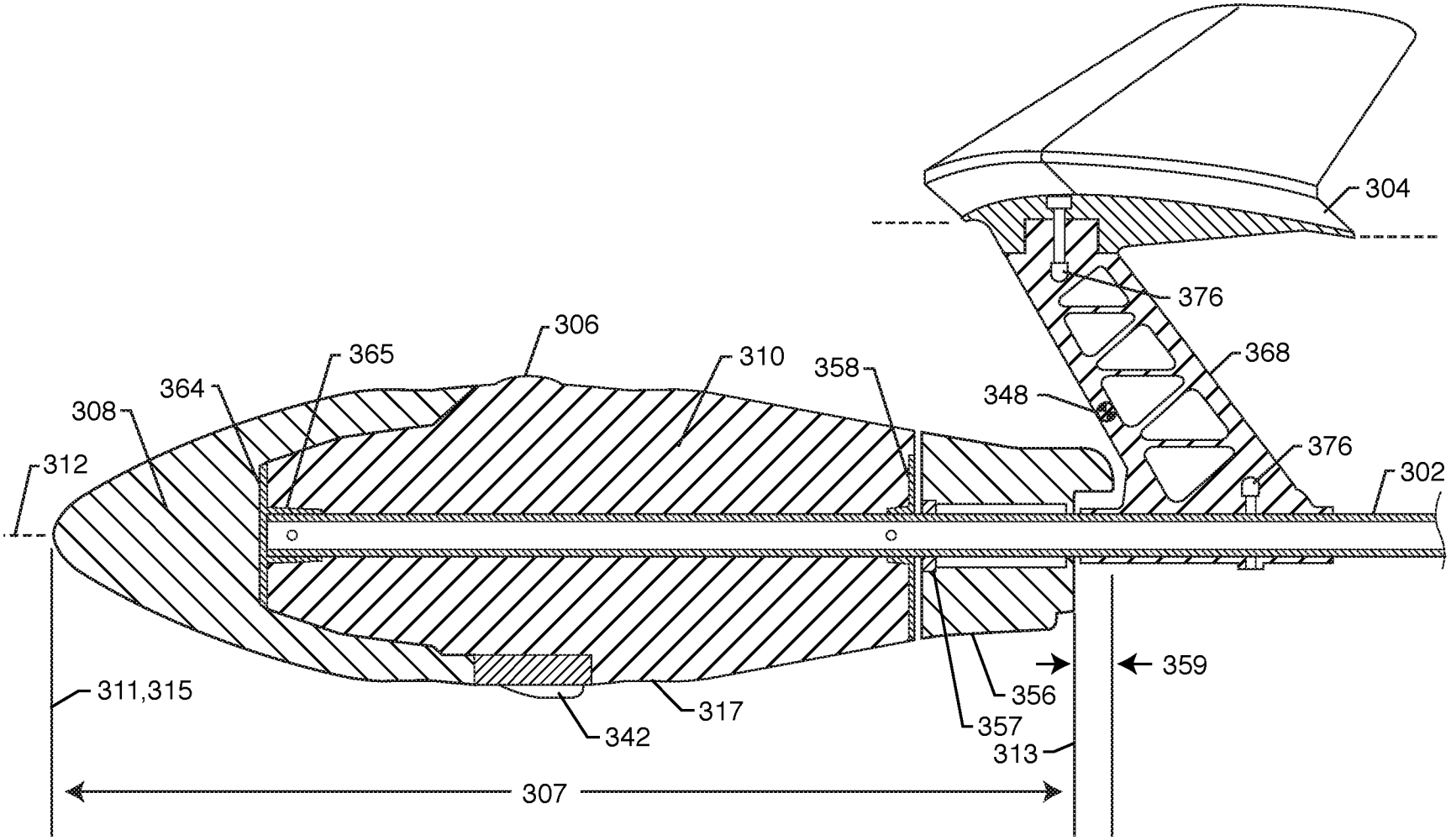
FIG. 49 is an enlarged sectional side view of the front structure of FIG. 48.

As best shown in FIG. 49, a center of gravity 348 is shown. It is optimal if the distance along the longitudinal axis 312 between the push surface 354 and the center of gravity 348 has a distance 359 which is zero. However, it is still acceptable if the distance 359 is 0.5 inches or even 1.0 inch. When the distance 359 is well above 1.0, throwing the toy 300 becomes difficult.

The push surface 354 should also have enough surface area for at least one finger to push thereon. Therefore, the push surface 354 should have an area of at least 1.0 square inch. Preferably the push surface 354 should have an area of at least 2.0 square inches such that two fingers may be used to propel the toy 300.

Wings (airfoils) are defined as having a leading edge and a trailing edge. The straight distance between the two edges is the cord length. A wing has a curve it follows when moving from the leading edge to the trailing edge. This curve is called the camber line/curve or just camber. The thickness of the wing is centered about the camber curve. Most wings have a substantial thickness to them. RC aircraft can use a foamed wing structure to provide rigidity since the thickness is quite substantial. Other RC aircraft use balsa-wood, composites, or carbon fiber with laminates stretched overtop to create the thickness of the wings. No matter the wing design for various RC aircraft, none have been designed to withstand the repeated abuse that a football would encounter. The wings needed to be durable enough such that they could take repeated crashes without damage and return to their preformed shape instantaneously for the next throw. The solution then was to use a thin section, injection molded, non-foamed, polymer wing and non-movably mount it to either the body 306 or the support 302. Therefore, the lift-generating wing 304 comprises a generally convex upper surface 360 opposite a generally concave lower surface 362, where the upper and lower surfaces define a wing thickness. The wing thickness is less than 0.10 of an inch. In this particular embodiment, the thickness is about 0.07 to 0.09 inches at the base and reduces to about 0.5 to 0.03 inches at the wing tips. The wing 306 is flexible enough that it deforms upon impact yet retains its shape in flight. The wing 306 is also relatively cheap to produce as it is a single material (non-composite) type of non-foamed polymer such as ABS. Accordingly, the wing 306 is an injection molded, non-foamed, polymer wing.

As best seen in FIGS. 39 and 49, an impact transfer surface 364 is attached directly to the support 302. The impact transfer surface 364 is shown as a surface of an impact transfer part 365. The impact transfer surface 364 is disposed within the body 306 and disposed between the front end 311 of the body 306 and the support 302. The impact transfer surface 364 abuts an inside of the front section 308. Then the impact transfer part 365 is attached directly to the support 302 with either a fastener, adhesive or the like. When the toy 300 impacts an object, such as the ground or a tree, the impact force is transmitted from the front section 308 directly into the impact transfer surface 364 and impact transfer part 365 and then the impact force is transmitted directly to the support 302. Impact forces are then not transmitted to the rear section 310 of the body 306 or to the spinner 356.

Furthermore, the horizontal stabilizer 346 is disposed behind the lift-generating wing 304, where the horizontal stabilizer 346 is attached directly to the support 302. This allows the energy stored in the horizontal stabilizer 346 to be transferred directly along the support 302. Furthermore, a vertical stabilizer 366 is disposed behind the lift-generating wing 304, where the vertical stabilizer 366 is attached directly to the support 302. Again, this allows the energy stored in the vertical stabilizer 366 to be transferred directly along the support 302. As shown herein, the horizontal stabilizer 346 and the vertical stabilizer 366 both comprise an injection molded, non-foamed, polymer stabilizer.

The impact transfer surface 364 is generally perpendicular to the longitudinal axis 312. The impact transfer surface 364 optimally has an impact area of at least 2.5 square inches, where the impact area faces the front end 311 of the body 306. However, one could shape the impact transfer surface 364 in a multitude of shapes including spheroidal, football shaped, slanted, angled or any other shape that still sufficiently transfers impact energy from the front section 308 to the support 302.

Figure 41:
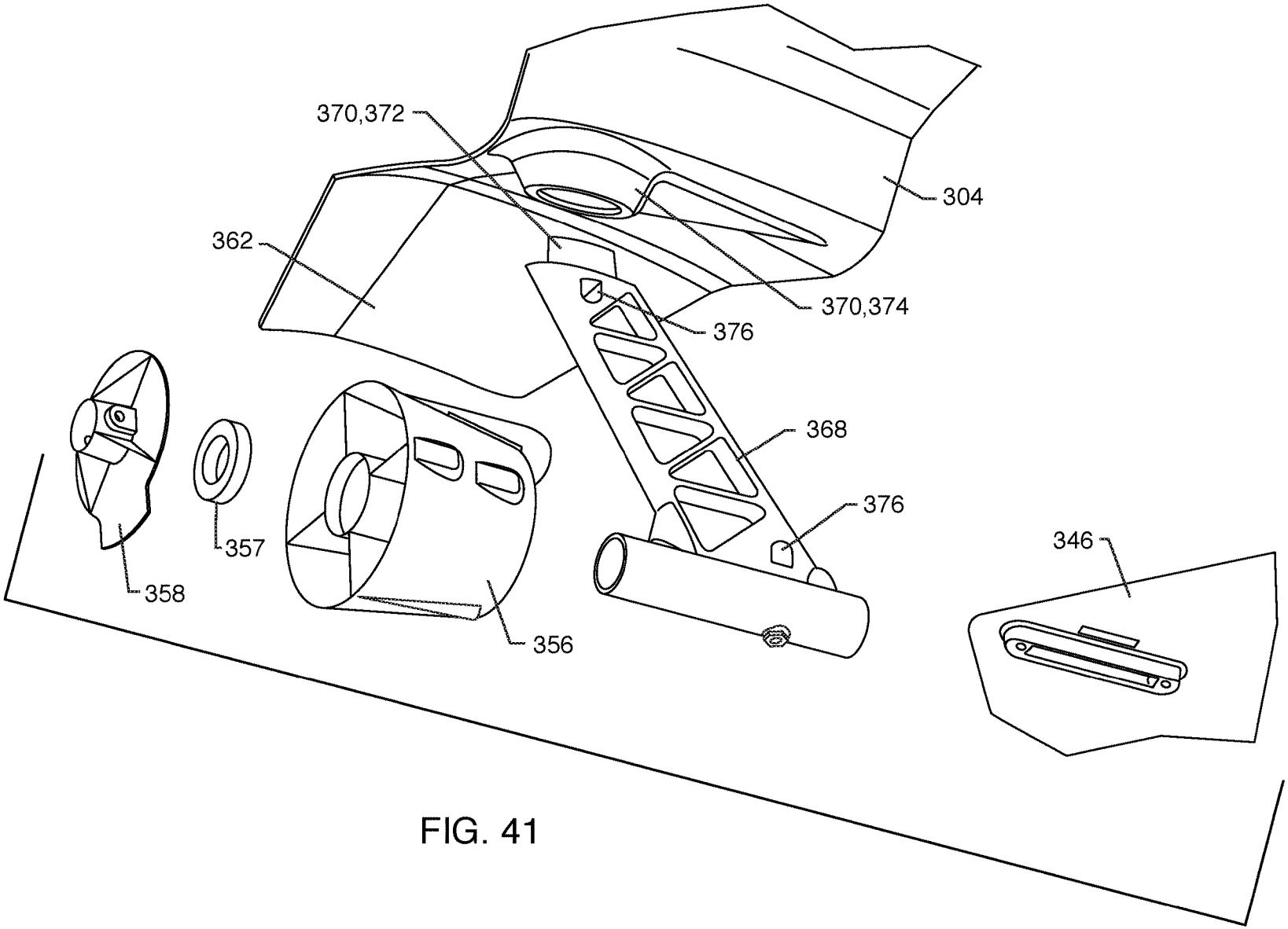
FIG. 41 is an enlarged exploded perspective view of the exemplary embodiment of FIG. 34.
Figure 42:
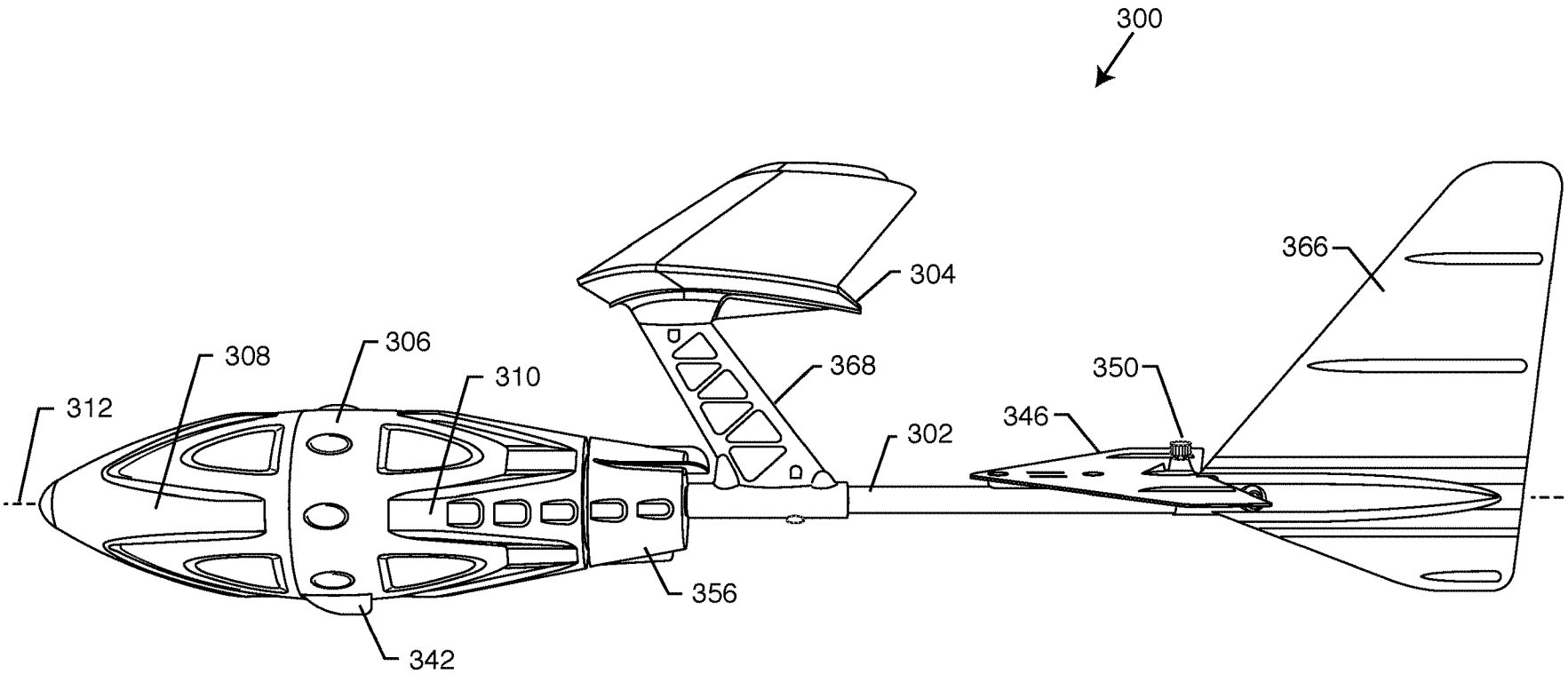
FIG. 42 is a side perspective view of the exemplary embodiment of FIG. 34.
Figure 43:
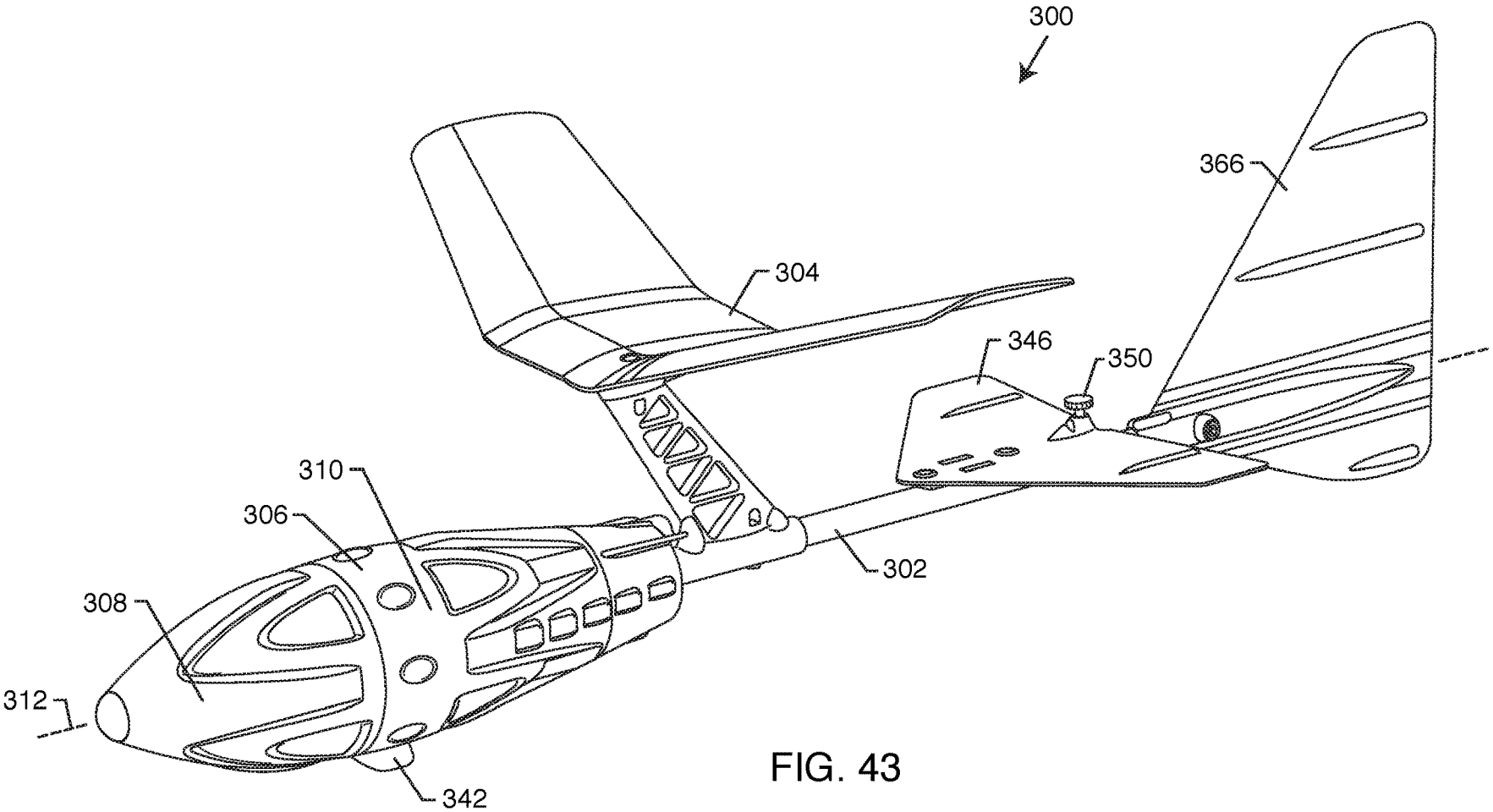
FIG. 43 is a front and side perspective view of the exemplary embodiment of FIG. 34.
Figure 44:
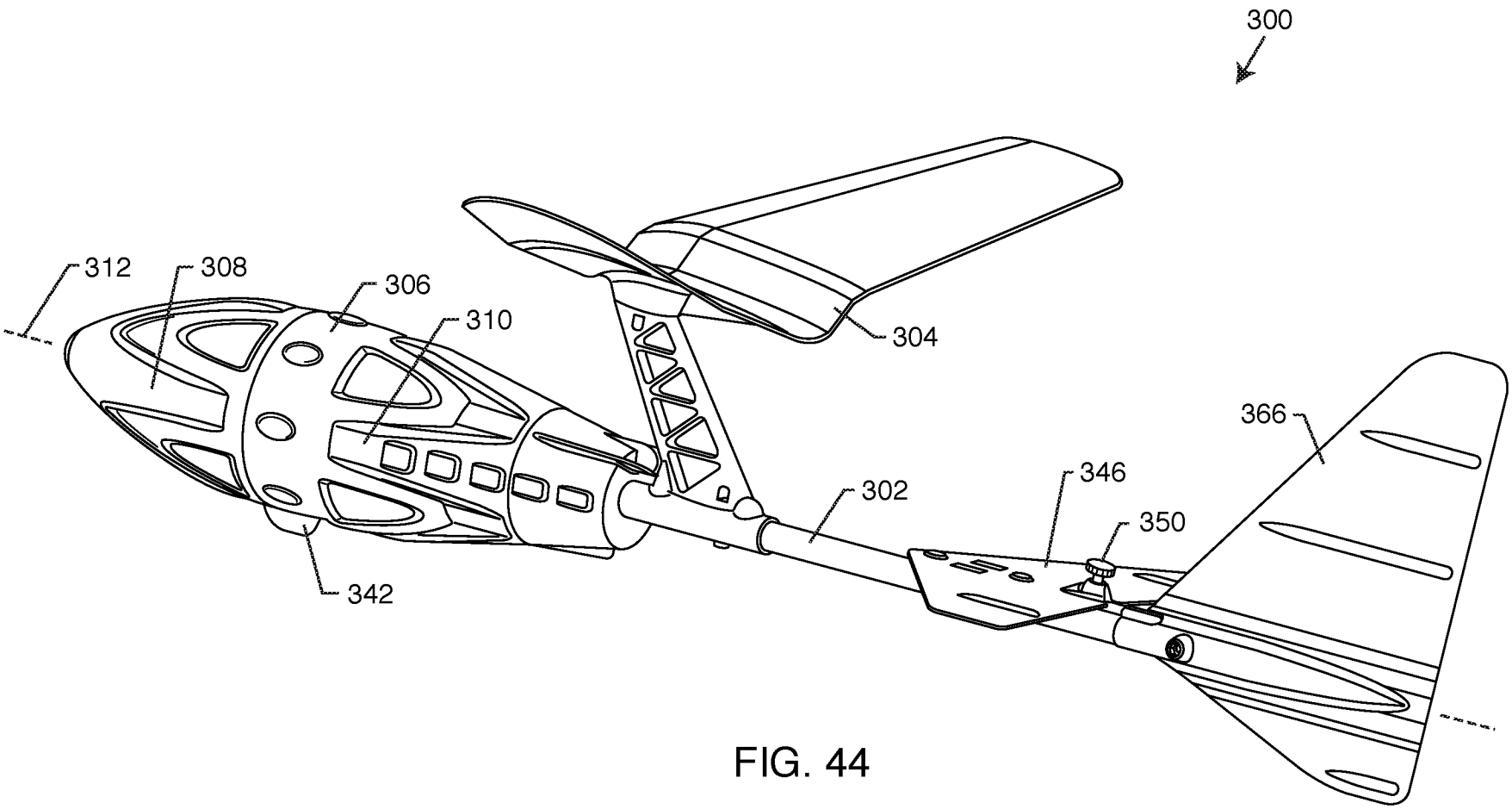
FIG. 44 is a rear and side perspective view of the exemplary embodiment of FIG. 34.
Figure 45:
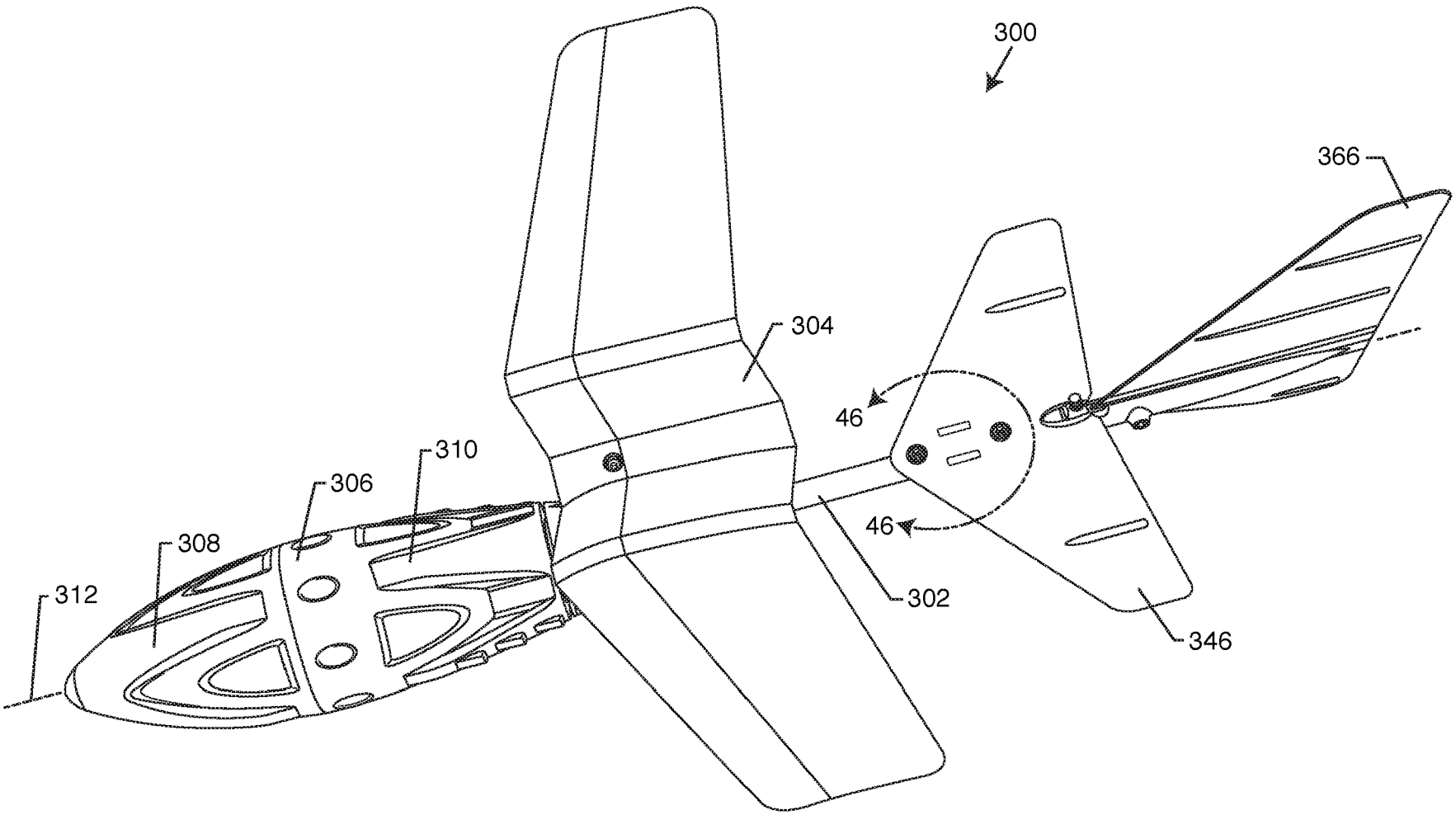
FIG. 45 is a top perspective view of the exemplary embodiment of FIG. 34.

As is best seen in FIG. 41, the wing 304 is attached to the support 302 through a wing bracket 368. The wing bracket 368 is shown herein to slide overtop the support 302. A screw and fastener can then be used to permanently fix the bracket 368 relative to the support 302. The wing bracket 368 should be made from a high-impact resistance material such as polycarbonate. This is because a lot of force is transmitted through the bracket 368 during a crash and polycarbonate has a high impact resistance.

The wing bracket 368 is attached to the support 302 behind the back end of the body 313. The wing bracket 368 then extends upwards to attach the wing 304. As can be seen, the wing 304 and body 306 are separately disposed. This means that an outside contiguous envelope of the body 306 does not coincide with any portion of an outside contiguous envelope of the lift-generating wing 304. This design assists the user to catch the toy 300 because the whole body 306 may be grabbed at any angle without having to worry about a portion of the toy 300 getting in the way. This is also why the wings 304 are disposed behind the center 319 of the body 306 and above the longitudinal axis 312.

The lift-generating wing 304 is non-movably attached to the support by a non-pivotable and non-rotatable male-to-female connection 370, where a male portion 372 of the male-to-female connection 370 is configured to non-pivotably and non-rotatably engage into a female portion 374 of the male-to-female connection 370, where the lift-generating wing 304 comprises one of either the male portion or the female portion and the support 302 or wing bracket 368 comprises the other of the male portion or female portion. As shown herein, the bracket 368 has the male portion 372 and the wing 304 includes the female portion 374. Here a shape of an oval is used. An oval placed inside an oval is not capable of rotation or pivoting. The wing 304 can then be held attached to the bracket 368 with a fastener and a nut. In this way, impact forces are transmitted from the structures of the male-to-female connection 370 and are not transmitted directly to the fasteners. Using fasteners to absorb the impact loads would lead to premature failure and parts breaking too quickly. The bracket 368 has two recesses 376 that are sized to capture a nut such that a separate tool is not needed to hold the nut during assembly. This is done to simplify the assembly process and reduce the number of tools needed for assembly.

As best seen in FIG. 47, the spinner 356 has finger extensions 378 extending in a direction aligned with the longitudinal axis. When a user places their fingers on the finger push surface 354 it is critical that the fingers don't extend over the edge of the spinner 356. Therefore, the finger extensions 378 block the fingers from being placed above the correct location or sliding above the correct location.

Although several embodiments of the throwing and catching flying toy 300 have been described in detail for purposes of illustration, various modifications may be made to each without departing from the scope and spirit of the invention. Accordingly, the invention is not to be limited, except as by the appended claims.

Bowless Arrow

A typical bow projects arrows by its elasticity. The bow is essentially a form of spring. As the bow is drawn, energy is stored in the limbs of the bow and transformed into rapid motion when the string is released, with the string transferring this force to the arrow. The basic elements of a bow are a pair of curved elastic limbs, traditionally made from wood, connected by a string. By pulling the string backwards the archer exerts compressive force on the string-facing section, or belly, of the limbs as well as placing the outer section, or back, under tension. While the string is held, this stores the energy later released in putting the arrow to flight. When the arrow is shot, the shooter still has the bow remaining in his hands. An arrow cannot be easily projected without the use of a bow.

As shown in FIGS. 21-27, a bowless arrow 400 is now disclosed comprising a shaft 402 defined as including a forward end 404 opposite a rear end 406. A slider 408 is translatably coupled along the shaft 402. The slider 408 includes a front-hand support 410 extending substantially perpendicular to the shaft 402. The slider 408 can be formed to travel on the outside of the shaft 402 or partially on the inside of the shaft 402.

A rear-hand grip 412 is located substantially about the rear end 406 of the shaft 402. A resiliently stretchable bias 414 is attached relative to the slider 408 and either the rear end 406 of the shaft 402 or the rear-hand grip 412. The bias 414 can be a spring, a stretchable material such as a rubber band or any other suitable biasing means. As shown best in FIG. 24, the bias 414 is a tube of rubber or the like. The tube 414 is then pressed onto a barbed end 416 of the slider 408 and a barbed end 418 of the rear-hand grip 412. A cushion 420 can be placed about the bias 414 such that it dissipates the energy from a launch without damaging the internal components. A slider cushion 422 can be formed overtop the slider 408 for safety as well.

In the embodiments shown herein, the bias 414 and a portion of the slider 408 and rear-hand grip 412 are disposed within the shaft 402. This provides for a simplistic appearance. The shaft 402 has a slot 430 that allows the slider 408 to be partially within the shaft 402 while allowing the front-hand support 410 to remain outside. It is to be understood by one skilled in the art that there are a multitude of methods and ways a slider 408 can be translatably coupled along a shaft 402, as this disclosure is not intended to limit it to the precise forms described and shown herein.

An exemplary embodiment may include an arrow tip 424 located at the forward end 404 of the shaft 402. The arrow tip 424 may comprise an energy dissipating material, such as foam or the like. Also, a plurality of tail fins 426 may be substantially evenly located about the rear end 406 of the shaft 402.

Figure 25:
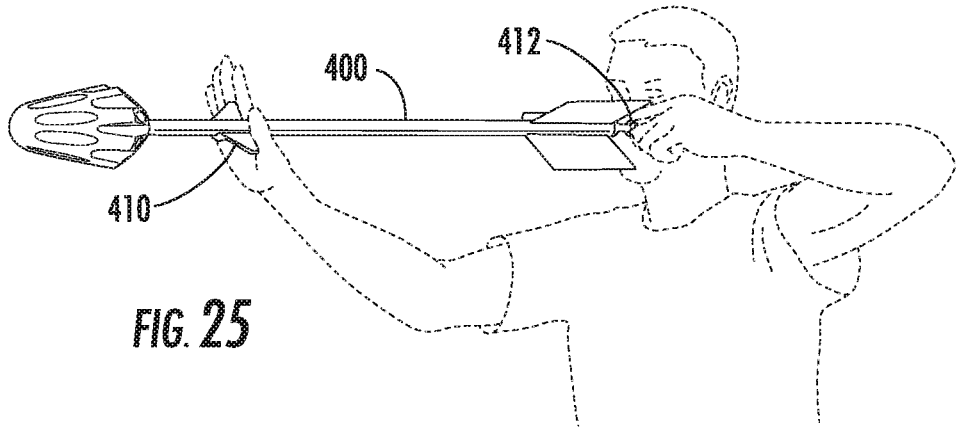
FIG. 25 is a perspective view of the exemplary bowless arrow of FIG. 21 being cocked for launch.
Figure 26:
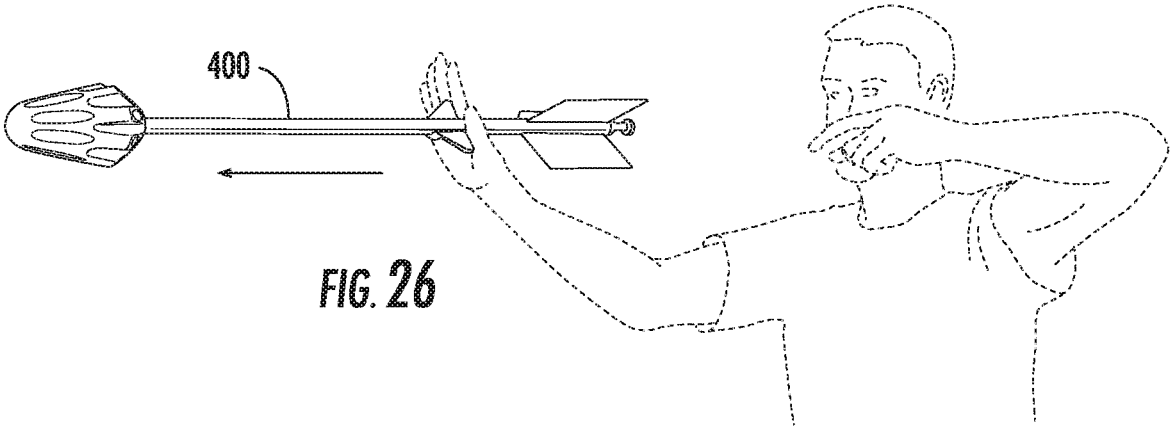
FIG. 26 is a perspective view of the exemplary bowless arrow of FIG. 21 being launched.
Figure 27:
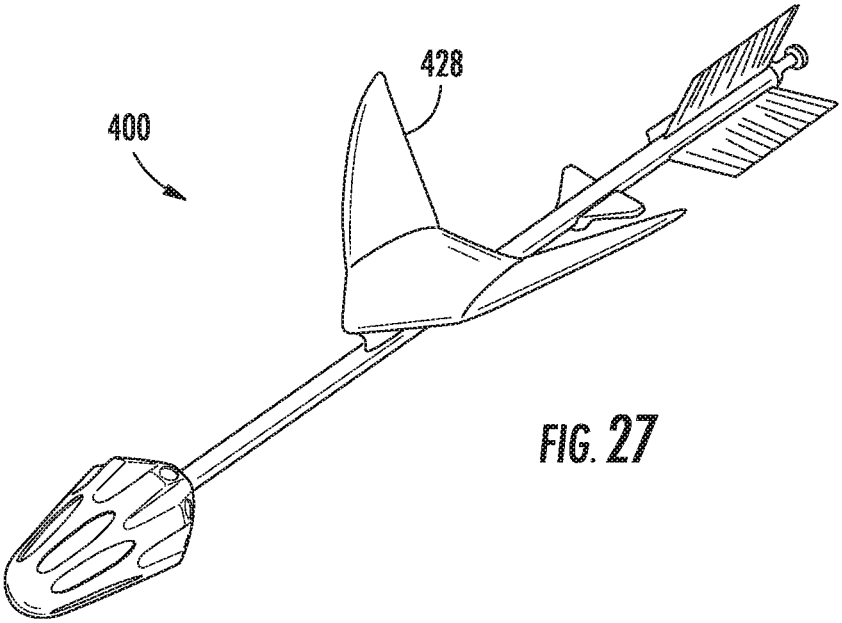
FIG. 27 is a front perspective view of another exemplary bowless arrow embodying one of the present inventions, now with wings.
Figure 28:
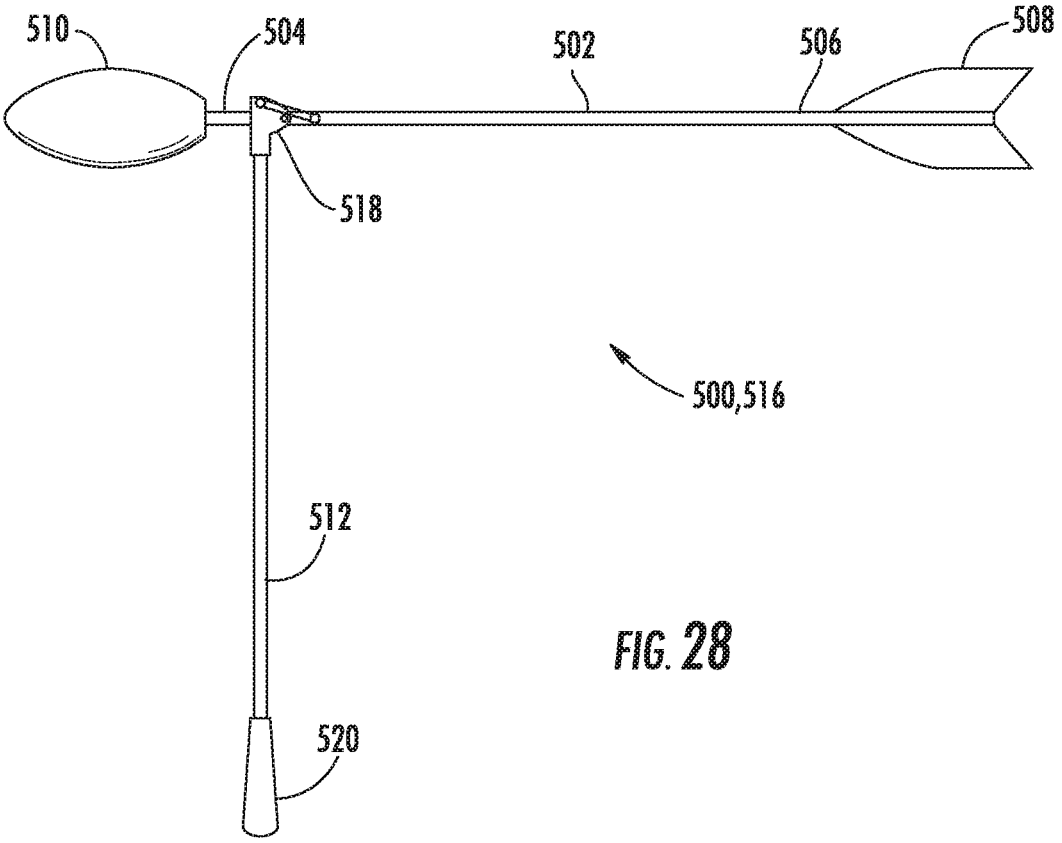
FIG. 28 is a side view of an exemplary distance-enhanced throwing toy embodying one of the present inventions, with handle extended for throwing.
Figure 29:
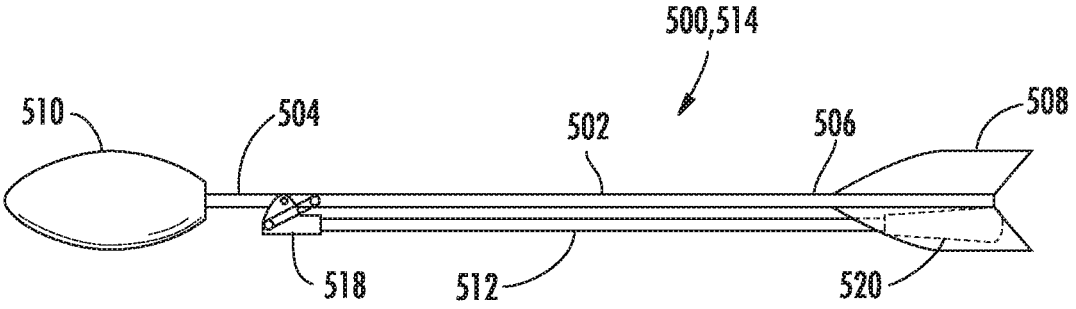
FIG. 29 is a side view of the exemplary embodiment of FIG. 28, with handle retracted for flight.

FIG. 25 shows how the bowless arrow 400 can be drawn. The rear hand of the shooter grasps the rear-hand grip 412 while the front hand of the user is placed upon the front-hand support 410. The bowless arrow 400 is then drawn backwards causing the internal bias 414 to stretch and store energy. As is shown in FIG. 26, when the shooter releases the rear-hand grip 412, the bowless arrow 400 is propelled forward.

Another exemplary embodiment may include a lift-generating wing 428 attached relative to the shaft 402. The lift-generating wing 428 may be similar in design to the methods discussed earlier regarding the flying football, as all the teachings are incorporated herein without repetition. This includes the pivotably adjustable features, the dihedral features, the positioning above the center of gravity, and the breakaway features. The bowless arrow 400 with wing 428 is commonly referred to as the Arrow Plane.

In another exemplary embodiment, the arrow tip 424 may comprise a substantially oblate spheroidal or football shape. This means that the bowless arrow 400 can be used to play catch. The shooter could launch the bowless arrow 400 at a receiver, and the receiver could catch the football arrow tip 424. Then the receiver becomes the shooter launching the bowless arrow 400 back.

Although several embodiments of the bowless arrow 400 have been described in detail for purposes of illustration, various modifications may be made to each without departing from the scope and spirit of the invention. Accordingly, the invention is not to be limited, except as by the appended claims.

Catapult Javelin

As shown in FIGS. 28-31, a distance-enhanced throwing toy 500 is disclosed comprising an elongated shaft 502 defined as having a forward end 504 opposite a rear end 506. A tail fin 508 is located about the rear end 506 of the shaft 502. Alternatively, the tail fin 508 may comprise a plurality of tail fins 508 substantially evenly located about the rear end 506 of the shaft 502. A tip 510 is located relative to the forward end 504 of the shaft 502. The tip 510 may comprise a multitude of designs previously discussed herein, such as a football shape, an arrow head shape or other various designs. The tip 510 may be comprised of an impact absorbing foam or energy dissipating material to reduce the chance of injuries or for catching the toy 500 once thrown.

An elongated handle 512 is pivotably attached substantially near the forward end 504 of the shaft 502. The handle 512 is temporarily and securedly biased and pivotable between a first position 514 and a second position 516. The handle 512 and shaft 502 are generally parallel in the first position 514. The handle 512 and shaft 502 are generally perpendicular in the second position 516. The elongated handle 512 can also have a grip 520 disposed at its distal end.

Figure 30:
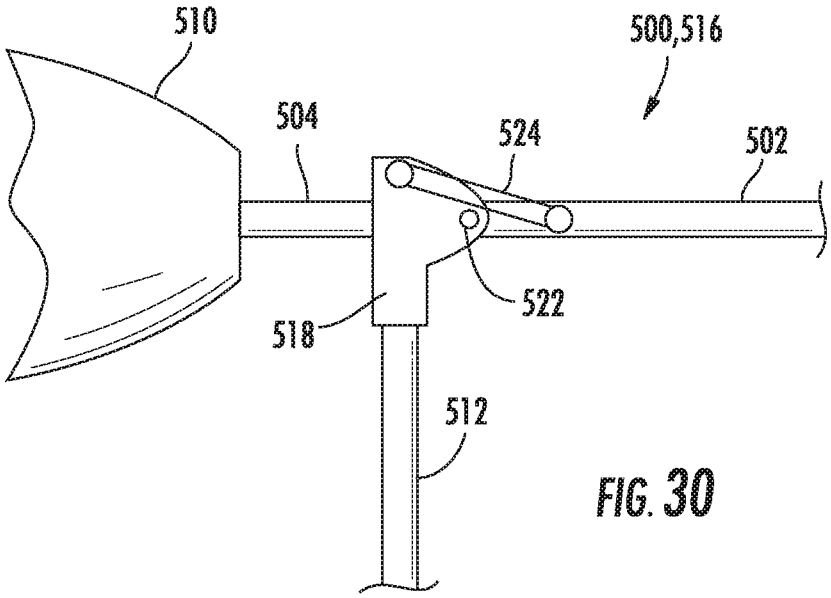
FIG. 30 is an enlarged view of the bias mechanism of the embodiment of FIG. 28, with handle extended for throwing.
Figure 31:
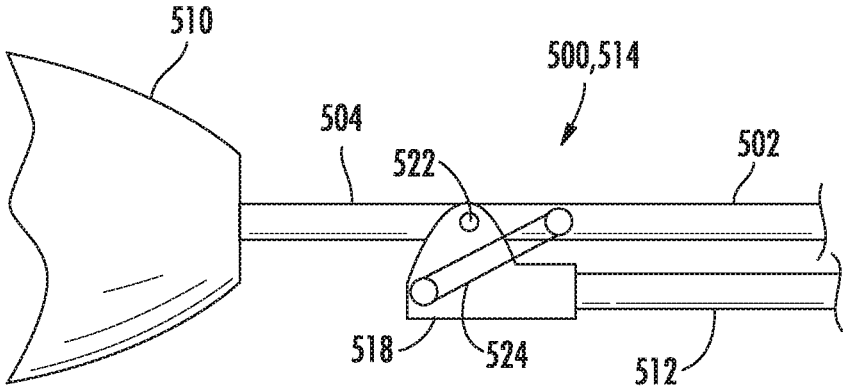
FIG. 31 is an enlarged view of the bias mechanism of the embodiment of FIG. 29, with handle retracted for flight.

As shown better in FIGS. 30-31, a bias mechanism 518 may be attached relative to the shaft 502 and handle 512. The bias mechanism 518 temporarily and securedly biases the handle 512 in the first position 514 and second position 516. The bias mechanism 518 acts in a similar manner to a cam. For instance the handle 512 is pivotably attached to the shaft 502 at the pivot 522. An elastomeric material 524 or spring is properly positioned to hold the handle 512 in the two different positions. As shown in FIG. 30, the handle 512 is in the second position 516. The elastomeric material 524 can be a rubber band or the like. The rubber band 524 is pulling the handle 512 to further open, thereby biasing it to remain in the second position 616. FIG. 31 shows how the same rubber band 524 can then pull the handle 512 to remain in the first position 514 for flight.

When the toy 500 is thrown, the handle 512 is in the second position 516. Upon release, a slight tug of the handle 512 moves it away from the second position 512 and then the angles of the rubber band 524 bias the handle 512 to the first position 514. The handle 512 will then close fully as the toy 500 is in the air. As can be seen by one skilled in the art, there are a multitude of ways and methods for biasing the handle 512 between the two positions 514 and 516 as this disclosure is not intended to limit it to the precise forms shown and described herein.

The toy 500 is capable of being thrown substantially further than a typical throwing toy due to the increased length of the throwing arm, i.e. the handle 512. Our initial prototype was able to easily achieve a distance thrown of over 300 feet. This distance was almost two to three times the distance of a normally thrown toy, such as a football or a baseball. The distance thrown is increased because the release velocity is substantially faster than a person's hand can travel.

After a short bit of practice, it was possible to aim the toy 500 relatively accurately at an intended receiver. The best throwing technique was to throw the toy 500 side arm, as opposed to throwing it overhead. Throwing the toy 500 side arm allowed for a wide range of movement and allowed the hips to rotate and help launch the toy 500.

Although several embodiments of the bowless distance-enhanced throwing toy 500 have been described in detail for purposes of illustration, various modifications may be made to each without departing from the scope and spirit of the invention. Accordingly, the invention is not to be limited, except as by the appended claims.

Cruise Missile

Figure 32:
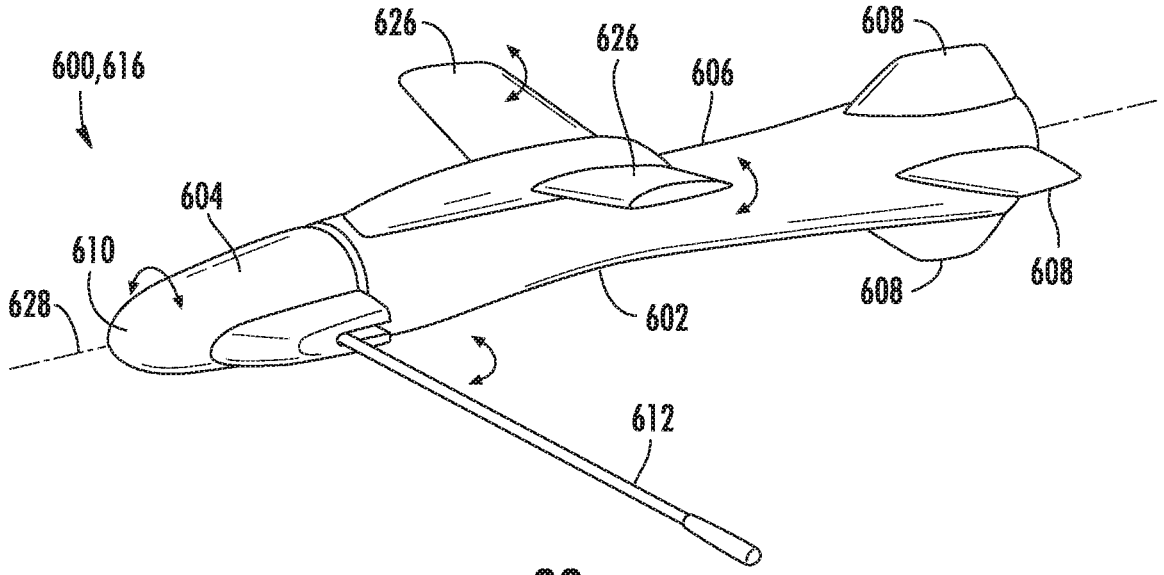
FIG. 32 is a front perspective view of an exemplary throwing and flying toy embodying one of the present inventions, with handle extended for throwing.
Figure 33:
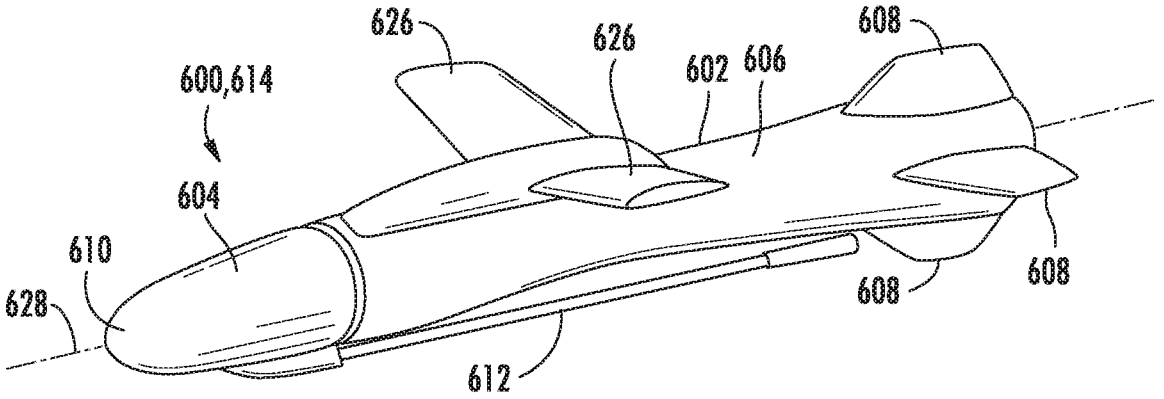
FIG. 33 is a front perspective view of the exemplary embodiment of FIG. 32, with handle retracted for flight.
Figure 34:
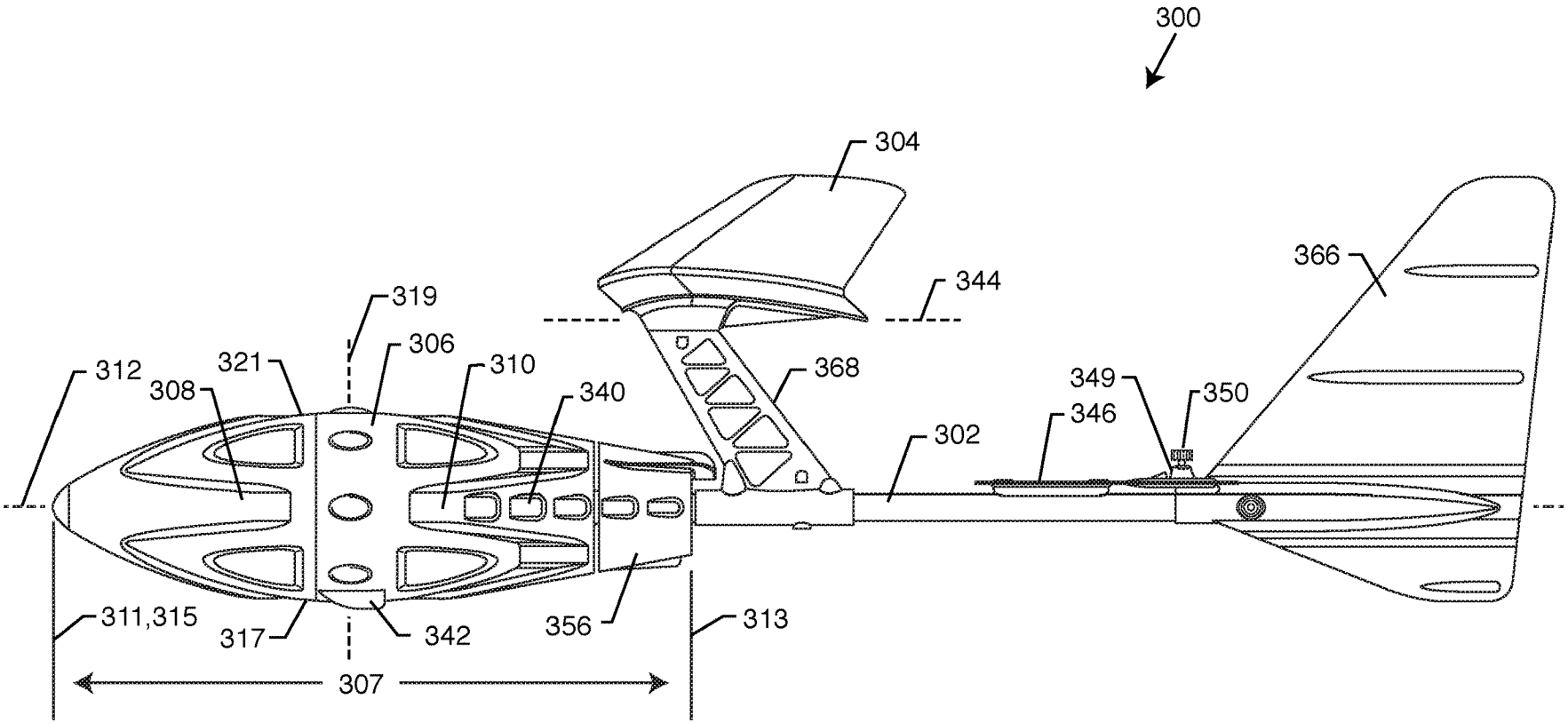
FIG. 34 is a side view of another exemplary throwing or catching flying toy embodying one of the present inventions.
Figure 35:
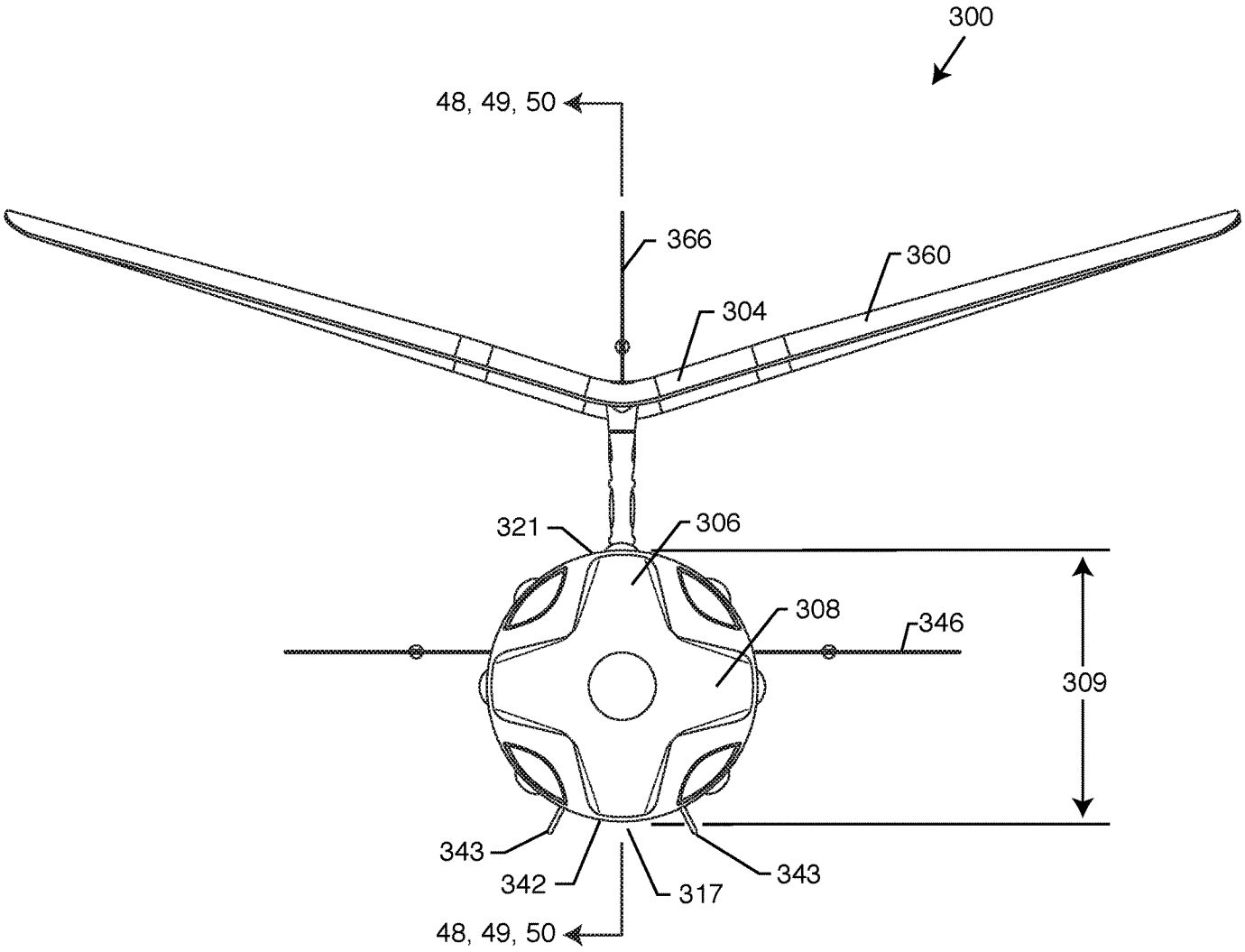
FIG. 35 is a front view of the exemplary embodiment of FIG. 34.
Figure 36:
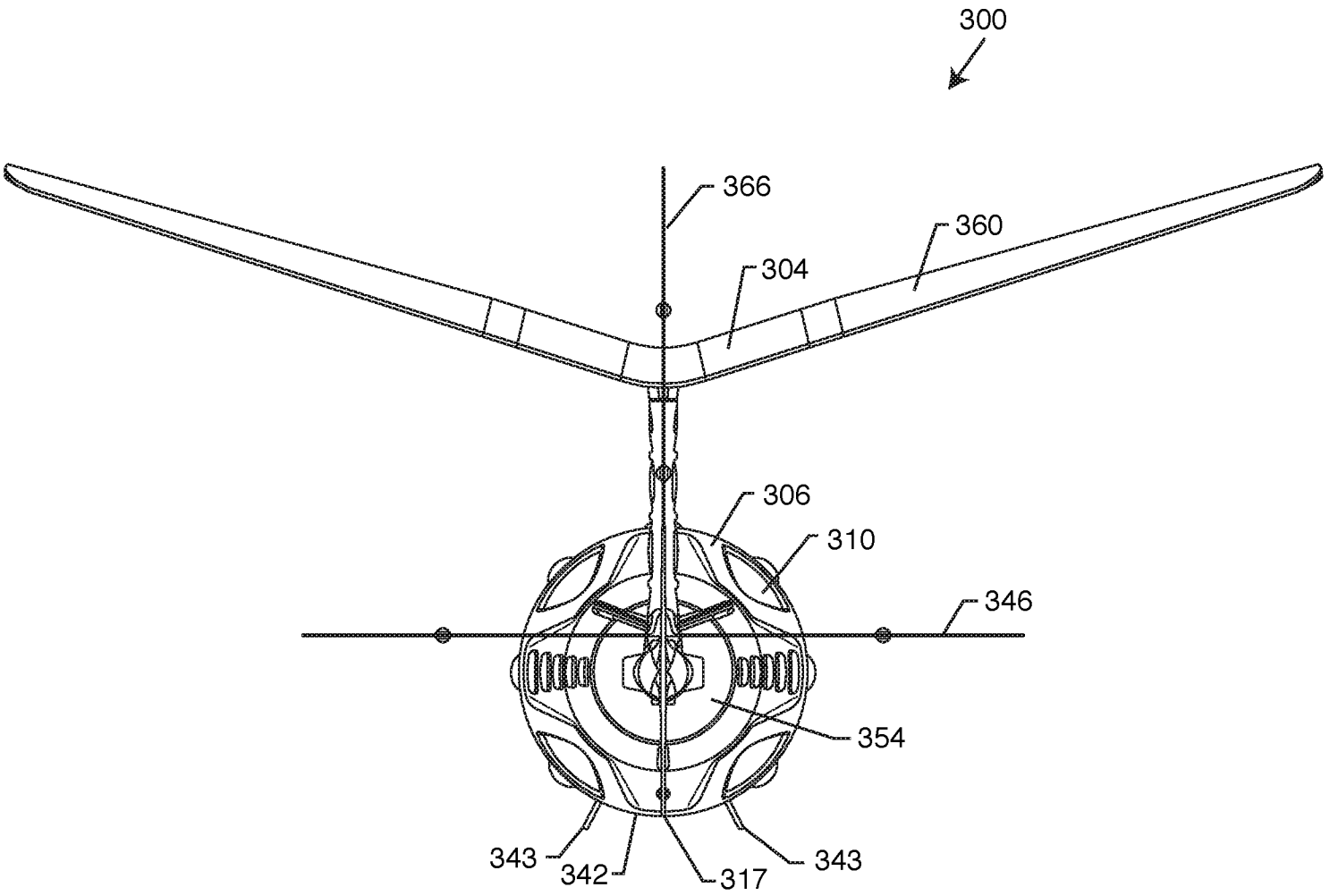
FIG. 36 is a back view of the exemplary embodiment of FIG. 34.
Figure 37:
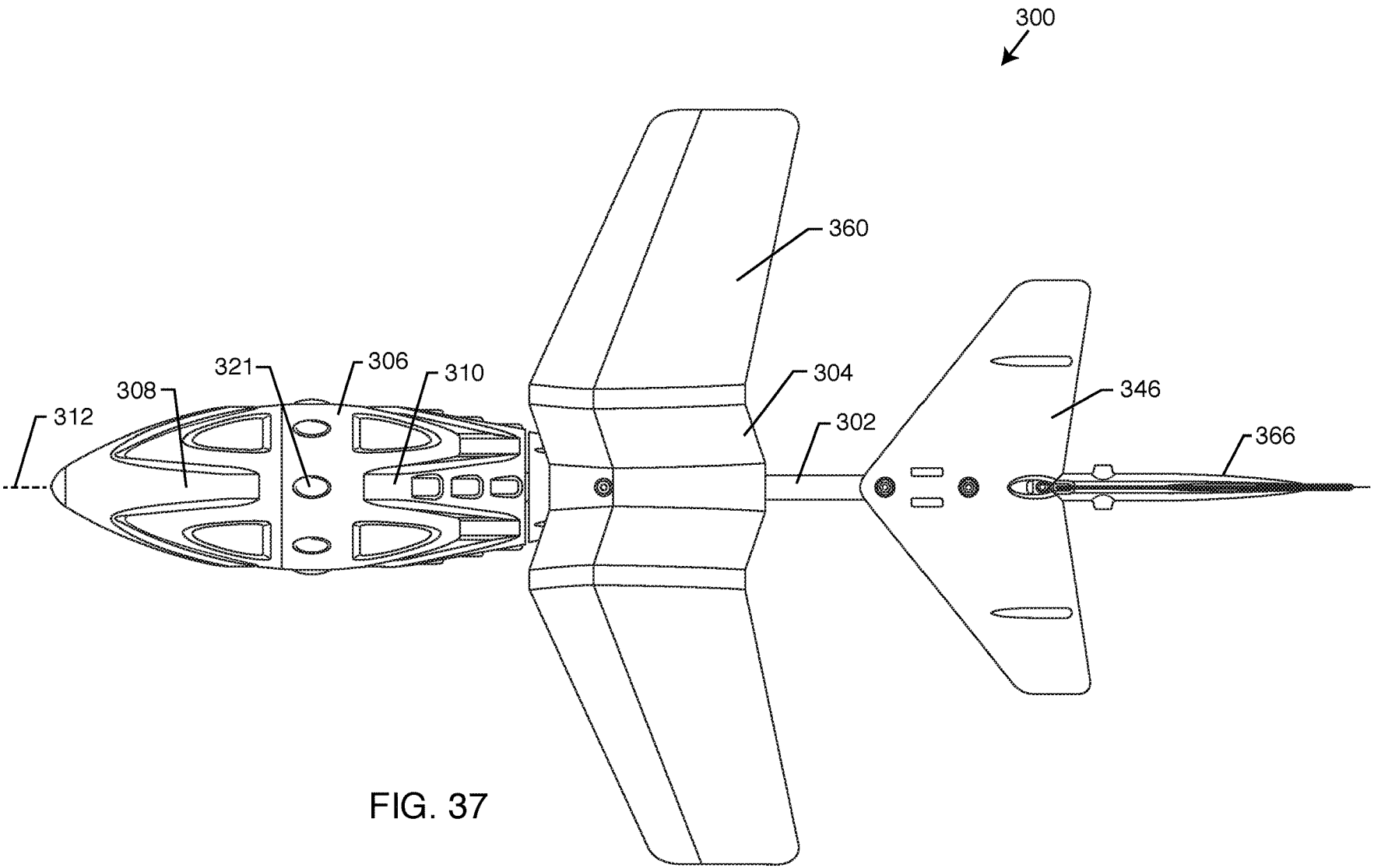
FIG. 37 is a top view of the exemplary embodiment of FIG. 34.
Figure 38:
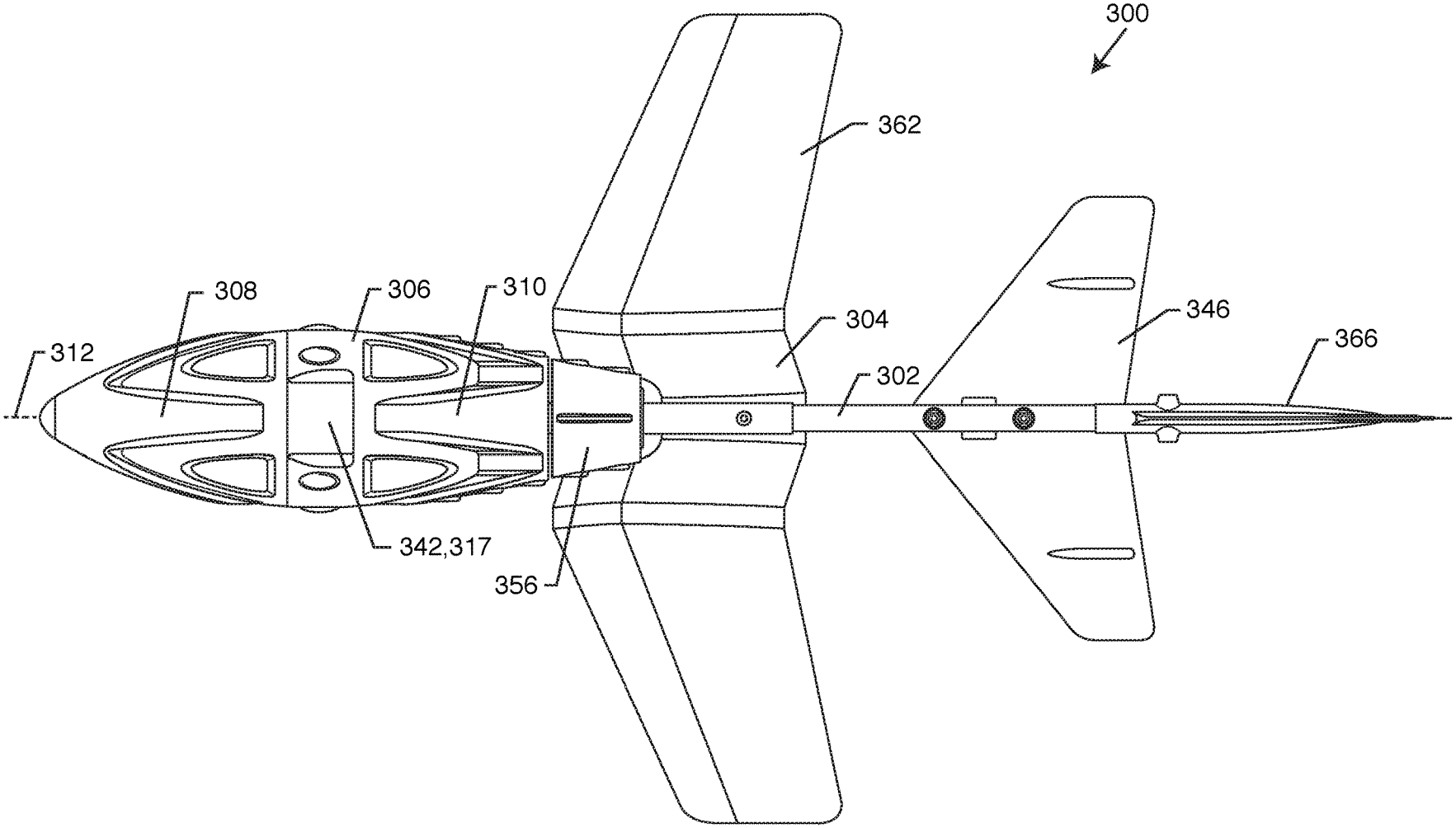
FIG. 38 is a bottom view of the exemplary embodiment of FIG. 34.

As shown in FIGS. 32-33, a throwing and flying toy 600 is disclosed which resembles a cruise missile when appropriately styled. The toy 600 incorporates the teachings of the Catapult Javelin and Flying Football herein without repetition. The toy 600 comprises a generally elongated body 602. The body 602 includes a front portion 604 rotatably attached to a rear portion 606. The front portion 604 includes the tip 610, which tip 610 may be formed of an impact dissipating material for safety. In another exemplary embodiment the tip 610 can be styled like an arrow head or football.

A tail fin 608 is located about the rear portion 606 of the body 602. The tail fin 608 may also comprise a plurality of tail fins 608 substantially evenly disposed about the rear portion 606. The plurality of tails fins 608 may be fixedly attached to the rear portion 606 or rotatably attached to the rear portion 606.

A lift-generating wing 626 is attached relative to the rear portion 606 of the body 602. The wing 626 may be similar in design to the methods discussed earlier regarding the Flying Football, as all the teachings are incorporated herein without repetition. This includes the pivotably adjustable features, the dihedral features, the positioning above the center of gravity, and the breakaway features.

An elongated handle 612 is pivotably attached relative to the front portion 604 of the body 602. The handle 612 is temporarily and securedly biased and pivotable between a first position 614 and a second position 616. The handle 612 and body 602 are generally parallel in the first position 614 and the handle 612 and body 602 are generally perpendicular in the second position 616. This is similar in design to the methods discussed earlier regarding the Catapult Javelin, as all the teaching are incorporated herein without repetition.

A bias mechanism similar to 518 may be attached relative to the front portion 604 and handle 612. The bias mechanism 518 temporarily and securedly biases the handle 612 in the first position 614 and second position 616. The bias mechanism 518 is similar in design to the mechanism of the Catapult Javelin. For instance, the handle 612 is pivotably attached to the front portion 604 at a pivot similar to the pivot 522. An elastomeric material 524 or spring is properly positioned to hold the handle 612 in the two different positions. As shown in FIG. 32, the handle 612 is in the second position 616. The elastomeric material 524 can be a rubber band or the like. The rubber band 524 is pulling the handle 612 to further open, thereby biasing it to remain in the second position 616. FIG. 32 shows how the same rubber band 524 can then pull the handle 612 to remain in the first position 614 for flight.

In another exemplary embodiment, the body 602 may comprise a substantially missile-like shape. When the toy 600 is in the air, the weight of the handle 612 will rotate the front portion 604 downwards such that the handle 612 remains below the body 602. When the toy 600 is about to be thrown, the rear portion 606 must be weight biased to remain upright, because this embodiment does not include the equivalent of a thumb grip as did the Flying Football. This means that the overall weight of the rear portion 606 must have a center of gravity below the longitudinal axis 628 such that the wing 626 doesn't cause the rear portion 606 to rotate upside-down before a throw. This can be accomplished by placing a weight below the longitudinal axis 628 affixed to the rear portion 606. Once the toy 600 is in the air, the dihedral and high mounted wing location keeps the wings 626 upright during flight.

The overall weight of the toy 600 should be around 150 grams. The light weight allows a fast whipping action that is needed to reach increased velocities. Furthermore, a light weight toy 600 will impart less energy if it does hit an object, such as a person. Even though the toy 600 may be traveling extremely fast, it is hard to create an injury if the overall mass is extremely low.

Although several embodiments of the throwing and flying toy 600 have been described in detail for purposes of illustration, various modifications may be made to each without departing from the scope and spirit of the invention. Accordingly, the invention is not to be limited, except as by the appended claims.

As used herein throughout the entirety of this disclosure: substantially means largely but not wholly that which is specified; plurality means two or more; disposed means joined or coupled together or to bring together in a particular relation; and longitudinal means of, relating to, or occurring in the lengthwise dimension or relating to length.

Although several inventions and embodiments of each have been described in detail for purposes of illustration, various modifications may be made to each without departing from the scope and spirit of the invention. Accordingly, the invention is not to be limited, except as by the appended claims.

REFERENCE NUMBER LIST

Jetball

10 Self-Propelled Flying Toy
12 Body
14 Front Section
16 Center Section
18 Rear Section
20 Longitudinal Axis
22 Ducted Fan
24 Electric Motor
26 Electrical Power Source
27 Structural Supports
28 Air-Inlet
30 Air-Outlet
32 On-Off Switch
34 Accelerometer
36 Microcontroller
38 Air-Permeable Structure
40 Charging Port
42 Lever Switch
44 Lever
46 Switch Body
48 Button
50 Electrical Connection Stubs
52 Weight
54 Conductive Mass
56 Circuit Gap
58 Cylindrical Hole
60 Electrical Circuit
62 Reed Switch
64 Permanent Magnet
66 First Ducted Fan
68 Second Ducted Fan
70 Pitch Adjustable Single Ducted Fan
72 Laces
74 Sliding Hub
76 Main Hub
78 Linkage
80 Self Propelled Flying Toy
82 Angled Surfaces
84 Truncated End
86 Auxiliary Air-Inlet
88 Aperture
90 Smaller Gear
92 Larger Gear
94 Centrifugal Switches
96 Timer
98 First Section
100 Second Section
102 First Plastic Screen
104 Second Plastic Section
106 Electrical Board

PropRocket

200 Self-Propelled Rocket Toy
202 Elongated Body
204 Longitudinal Axis
206 Top End
208 Bottom End
210 Propeller

212 Electric Motor
214 Power Source
216 Activation Mechanism
218 Outwardly Extending Supports
220 Auxiliary Charger
222 Ring
224 Charger Port
226 Launch Button, On Body
228 Timer
230 Receiver
232 Remote Launch Transmitter
234 Centrifugal Switch
236 Stand
238 Tethered Launch Button
240 Launch Button, On Stand
242 Frame
244 Electrical Board
246 Air Flow, Support
248 Rotation, Support
250 Air Flow, Propeller
252 Rotation, Propeller
254 Flap
256 Stop
258 Extension
260 Guide
262 Track
264 Stand
266 Extension
268 Axis of Pivot
270 Surface
272 Distance Flying Football

300 Throwing or Catching Flying Toy
302 Structural Support
303 First End of Support
304 Lift-Generating Wing
305 Second End of Support
306 Body
307 Length of Body
308 Front Section
309 Equatorial Diameter
310 Rear Section
311 Front End of Body
312 Longitudinal Axis
313 Back End of Body
314 Tail
315 Front End of Toy
316 Tail Fin
317 Bottom of Body
318 Tail End
319 Center of Body
320 Thumb Grip
321 Top of Body
322 Bearing
324 Pitch Axis
326 Pivot
328 Screw
330 Bias
332 Dihedral Angle
334 Horizontal Section
336 Dihedral Section
338 Vacuum-Formed Plastic Part
340 Laces
342 Floor Stand
343 Protrusions on Floor Stand
344 Wing Centerline
346 Horizontal Stabilizer
348 Center of Gravity
349 Notch
350 Manual Adjuster
351 Nut
352 Nut Recess
353 Wall Stand Apertures
354 Push Surface
356 Spinner
357 Bearing
358 Rear Brace
359 Distance
360 Convex Upper Surface
362 Concave Lower Surface
364 Impact Transfer Surface
365 Impact Transfer Part
366 Vertical Stabilizer
368 Wing Bracket
370 Male-to-Female Connection
372 Male Portion
374 Female Portion
376 Recess
378 Finger Extensions Bowless Arrow

400 Bowless Arrow
402 Shaft
404 Forward End
406 Rear End
408 Slider
410 Front-Hand Support
412 Rear-Hand Support
414 Resiliently Stretchable Bias
416 Barbed End, Slider
418 Barbed End, Rear-Hand Grip
420 Cushion
422 Slider Cushion
424 Arrow Tip
426 Plurality Of Tail Fins
428 Lift-Generating Wing
430 Slot Catapult Javelin

500 Distance-Enhanced Throwing Toy
502 Elongated Shaft
504 Forward End
506 Rear End
508 Tail Fin
510 Tip
512 Elongated Handle
514 First Position
516 Second Position
518 Bias Mechanism
520 Grip
522 Pivot
524 Elastomeric Material Cruise Missile

600 Throwing And Flying Toy
602 Elongated Body
604 Front Portion
606 Rear Portion
608 Tail Fin

610 Tip
612 Elongated Handle
614 First Position
616 Second Position
518 Bias Mechanism
620 Grip
522 Pivot
524 Elastomeric Material
626 Lift-Generating Wing
628 Longitudinal Axis

What is claimed is:

1. A self-propelled rocket toy, comprising:

an elongated rocket body located along a longitudinal axis, the body defined as including a top end opposite a bottom end, wherein the longitudinal axis is vertically disposed with the top end disposed above the bottom end;

a propeller substantially centered about the longitudinal axis located about the bottom end of the body;

an electric motor mechanically connected to the propeller;

a power source electrically connected to the electric motor;

an activation mechanism electrically connected to the electric motor and power source;

wherein the electric motor and power source are disposed about the bottom end of the body adjacent to the propeller; and at least two supports disposed at the bottom end of the body and outwardly extending from and fixed relative to the body;

wherein a portion of the at least two supports extends past the propeller in a direction along the longitudinal axis; and wherein no electronic components are disposed in the top end of the body.

2. The self-propelled rocket toy of claim 1, wherein the power source is a rechargeable battery.

3. The self-propelled rocket toy of claim 2, wherein the rechargeable battery is a NiCad, NiMh or LiPo battery.

4. The self-propelled rocket toy of claim 2, wherein the rechargeable battery is a capacitor.

5. The self-propelled rocket toy of claim 1, wherein the at least two supports are disposed parallel to the longitudinal axis configured to slow a rotation of the body during a powered ascent.

6. The self-propelled rocket toy of claim 1, including a ring centered about the longitudinal axis and connected to each of a distal end of the at least two supports.

7. The self-propelled rocket toy of claim 1, including a flap pivotably attached to each of the at least two supports, wherein each flap is configured to create a rotation of the self-propelled rocket toy during a descent thereby resulting in an autorotation.

8. The self-propelled rocket toy of claim 7, wherein the rotation of the body of the self-propelled rocket toy during the descent due to each flap is in the same rotational direction as a rotation of the body of the self-propelled rocket toy during an ascent when powered by the propeller and the electric motor.

9. The self-propelled rocket toy of claim 1, wherein the at least two supports are fixed in position and configured as autorotation devices during a decent of the self-propelled rocket toy, each of the at least two supports being angled greater than 0 degrees and less than 90 degrees from parallel to the longitudinal axis in a similar angled direction relative to the propeller.

10. The self-propelled rocket toy of claim 9, wherein the rotation of the body of the self-propelled rocket toy during the descent due to the at least two supports is in the same rotational direction as a rotation of the body of the self-propelled rocket toy during an ascent when powered by the propeller and the electric motor.

11. The self-propelled rocket toy of claim 1, wherein the activation mechanism comprises a centrifugal switch disposed within the body and in communication with the electric motor and power source, wherein the centrifugal switch is configured to provide an electric current flow from the power source to the electric motor thereby spinning the propeller for a powered ascent upon detecting rotation about the longitudinal axis.

12. The self-propelled rocket toy of claim 1, wherein the activation mechanism is a launch button in communication with the electric motor and the power source, the launch button configured to be manually activated by a user, and when manually activated by the user is configured to provide an electric current flow from the power source to the electric motor thereby spinning the propeller for a powered ascent.

13. The self-propelled rocket toy of claim 12, including a countdown timer located within the body in communication with the electric motor and the power source, the countdown timer configured to delay the activation of the electric motor and propeller after the launch button is activated by the user.

14. The self-propelled rocket toy of claim 13, including a flight timer located within the body in communication with the electric motor and the power source, wherein the flight timer is configured to automatically turn off the electric motor during a powered ascent after a predetermined time.

15. The self-propelled rocket toy of claim 14, wherein the flight timer is configured to automatically turn off the electric motor after at least two different predetermined times thereby allowing the user to choose between at least two different heights to be reached during the powered ascent.

16. The self-propelled rocket toy of claim 1, including a rocket stand associated with the self-propelled rocket toy, wherein the self-propelled rocket toy is configured to be placed upon the rocket stand before a powered ascent.

17. The self-propelled rocket toy of claim 1, including a frame, wherein the power source, the electric motor and the propeller are connected to the frame and wherein the frame is attached to the bottom end of the body.

18. The self-propelled rocket toy of claim 1, wherein the propeller is configured to only rotate in one direction providing a forward thrust directed away from the elongated rocket body.

19. A self-propelled rocket toy, comprising:

an elongated rocket body located along a longitudinal axis, the body defined as including a top end opposite a bottom end;

a propeller substantially centered about the longitudinal axis located about the bottom end of the body;

an electric motor mechanically connected to the propeller;

a power source electrically connected to the electric motor;

an activation mechanism electrically connected to the electric motor and power source; and at least two supports outwardly extending from and fixed relative to the body;

wherein the at least two supports are configured as autorotation devices during a decent of the self-propelled rocket toy, each of the at least two supports angled greater than 0 degrees and less than 90 degrees from parallel to the longitudinal axis in a similar angled direction relative to the propeller, wherein the body is configured to rotate in a same rotational direction whether the self-propelled rocket toy is ascending with power or descending without power.

20. A self-propelled rocket toy, comprising:

an elongated rocket body located along a longitudinal axis, the body defined as including a top end opposite a bottom end;

a propeller substantially centered about the longitudinal axis located about the bottom end of the body;

an electric motor mechanically connected to the propeller;

a power source electrically connected to the electric motor;

an activation mechanism electrically connected to the electric motor and power source; and at least two supports outwardly extending from and fixed relative to the body;

a flap pivotably attached to each of the at least two supports, wherein each flap is configured to create a rotation of the self-propelled rocket toy during a descent thereby resulting in an autorotation, wherein the rotation of the body of the self-propelled rocket toy during the descent due to each flap is in the same rotational direction as a rotation of the body of the self-propelled rocket toy during an ascent when powered by the propeller and the electric motor.

21. A self-propelled rocket toy, comprising:

an elongated rocket body located along a longitudinal axis, the body defined as including a top end opposite a bottom end, wherein the longitudinal axis is vertically disposed with the top end disposed above the bottom end;

a propeller substantially centered about the longitudinal axis located about the bottom end of the body;

an electric motor mechanically connected to the propeller;

a power source electrically connected to the electric motor;

an activation mechanism electrically connected to the electric motor and power source; and a flight timer in electrical communication with the electric motor and the power source;

wherein the flight timer is configured to automatically turn off the electric motor during a powered ascent after a predetermined time; and wherein the flight timer is configured to automatically turn off the electric motor after at least two different predetermined times thereby allowing the user to choose between at least two different heights to be reached during the powered ascent.

22. A self-propelled rocket toy, comprising:

an elongated rocket body located along a longitudinal axis, the body defined as including a top end opposite a bottom end, wherein the longitudinal axis is vertically disposed with the top end disposed above the bottom end;

a propeller substantially centered about the longitudinal axis located about the bottom end of the body;

an electric motor mechanically connected to the propeller;

a power source electrically connected to the electric motor; and an activation mechanism electrically connected to the electric motor and power source;

wherein the activation mechanism comprises a centrifugal switch disposed within the body and in communication with the electric motor and power source, wherein the centrifugal switch is configured to provide an electric current flow from the power source to the electric motor thereby spinning the propeller for a powered ascent upon detecting rotation about the longitudinal axis.

23. A self-propelled rocket toy, comprising:

an elongated rocket body located along a longitudinal axis, the body defined as including a top end opposite a bottom end, wherein the longitudinal axis is vertically disposed with the top end disposed above the bottom end;

a propeller substantially centered about the longitudinal axis located about the bottom end of the body;

an electric motor mechanically connected to the propeller;

a power source electrically connected to the electric motor;

an activation mechanism electrically connected to the electric motor and power source;

at least two supports disposed at the bottom end of the body and outwardly extending from and fixed relative to the body; and a ring disposed at the bottom end of the body and centered about the longitudinal axis and connected to each of a distal end of the at least two supports;

wherein at least a portion of the ring or the at least two supports extends past the propeller in a direction along the longitudinal axis.

24. A self-propelled rocket toy, comprising:

an elongated rocket extending along a longitudinal axis, the rocket defining a top end opposite a bottom end;

a propeller centered about the longitudinal axis located about the bottom end of the rocket;

an electric motor mechanically connected to the propeller;

a power source electrically connected to the electric motor;

an activation mechanism electrically connected to the electric motor and the power source; and at least two fins outwardly extending from rocket;

wherein at least a portion of each of the at least two fins are pivotably attached to the rocket;

wherein the at least a portion are configured to be in a first position during an ascent of the self-propelled rocket toy and pivot to a second position during a descent of the self-propelled rocket toy;

wherein the at least a portion in the first position during the ascent are configured to slow a rotation of the self-propelled rocket toy during the ascent as the rocket spins in an opposite rotational direction in comparison to a propeller's rotational direction due to a rotational torque from the propeller; and wherein the at least a portion in the second position are configured as an autorotation device during the descent of the self-propelled rocket toy, the autorotation device configured to spin the self-propelled rocket toy during the descent.

* * * * *